US011253898B2

(12) United States Patent
Sanders et al.

(10) Patent No.: US 11,253,898 B2
(45) Date of Patent: Feb. 22, 2022

(54) HOT-FORMING PRESSES AND METHODS OF HOT-FORMING WORKPIECES

(71) Applicant: The Boeing Company, Chicago, IL (US)

(72) Inventors: Daniel Gordon Sanders, Cle Elum, WA (US); Robert Charles Larsen, Bonney Lake, WA (US); Donald Lloyd Conaway, Gig Harbor, WA (US)

(73) Assignee: The Boeing Company, Chicago, IL (US)

( * ) Notice: Subject to any disclaimer, the term of this patent is extended or adjusted under 35 U.S.C. 154(b) by 231 days.

(21) Appl. No.: 16/164,603

(22) Filed: Oct. 18, 2018

(65) Prior Publication Data

US 2020/0122215 A1 Apr. 23, 2020

(51) Int. Cl.
*B21D 22/02* (2006.01)

(52) U.S. Cl.
CPC ..... *B21D 22/022* (2013.01)

(58) Field of Classification Search
CPC .... B21D 22/022; B21D 22/208; B21D 37/16; B30B 15/34; B30B 15/04; B30B 15/41;
(Continued)

(56) References Cited

U.S. PATENT DOCUMENTS 3,461,709 A * 8/1969 McMillen ..... B21K 29/00 72/342.92
4,145,908 A 3/1979 Miller
(Continued)

FOREIGN PATENT DOCUMENTS

CN 207347389 5/2018
EP 0246838 11/1987
(Continued)

OTHER PUBLICATIONS

SITEMA Rod locking unit 13DEC2012; from web archive, accessed Oct. 28, 2020 https://web.archive.org/web/20121212001752/http://www.sitema.com/en/products/locking_units/index.php (Year: 2012).*
(Continued)

*Primary Examiner* — Adam J Eiseman
*Assistant Examiner* — Fred C Hammers
(74) *Attorney, Agent, or Firm* — Dascenzo Gates Intellectual Property Law, P.C.

(57) ABSTRACT

A hot-forming press (100) comprises a lower press assembly (102) and an upper press assembly (108). The lower press assembly (102) is movable along a vertical axis and comprises a lower die (106), and a lower hot-box portion (104), configured to receive the lower die (106). The upper press assembly (108) is movable along the vertical axis above the lower press assembly (102) and comprises an upper die (112), and an upper hot-box portion (110). The upper hot-box portion (110) is configured to receive the upper die (112) so that the upper die (112) is positioned opposite the lower die (106). The lower die (106) and the upper die (112) are configured to apply a forming pressure to a workpiece (114) that is received between the lower die (106) and the upper die (112). The lower hot-box portion (104) and the upper hot-box portion (110) are configured to heat the workpiece (114).

21 Claims, 26 Drawing Sheets

(58) Field of Classification Search
CPC ..... B30B 15/45; B29C 33/306; C21D 9/46; C21D 1/40; C21D 1/673; C09J 5/10
See application file for complete search history.

(56) References Cited

U.S. PATENT DOCUMENTS

| | | | | |
|---|---|---|---|---|
| 4,259,054 | A * | 3/1981 | Savage | B30B 15/045 425/344 |
| 4,552,525 | A * | 11/1985 | Stehr | B21J 13/14 164/347 |
| 5,158,641 | A | 10/1992 | Vermeulen et al. | |
| 5,419,170 | A | 5/1995 | Sanders et al. | |
| 5,728,309 | A | 3/1998 | Matsen et al. | |
| 6,655,268 | B2 | 12/2003 | Comley et al. | |
| 7,708,845 | B2 | 5/2010 | Tetyukhin et al. | |
| 7,850,058 | B2 | 12/2010 | Connelly et al. | |
| 9,623,977 | B2 | 4/2017 | Runyan et al. | |
| 2003/0079619 | A1* | 5/2003 | Comley | B30B 15/34 100/38 |
| 2004/0212109 | A1* | 10/2004 | Fujimoto | B29C 33/02 264/1.32 |
| 2010/0166903 | A1 | 7/2010 | Krajewski et al. | |
| 2011/0300254 | A1* | 12/2011 | Wang | B21D 37/02 425/450.1 |
| 2013/0074568 | A1* | 3/2013 | Robbins | B21C 29/02 72/272 |
| 2015/0344986 | A1* | 12/2015 | Hwang | B21D 22/208 148/566 |
| 2016/0136712 | A1* | 5/2016 | Ooyama | B21D 22/022 219/154 |
| 2016/0193645 | A1* | 7/2016 | Sanders | C04B 35/66 72/342.8 |
| 2016/0228934 | A1 | 8/2016 | Frost et al. | |
| 2016/0312502 | A1* | 10/2016 | Miyamoto | E05C 1/08 |
| 2018/0117654 | A1* | 5/2018 | Hubbes | B22D 17/26 |

FOREIGN PATENT DOCUMENTS

| | | |
|---|---|---|
| EP | 2548670 | 1/2013 |
| EP | 3257601 | 12/2017 |
| EP | 3132867 | 7/2019 |
| WO | WO03037611 | 5/2003 |

OTHER PUBLICATIONS

SITEMA Rod locking unit Dec. 13, 2012; from web archive, accessed Oct. 28, 2020 https://web.archive.org/web/20121212001752/http://www.sitema.com/en/products/locking_units/index.php (Year: 2012).*

Multizone heater Apr. 22, 2015; from web archive, accessed Oct. 28, 2020 (https://web.archive.org/web/20151026152340/https://www.nph-processheaters.com/multi-maxi-zone-cartridge-heaters/) (Year: 2015).*

European Patent Office, Extended European Search Report for related European Application No. 19195880, dated Mar. 18, 2020.

Machine-generated English language translation of abstract of EP 2548670, downloaded from Espacenet.com on Nov. 12, 2020.

Machine-generated English language translation of abstract of CN 207347389 downloaded from Espacenet.com on Nov. 12, 2020.

* cited by examiner

HOT-FORMING PRESSES AND METHODS OF HOT-FORMING WORKPIECES

FIELD

The present disclosure relates to hot-forming presses

BACKGROUND

Conventional hot-forming presses are expensive. For example, in the aerospace industry, a hot-forming press, capable of processing large parts, may cost in excess of US$2.5 million and even as much as US$10 million. Moreover, conventional hot-forming presses require expensive maintenance and are subject to unpredictable down-time, which adversely effects manufacturing cycle time. In addition, if a hot-forming press fails in operation, expensive rework of parts, being processed by the press at the time of failure, is often needed. As a worst-case scenario, such parts must be scrapped, resulting in significant additional costs.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter, according to the invention, relates to a hot-forming press. The hot-forming press comprises a lower press assembly and an upper press assembly. The lower press assembly is movable along a vertical axis and comprises a lower die, and a lower hot-box portion, configured to receive the lower die. The upper press assembly is movable along the vertical axis above the lower press assembly and comprises an upper die, and an upper hot-box portion. The upper hot-box portion is configured to receive the upper die so that the upper die is positioned opposite the lower die. The lower die and the upper die are configured to apply a forming pressure to a workpiece that is received between the lower die and the upper die. The lower hot-box portion and the upper hot-box portion are configured to heat the workpiece.

By having both the lower press assembly and the upper press assembly movable along a vertical axis, the component(s) of the hot-forming press that apply a forming force to generate the forming pressure (i.e., the tonnage of the hot-forming press) for application to the workpiece need not have a significant stroke length that accounts both for operative placement of the workpiece and removal of a formed part from the hot-forming press and for application of the forming force. Similarly, the component(s) of the hot-forming press that apply a forming force to generate the forming pressure need not have a stroke length that also accounts for removal and replacement of the lower die and the upper die. Accordingly, the component(s) of the hot-forming press that apply the forming force to generate the forming pressure undergo less stress over the same number of cycles than prior art hot-forming presses, thus requiring less maintenance and repair over the lifetime of the hot-forming press.

Another example of the subject matter, according to the invention, relates to a hot box of a hot-forming press. The hot box comprises a lower hot-box portion and an upper hot-box portion. The lower hot-box portion comprises a lower housing, a lower heating plate, and a lower insulation layer. The lower heating plate is received within the lower housing and is configured to support a lower die. The lower insulation layer is positioned between the lower housing and the lower heating plate. The upper hot-box portion is positionable above the lower hot-box portion and comprises an upper housing, an upper heating plate, and an upper insulation layer. The upper heating plate is received within the upper housing and is configured to support an upper die. The upper insulation layer is positioned between the upper housing and the upper heating plate. The lower hot-box portion and the upper hot-box portion provide a thermal barrier around a workpiece that is received between the lower die and the upper die, when the lower hot-box portion and the upper hot-box portion are in contact with each other.

The hot box provides a thermal barrier to maintain the heat delivered to the lower die and the upper die, and thus to the workpiece, when the hot-forming press is operatively forming a part from the workpiece. The lower housing provides structure for supporting the other components of the lower hot-box portion. The lower insulation layer insulates the lower heating plate, which is configured to support the lower die and conduct heat thereto, and thereby facilitates efficient heating of the lower die by restricting conduction away from the lower die. Similarly, the upper housing provides structure for supporting the other components of the upper hot-box portion. The upper insulation layer insulates the upper heating plate, which is configured to support the upper die and conduct heat thereto, and thereby facilitates efficient heating of the upper die by restricting conduction away from the upper die.

Yet another example of the subject matter, according to the invention, relates to a method of hot-forming a workpiece. The method comprises a step of vertically moving both a lower press assembly and an upper press assembly to a loading configuration, in which the lower press assembly and the upper press assembly are spaced-apart to receive the workpiece. The method comprises a step of positioning the workpiece between a lower die of the lower press assembly and an upper die of the upper press assembly. The method further comprises a step of vertically moving both the lower press assembly and the upper press assembly to a closed configuration, in which the lower press assembly and the upper press assembly are positioned to apply a forming pressure to the workpiece. The method also comprises a step of immobilizing the upper press assembly. The method further comprises a step of moving the lower press assembly toward the upper press assembly to apply the forming pressure to the workpiece. The method also comprises a step of heating the workpiece.

By vertically moving both the lower press assembly and the upper press assembly between the loading configuration and the closed configuration, the component(s) of the hot-forming press that apply a forming force to generate the forming pressure (i.e., the tonnage of the hot-forming press) for application to the workpiece need not have a significant stroke length that accounts both for operative placement of the workpiece and removal of a formed part from the hot-forming press and for application of the forming force. Similarly, the component(s) of the hot-forming press that apply a forming force to generate the forming pressure need not have a stroke length that also accounts for removal and replacement of the lower die and the upper die. Accordingly, the component(s) of the hot-forming press that apply the forming force to generate the forming pressure undergo less stress over the same number of cycles than prior art hot-forming presses, thus requiring less maintenance and repair over the lifetime of the hot-forming press.

By immobilizing the upper press assembly, the component(s) associated with vertically moving the upper press assembly need not be capable of applying a forming force that is sufficient to generate the required forming pressure to operatively deform the workpiece. Rather, only the component(s) associated with vertically moving the lower press assembly need be capable of applying a forming force that is sufficient to generate the required forming pressure to operatively deform the workpiece. As a result, the component(s) associated with vertically moving the upper press assembly may be significantly less expensive than the component(s) associated with vertically moving the lower press assembly.

Yet another example of the subject matter, according to the invention, relates to a method of hot-forming a workpiece. The method comprises a step of delivering an actively determined amount of heat to distinct lower regions of a lower heating plate of a lower hot-box portion of a hot box of a hot-forming press or to distinct upper regions of an upper heating plate of an upper hot-box portion of the hot box.

By vertically moving both the lower press assembly and the upper press assembly between the loading configuration and the closed configuration, the component(s) of the hot-forming press that apply a forming force to generate the forming pressure (i.e., the tonnage of the hot-forming press) for application to the workpiece need not have a significant stroke length that accounts both for operative placement of the workpiece and removal of a formed part from the hot-forming press and for application of the forming force. Similarly, the component(s) of the hot-forming press that apply a forming force to generate the forming pressure need not have a stroke length that also accounts for removal and replacement of the lower die and the upper die. Accordingly, the component(s) of the hot-forming press that apply the forming force to generate the forming pressure undergo less stress over the same number of cycles than prior art hot-forming presses, thus requiring less maintenance and repair over the lifetime of the hot-forming press.

By immobilizing the upper press assembly, the component(s) associated with vertically moving the upper press assembly need not be capable of applying a forming force that is sufficient to generate the required forming pressure to operatively deform the workpiece. Rather, only the component(s) associated with vertically moving the lower press assembly need be capable of applying a forming force that is sufficient to generate the required forming pressure to operatively deform the workpiece. As a result, the component(s) associated with vertically moving the upper press assembly may be significantly less expensive than the component(s) associated with vertically moving the lower press assembly.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

Figure 1A:
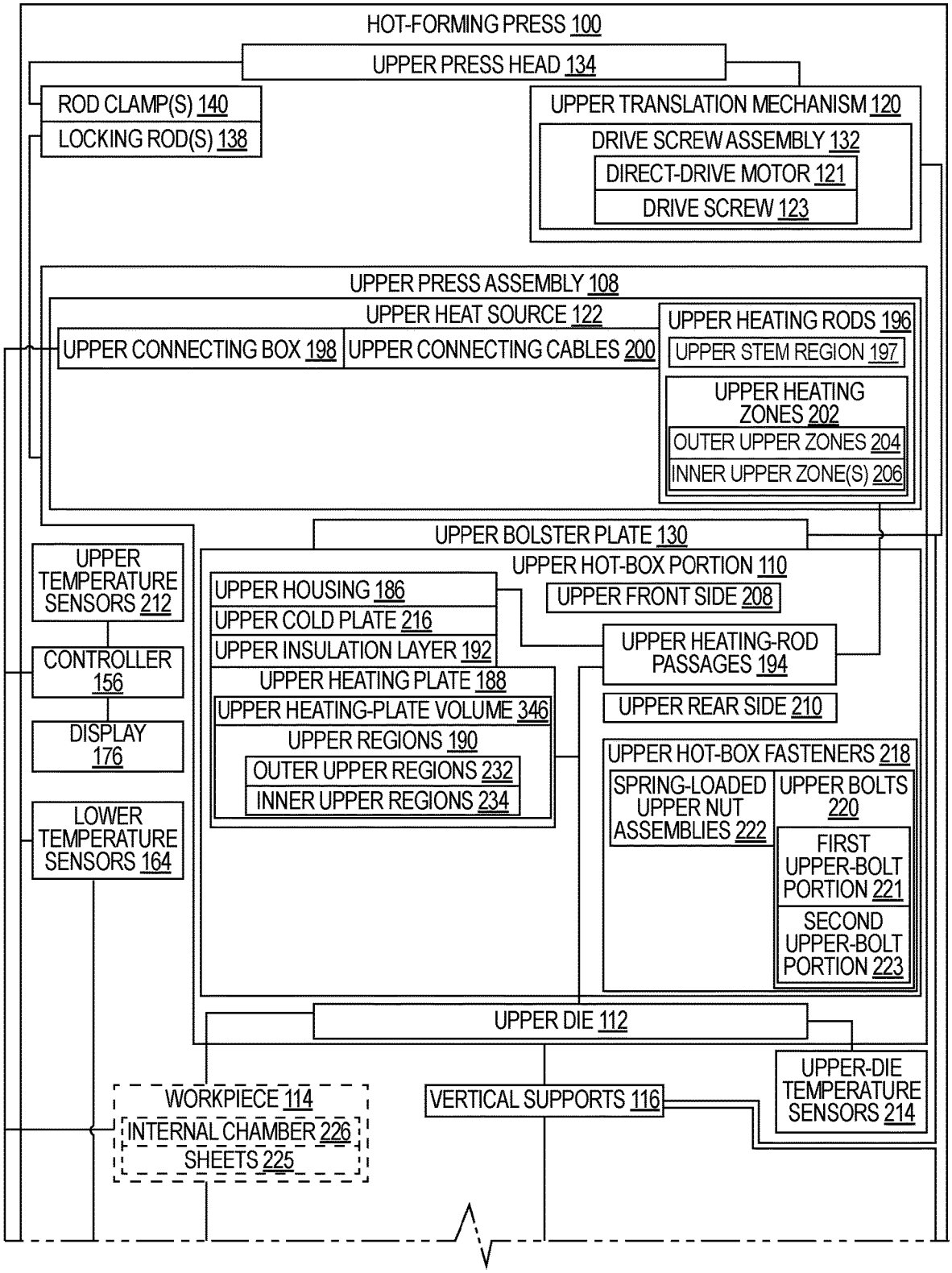
Figure 1B:
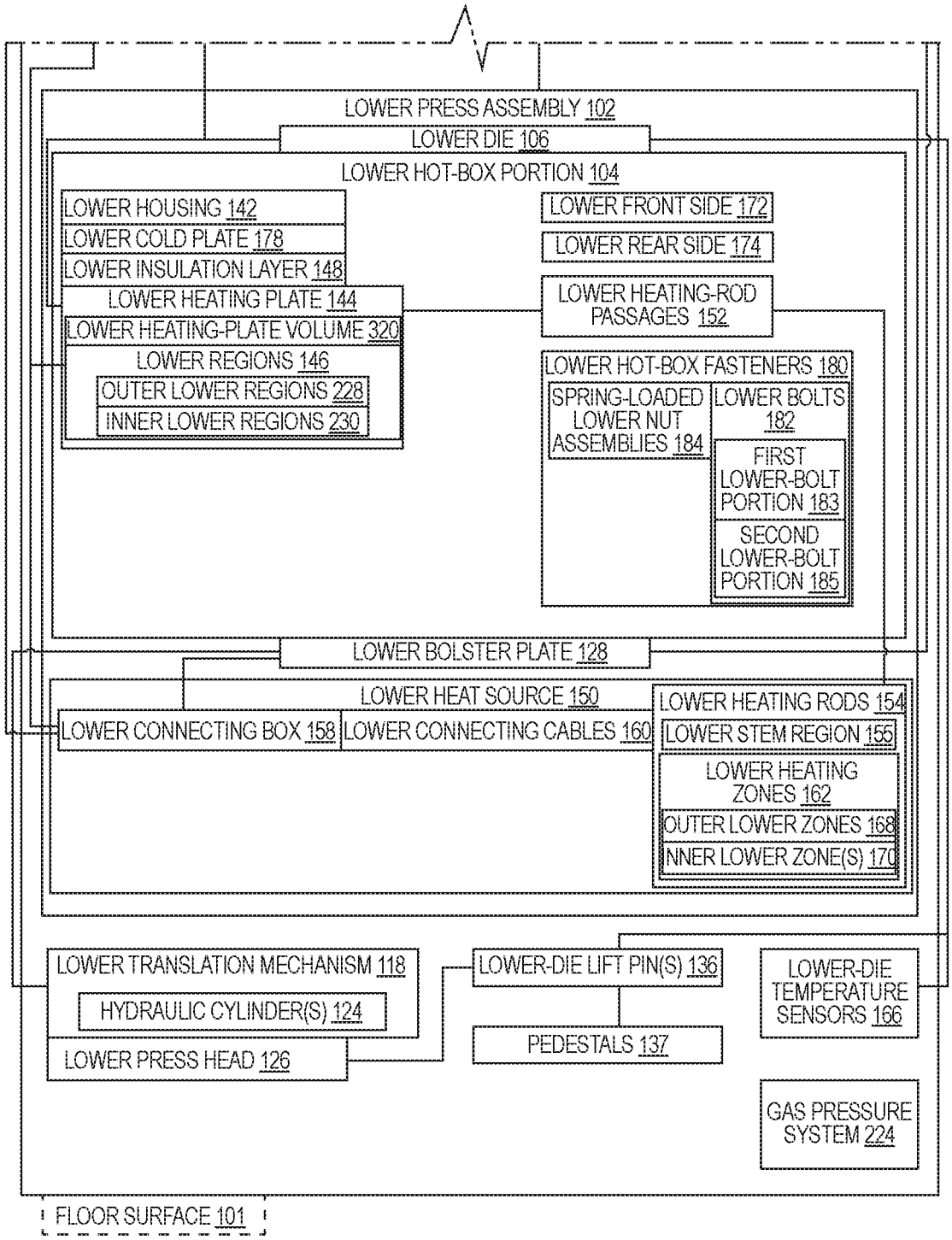
Figure 2A:
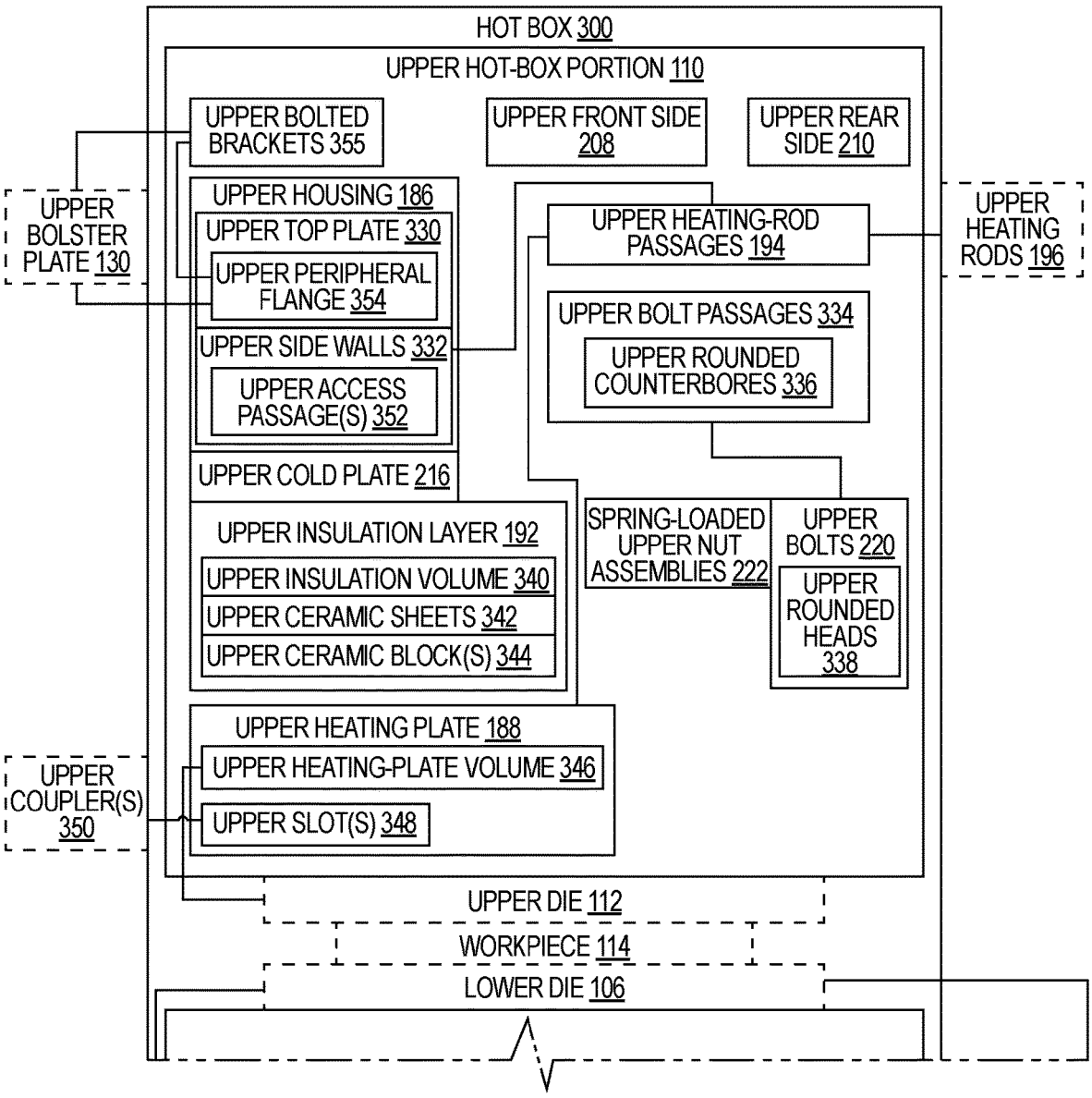
Figure 2B:
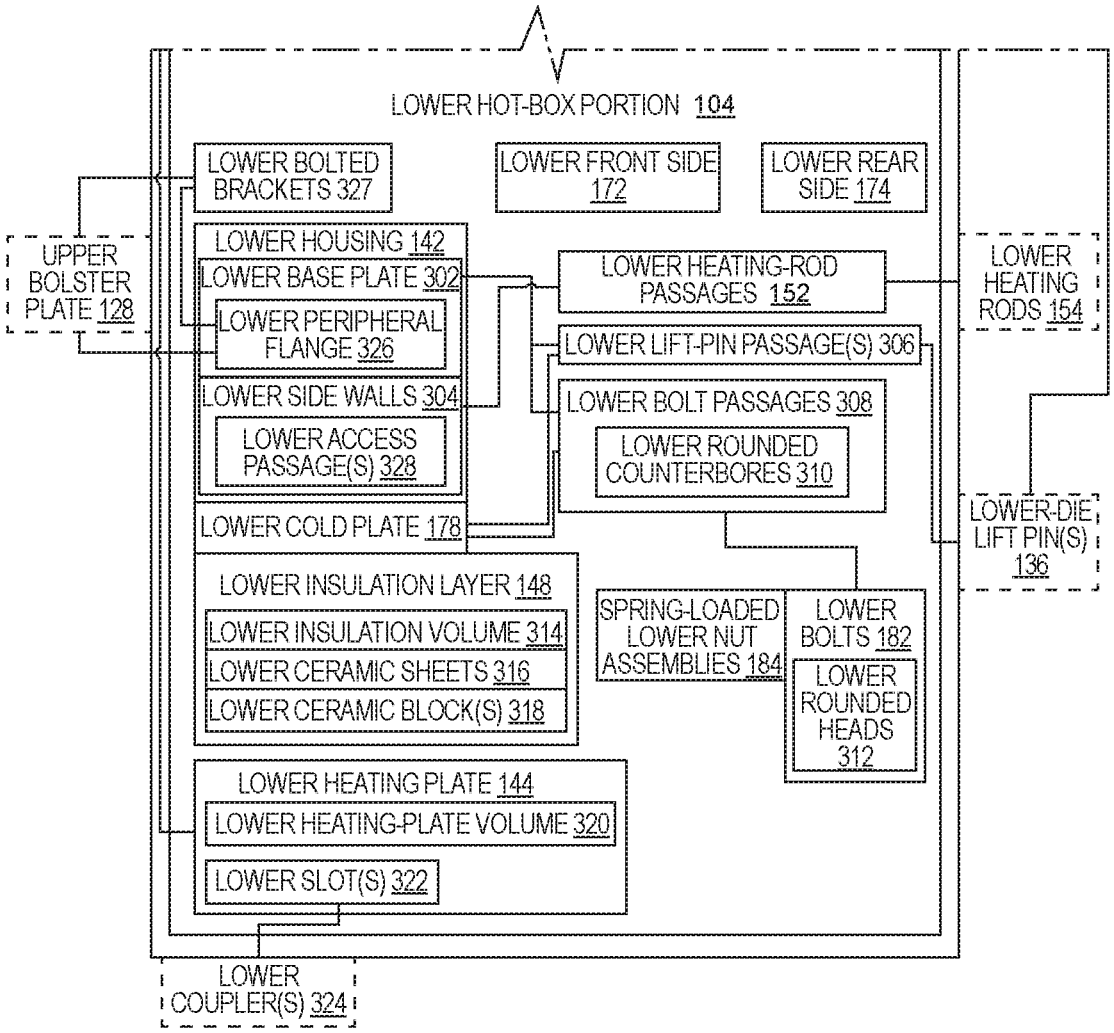
Figure 3:
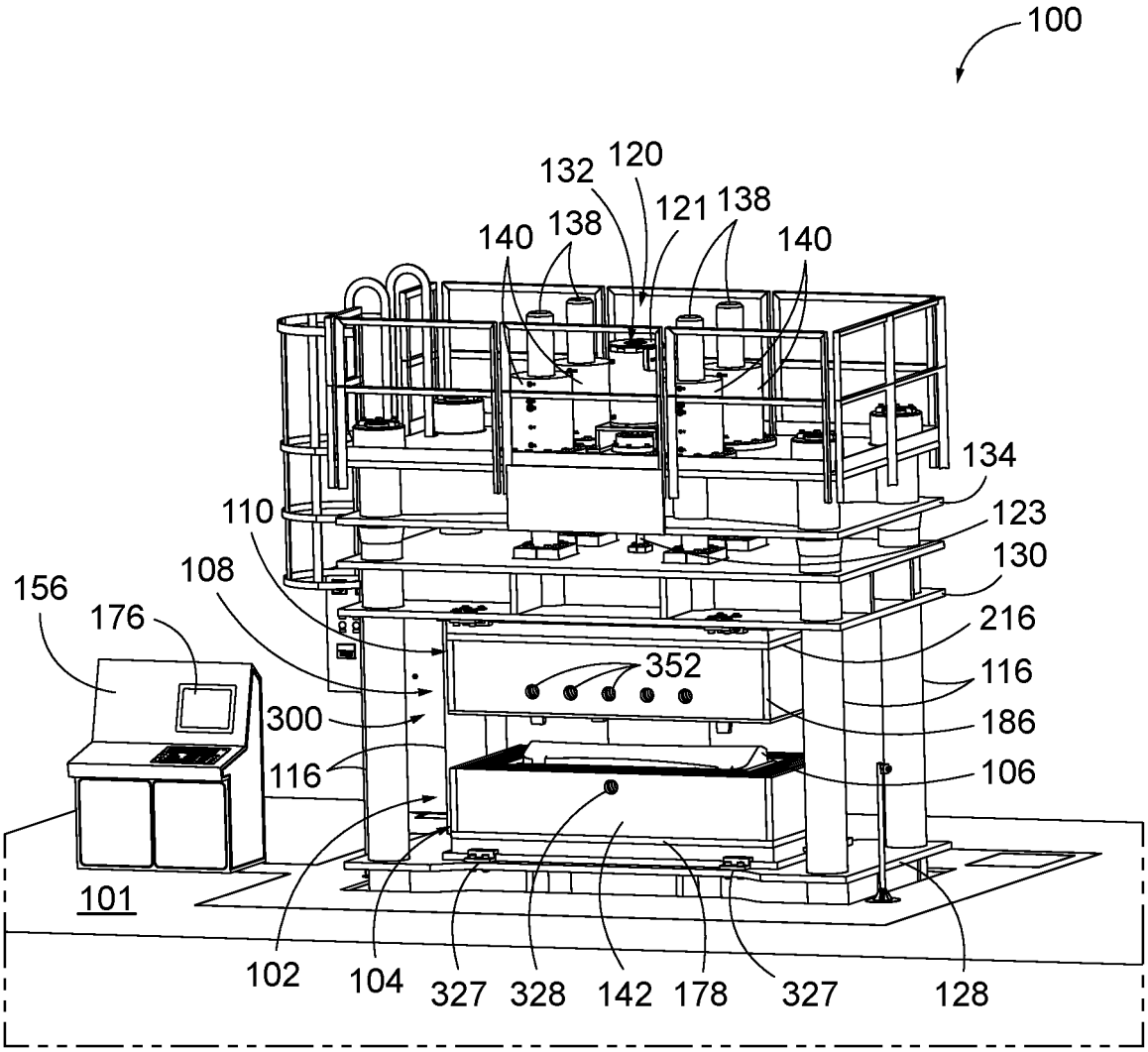
Figure 4:
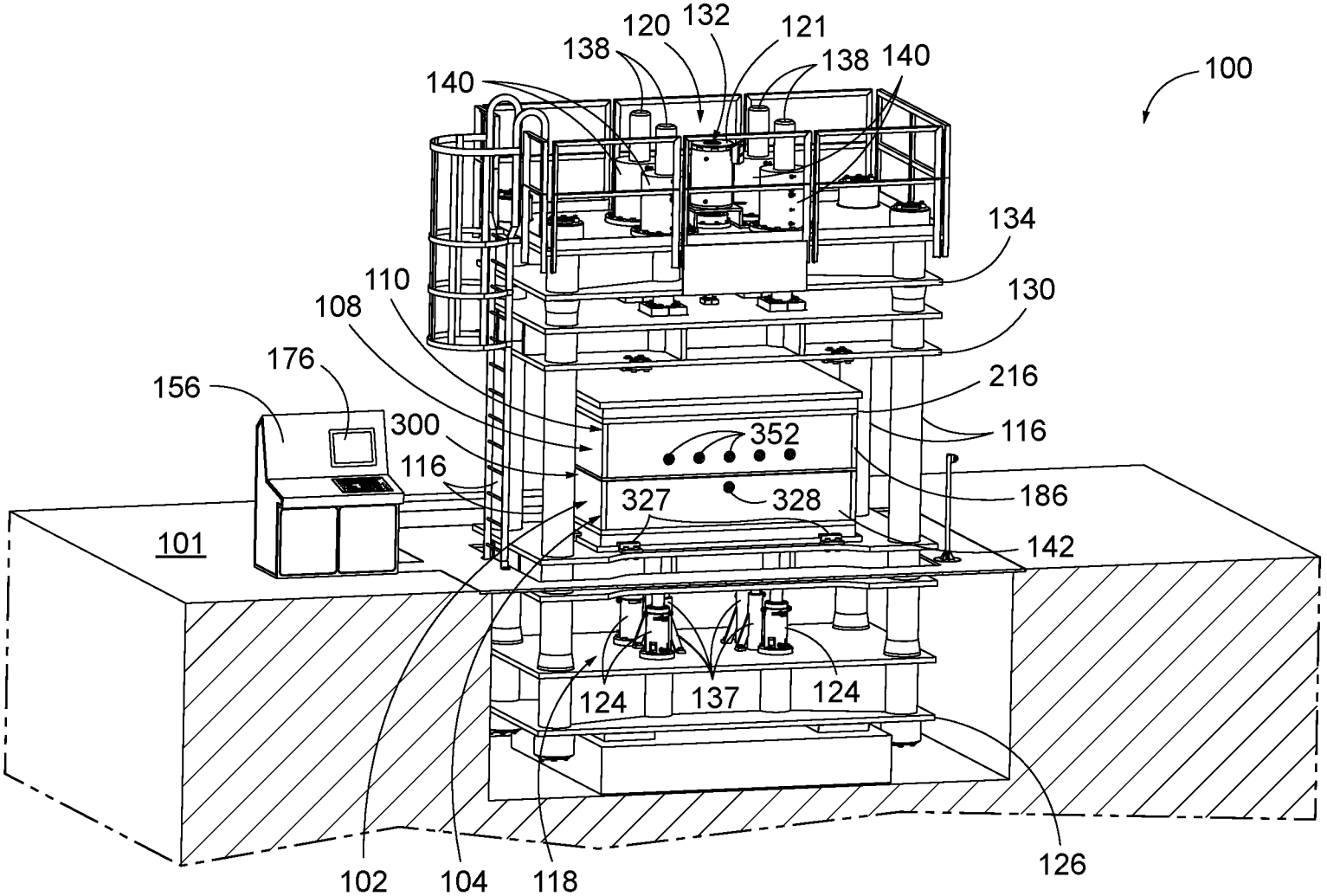
Figure 5:
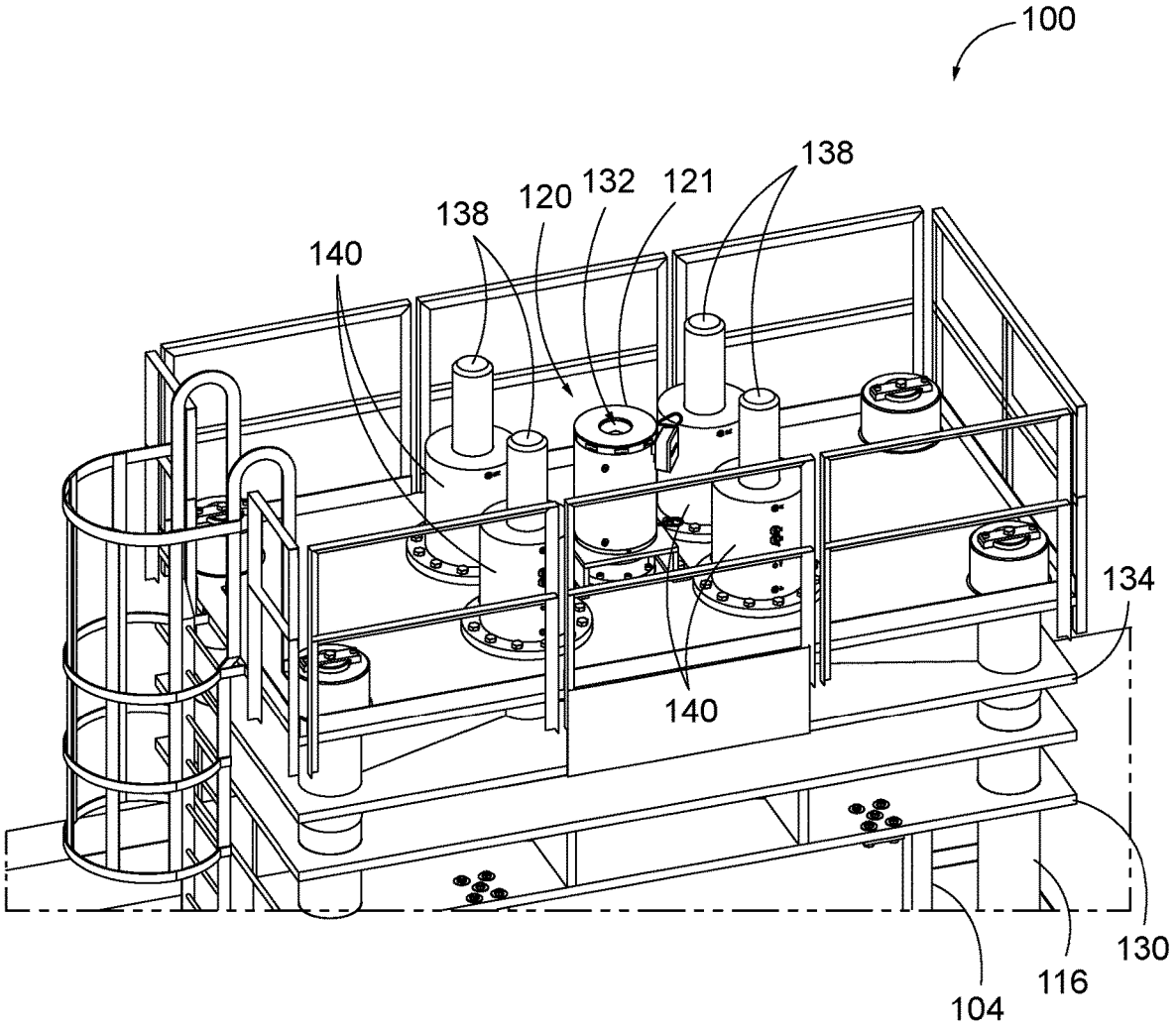
Figure 6:
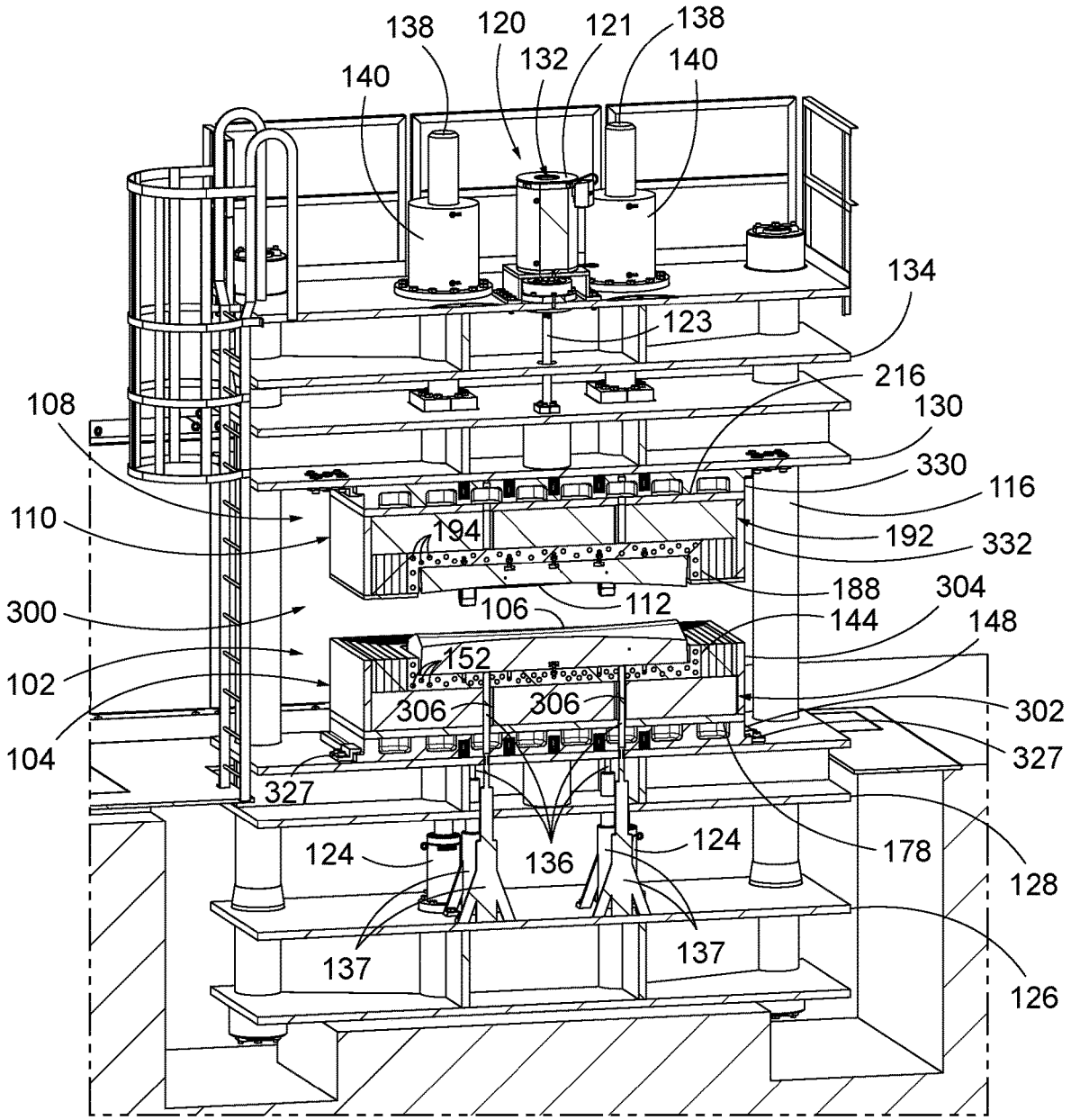
Figure 7:
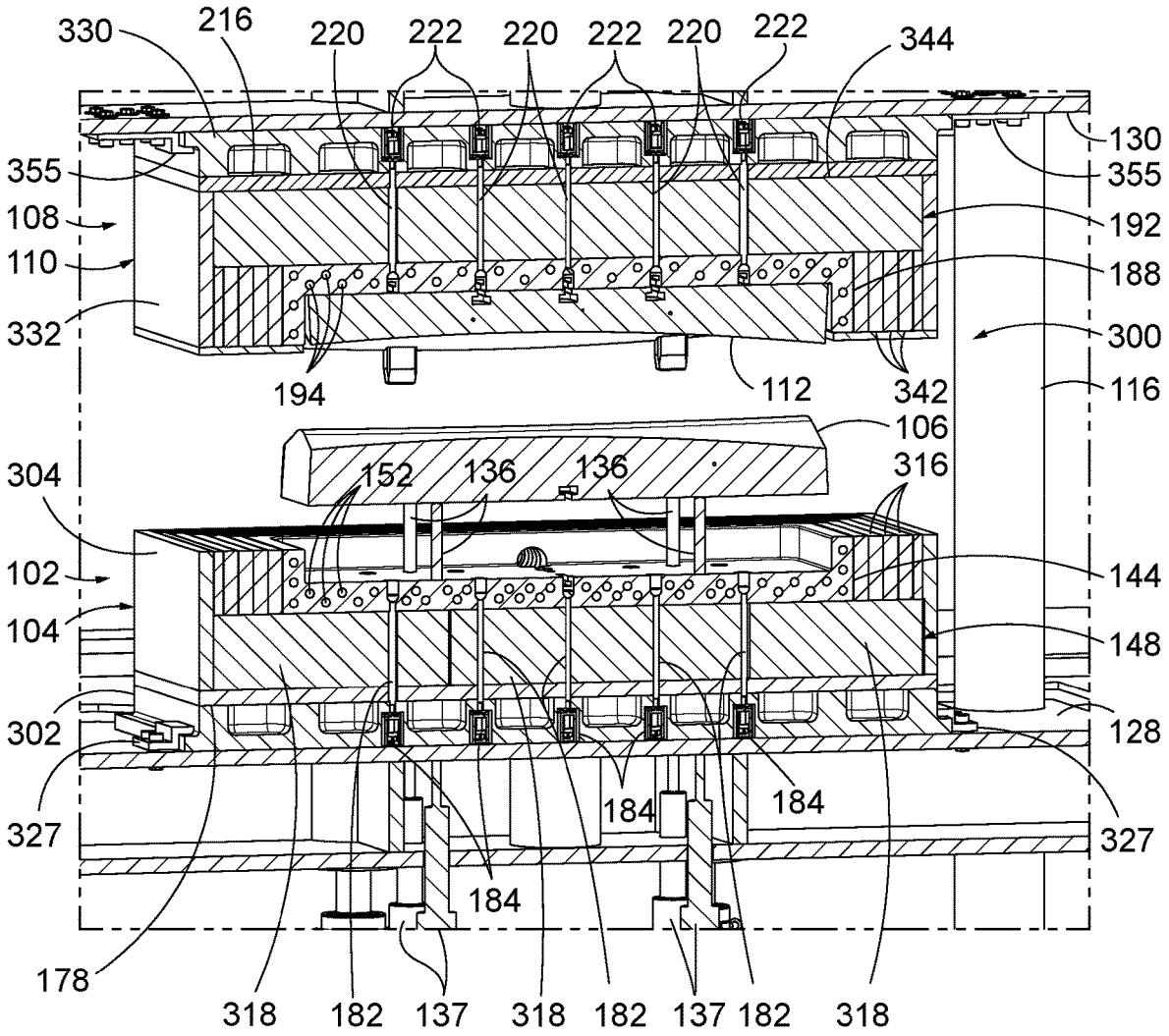
Figure 8:
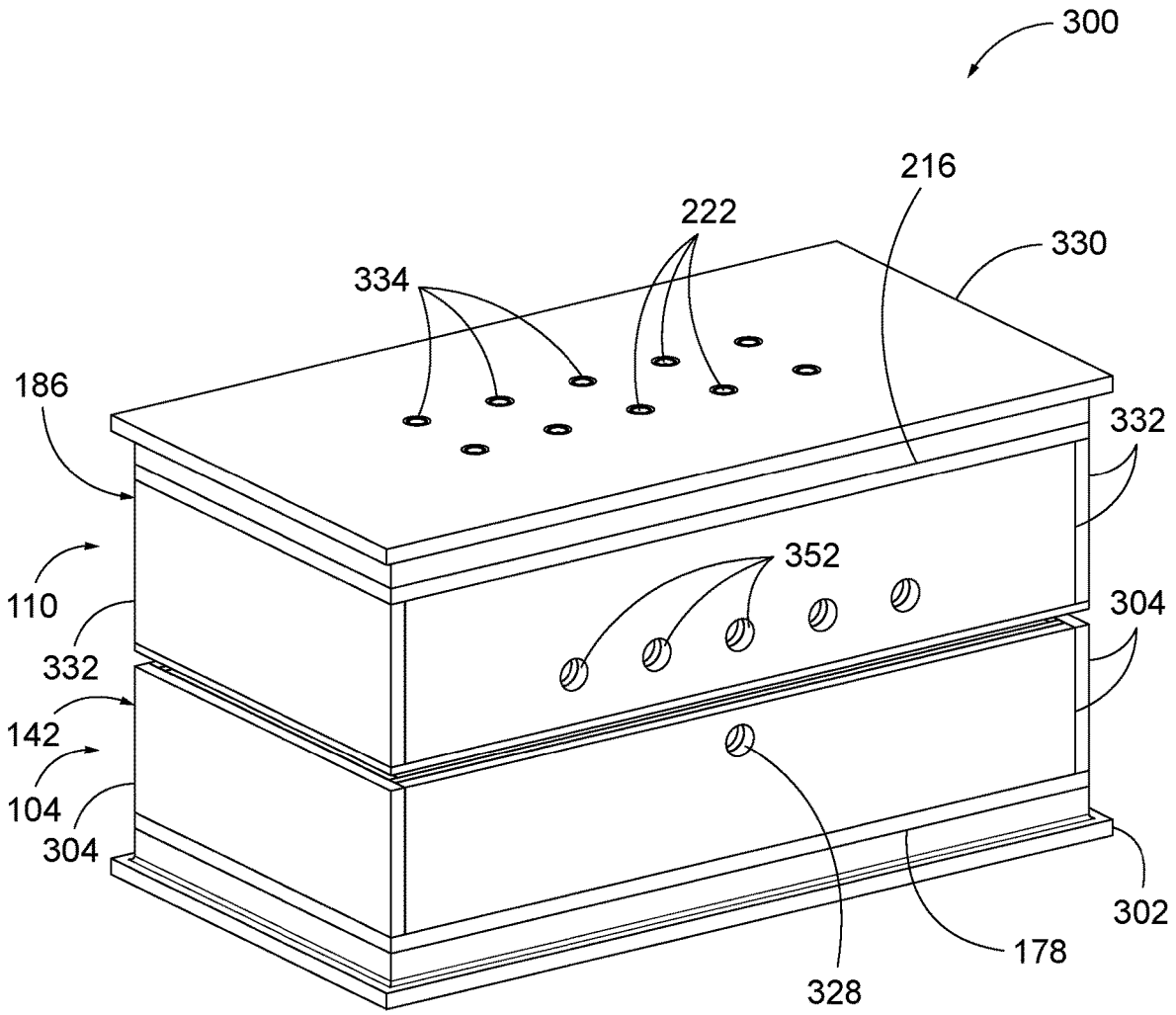
Figure 9:
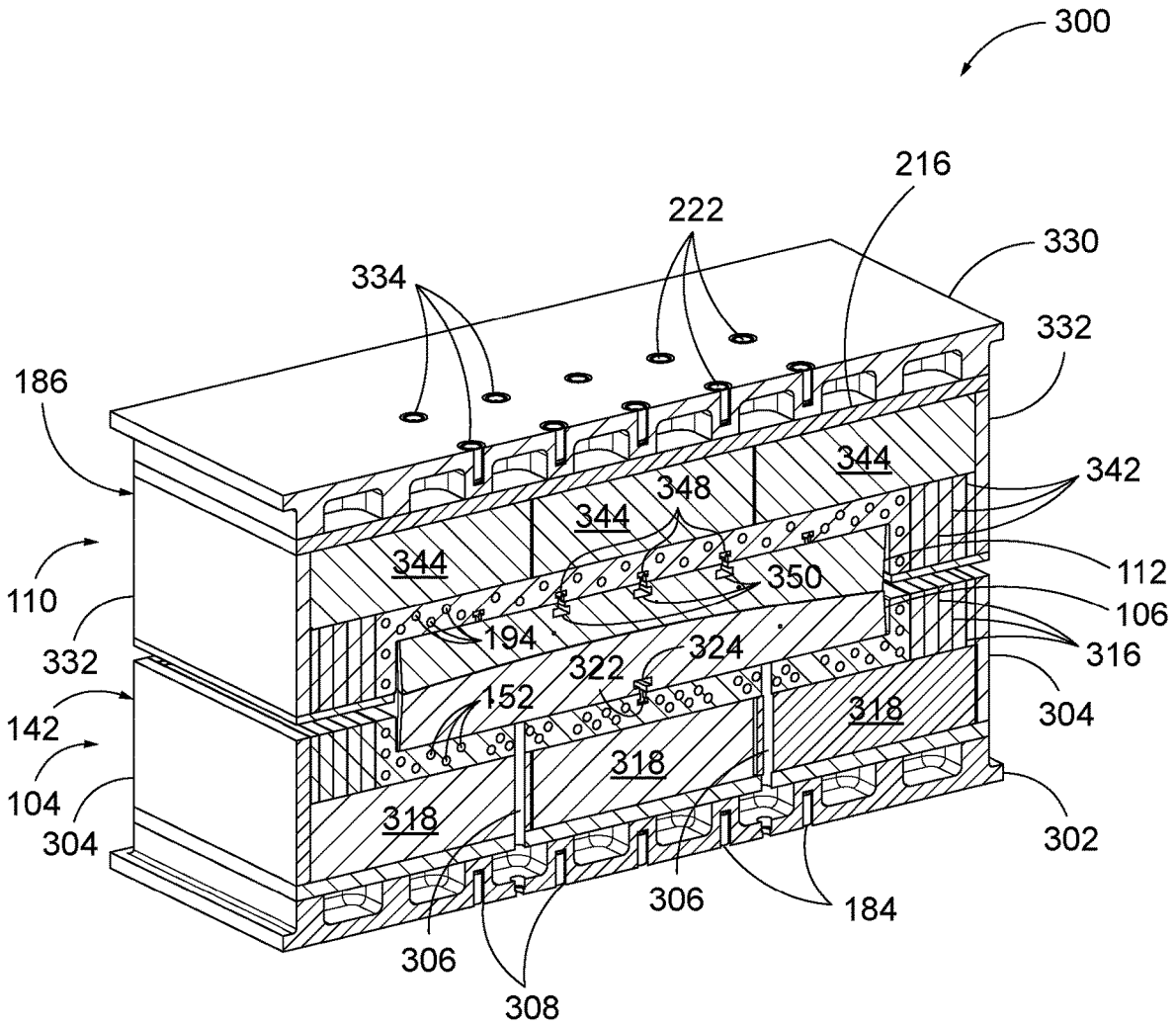
Figure 10:
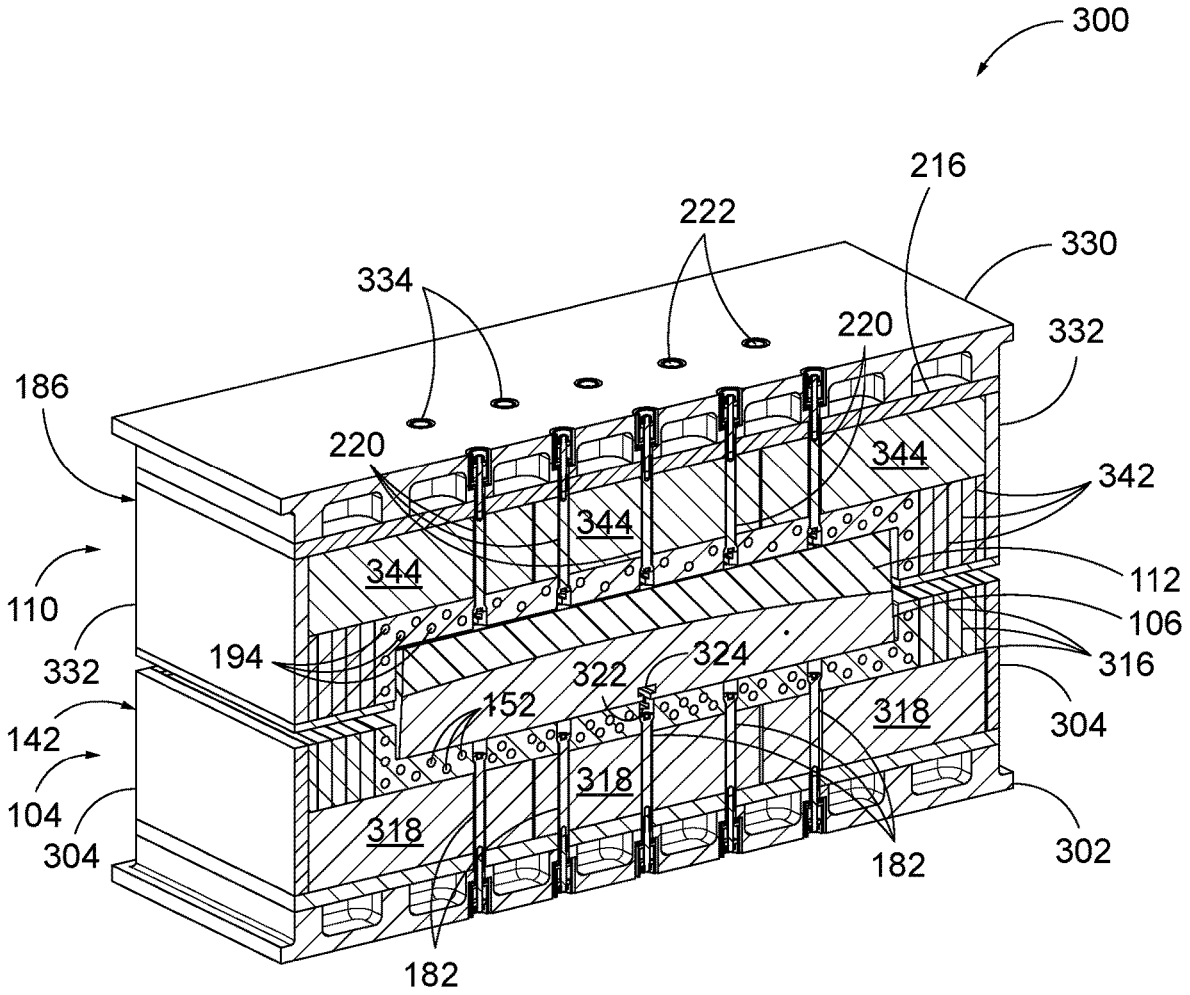
Figure 11:
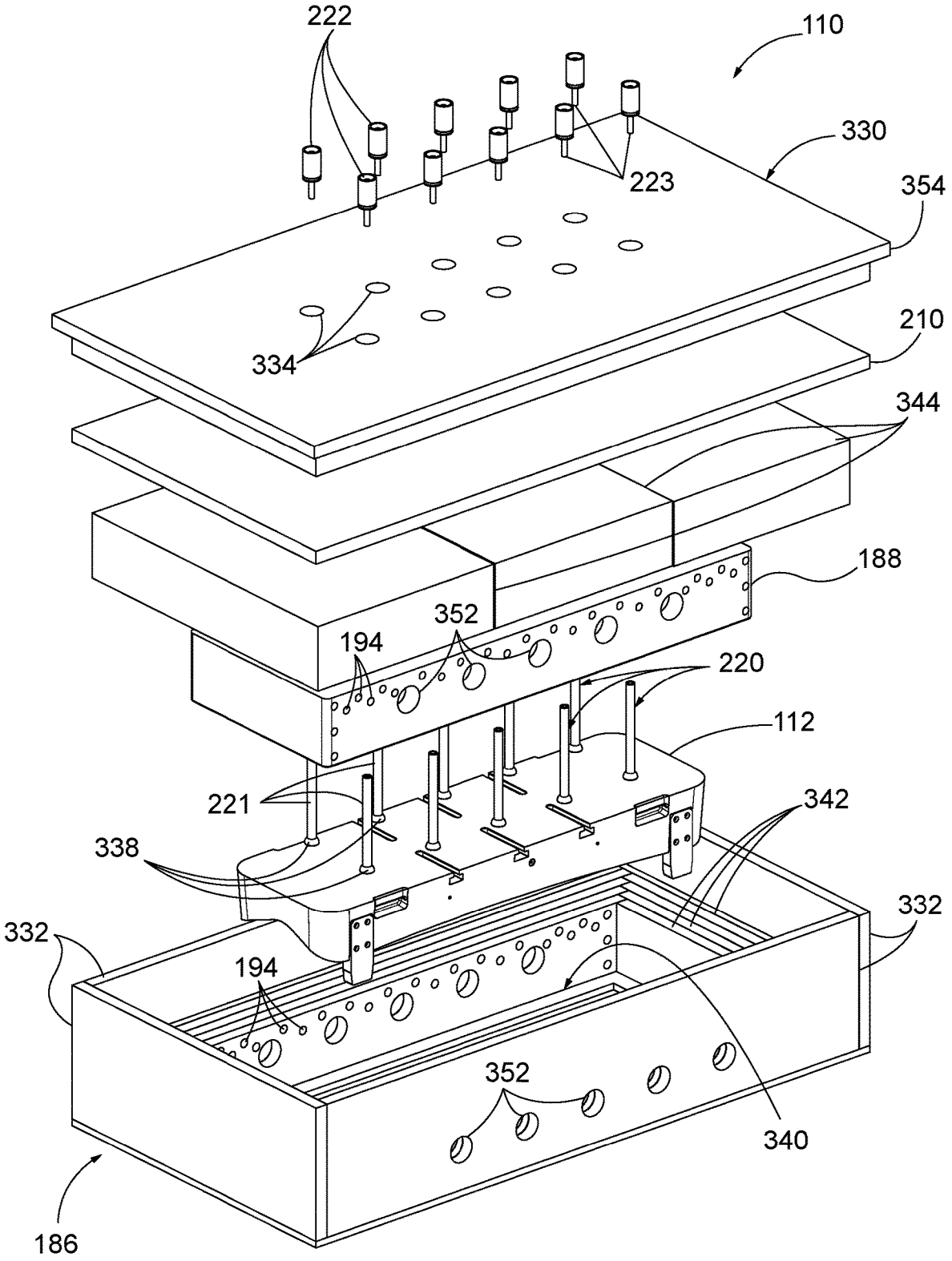
Figure 12:
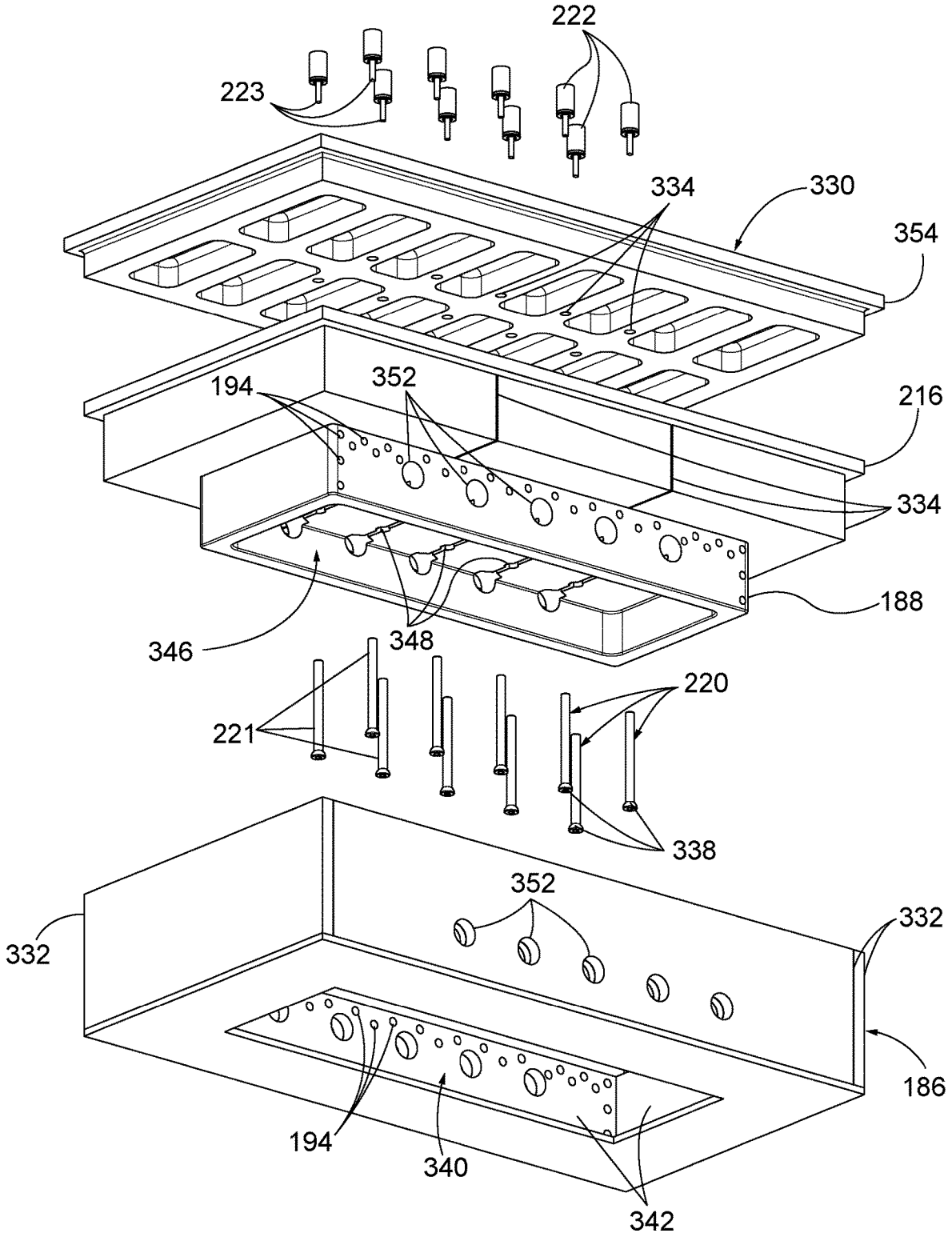
Figure 13:
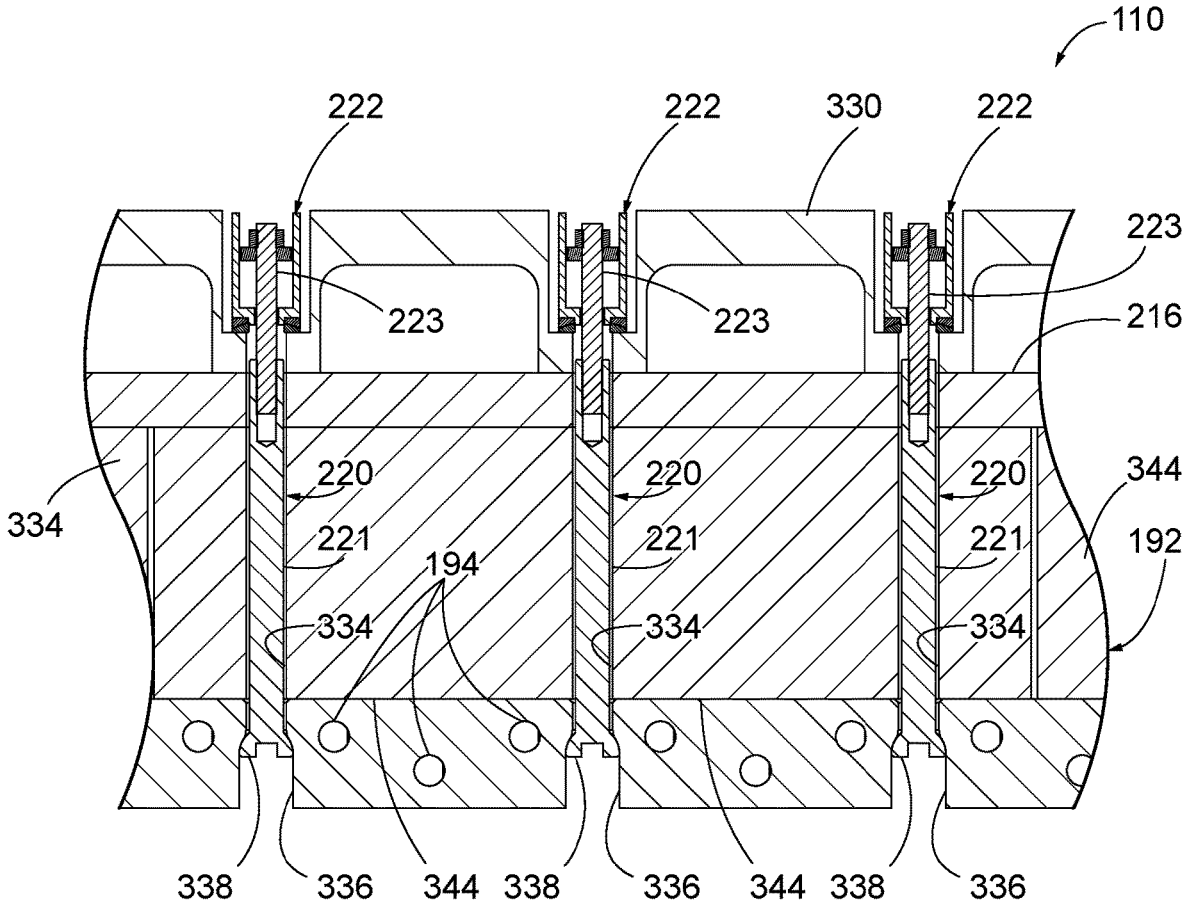
Figure 14:
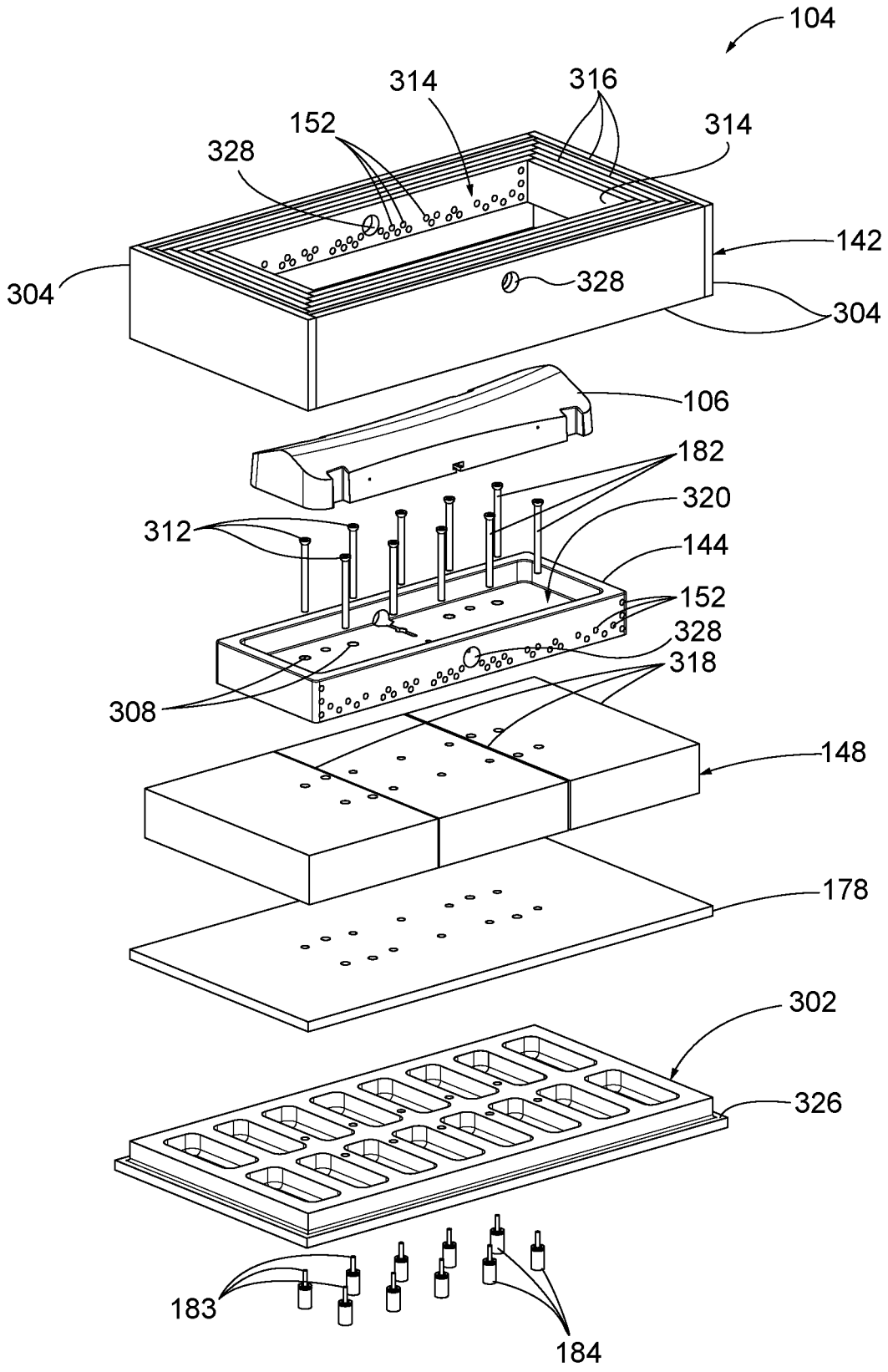
Figure 15:
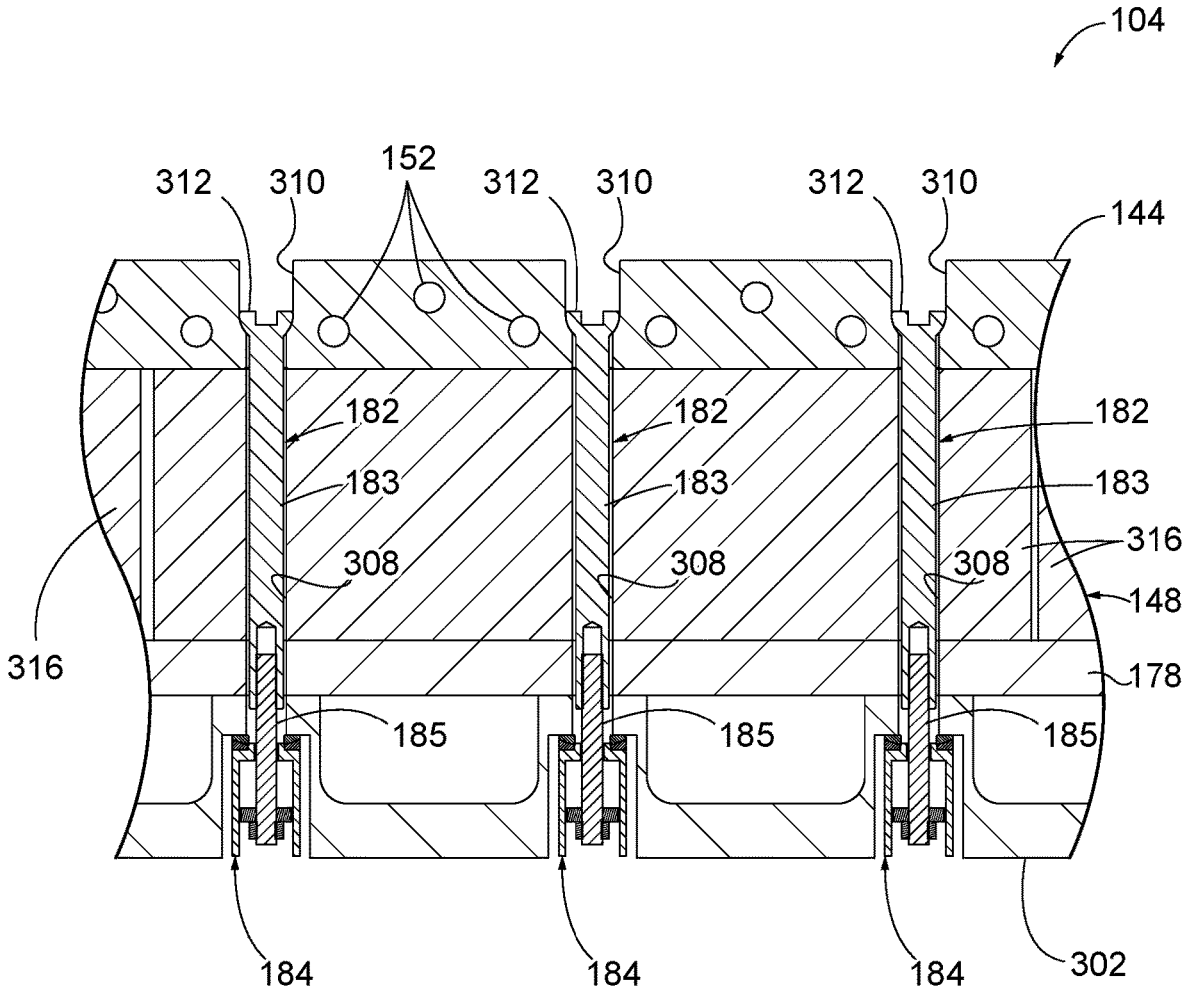
Figure 16:
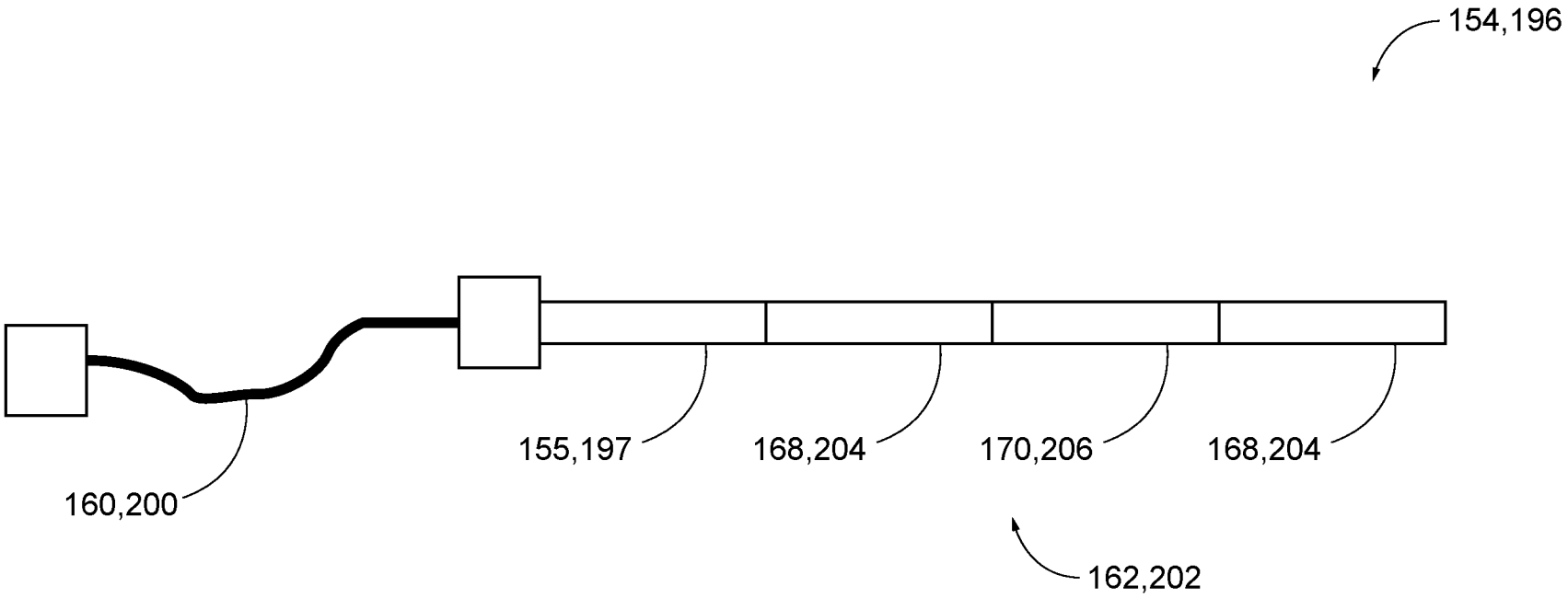
Figure 17:
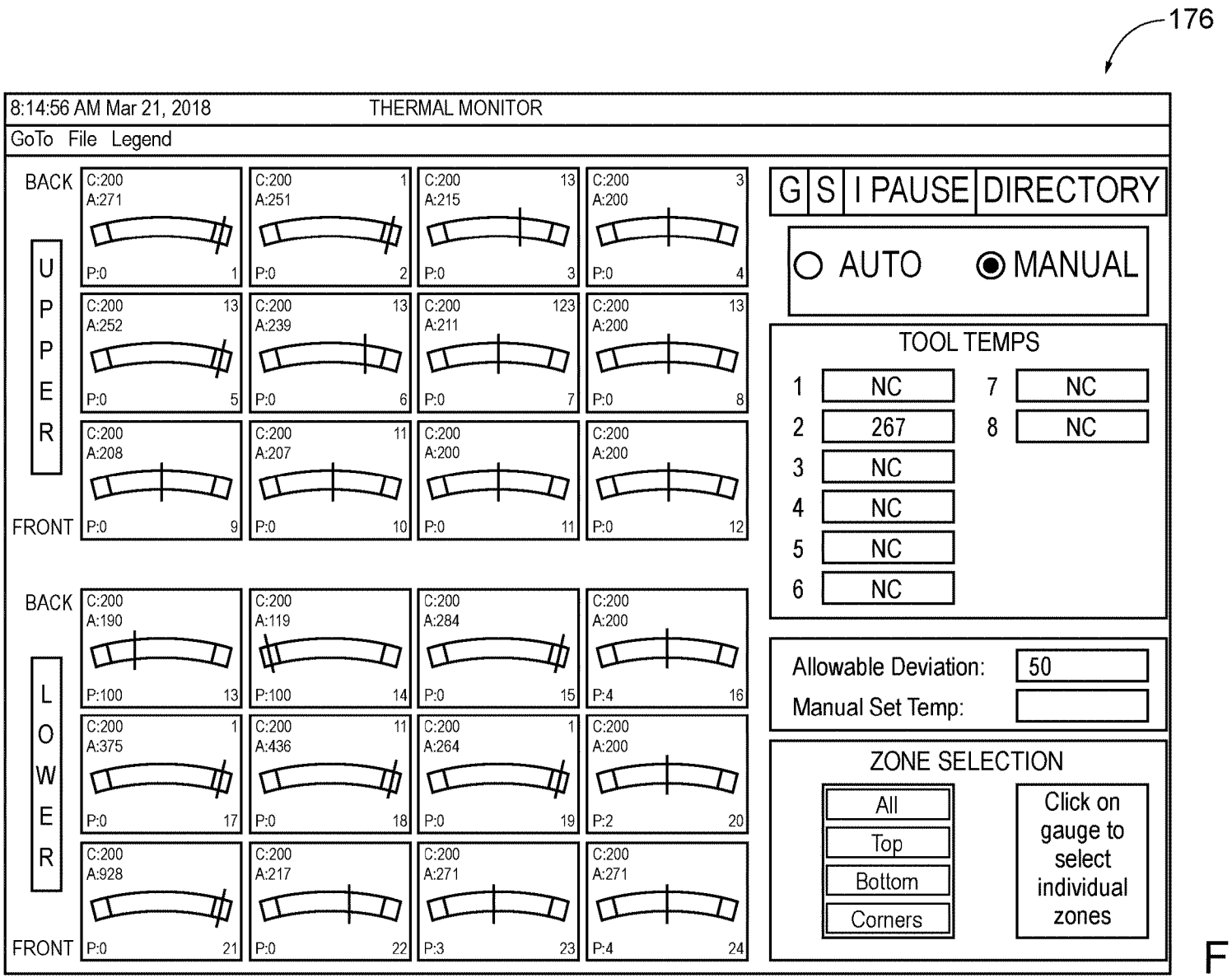
Figure 18:
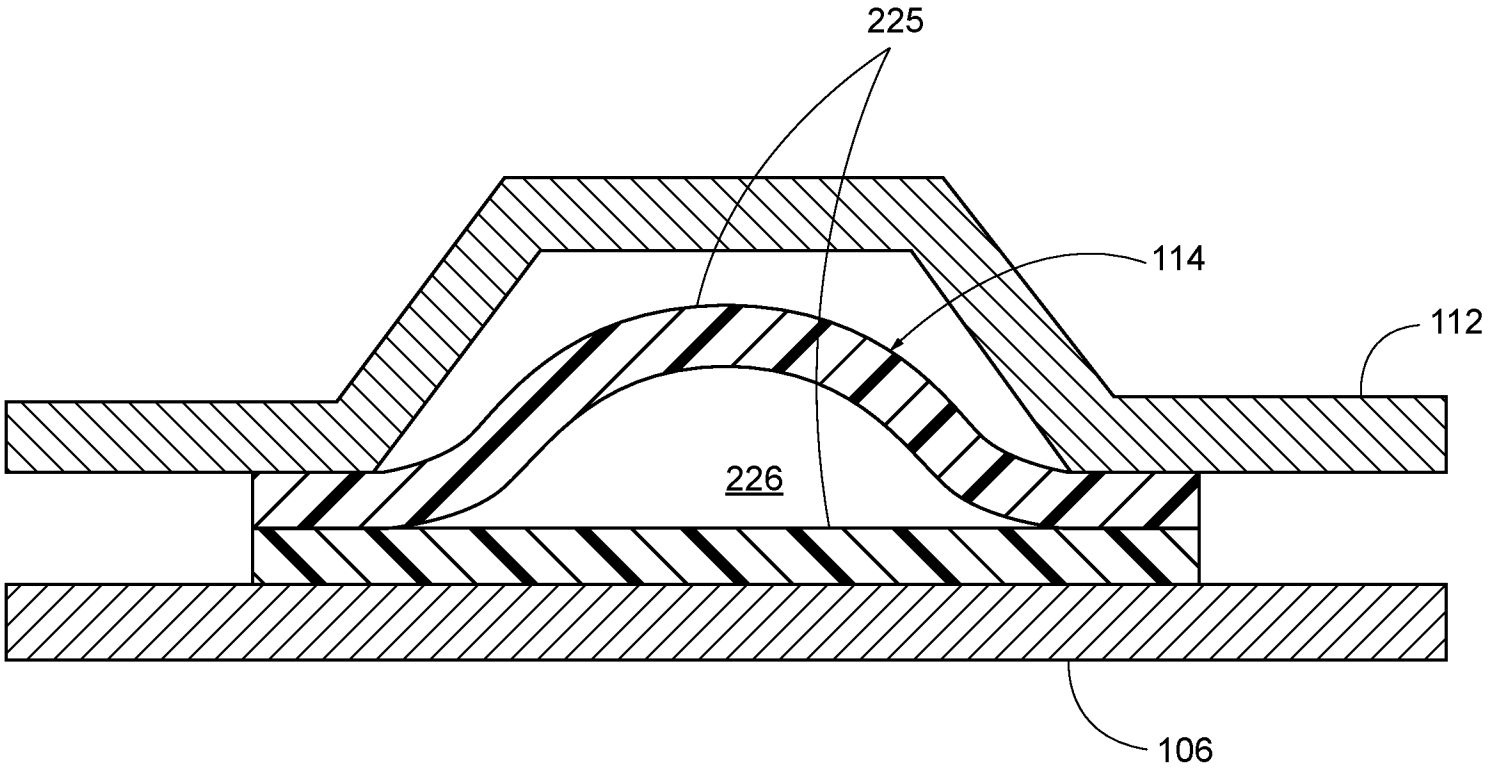
Figure 19:
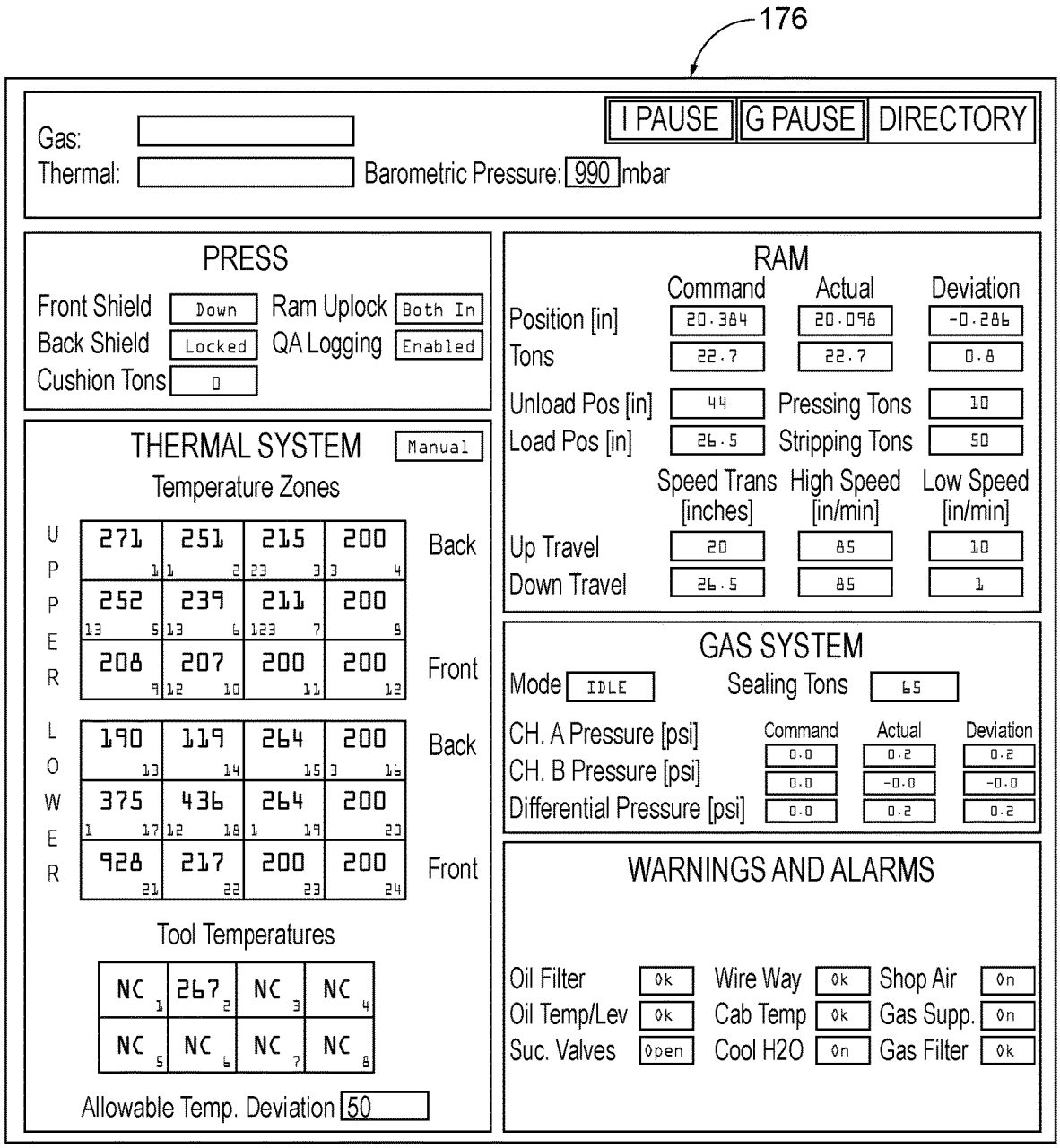
Figure 20A:
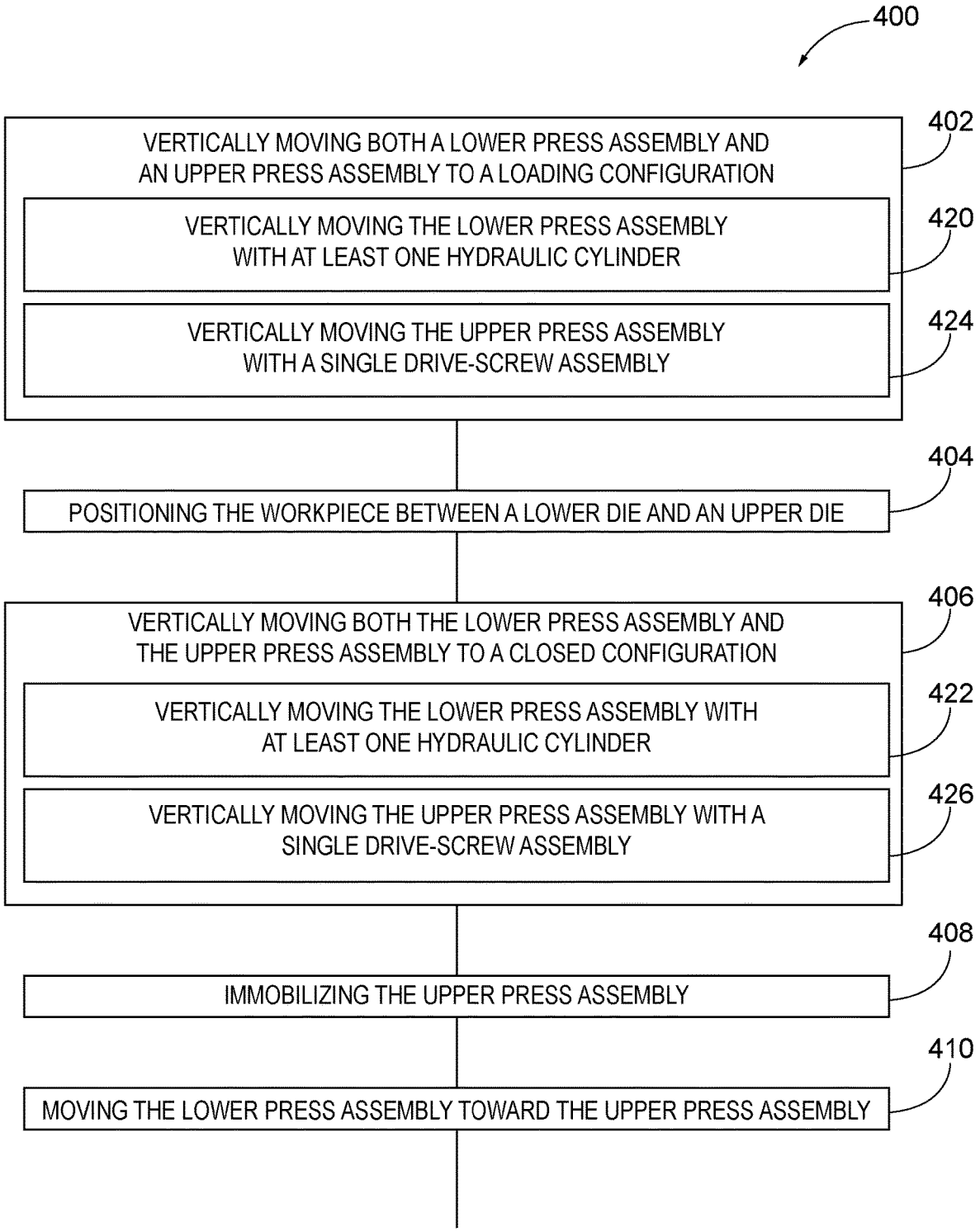
Figure 20B:
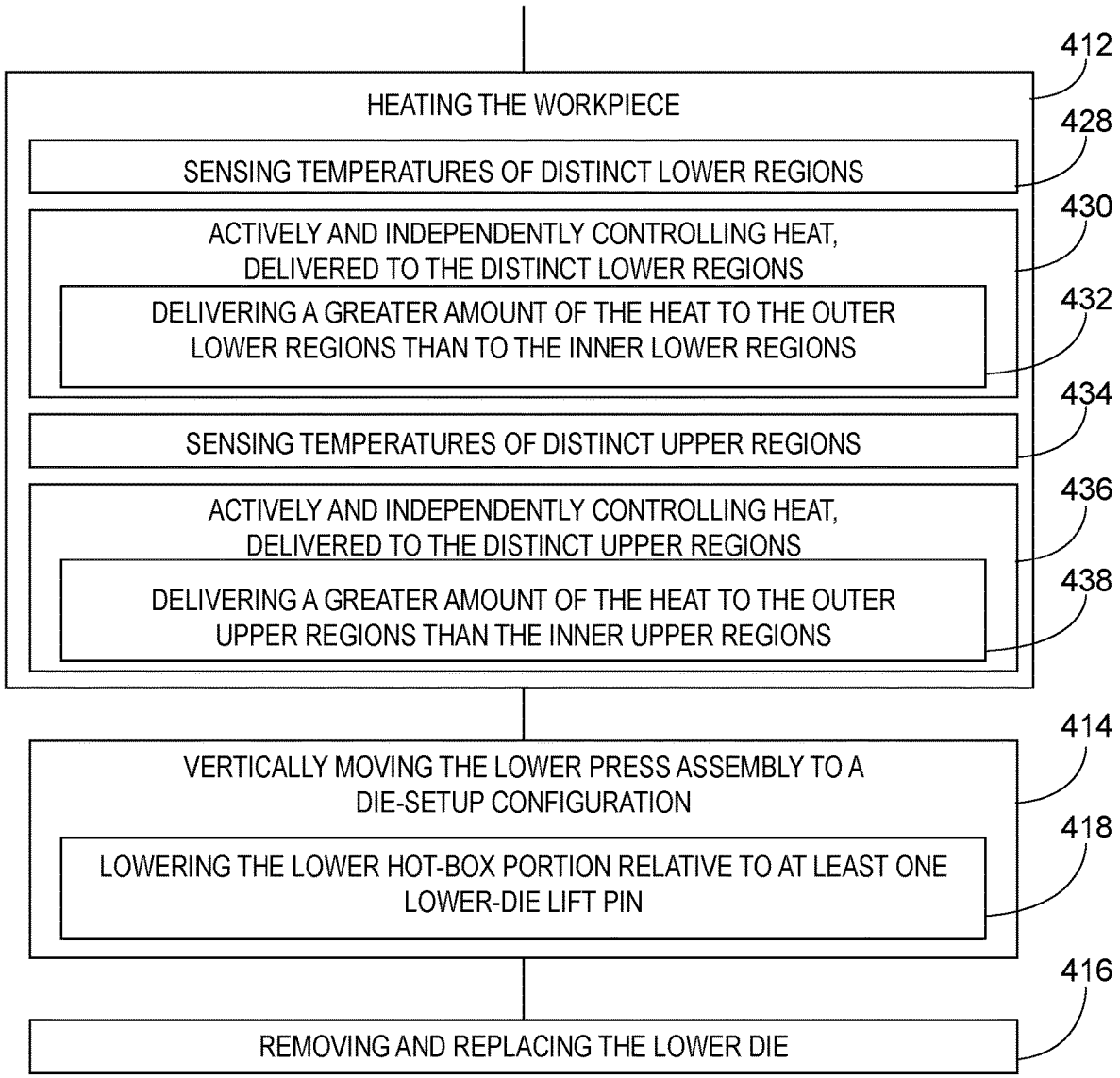
Figure 21:
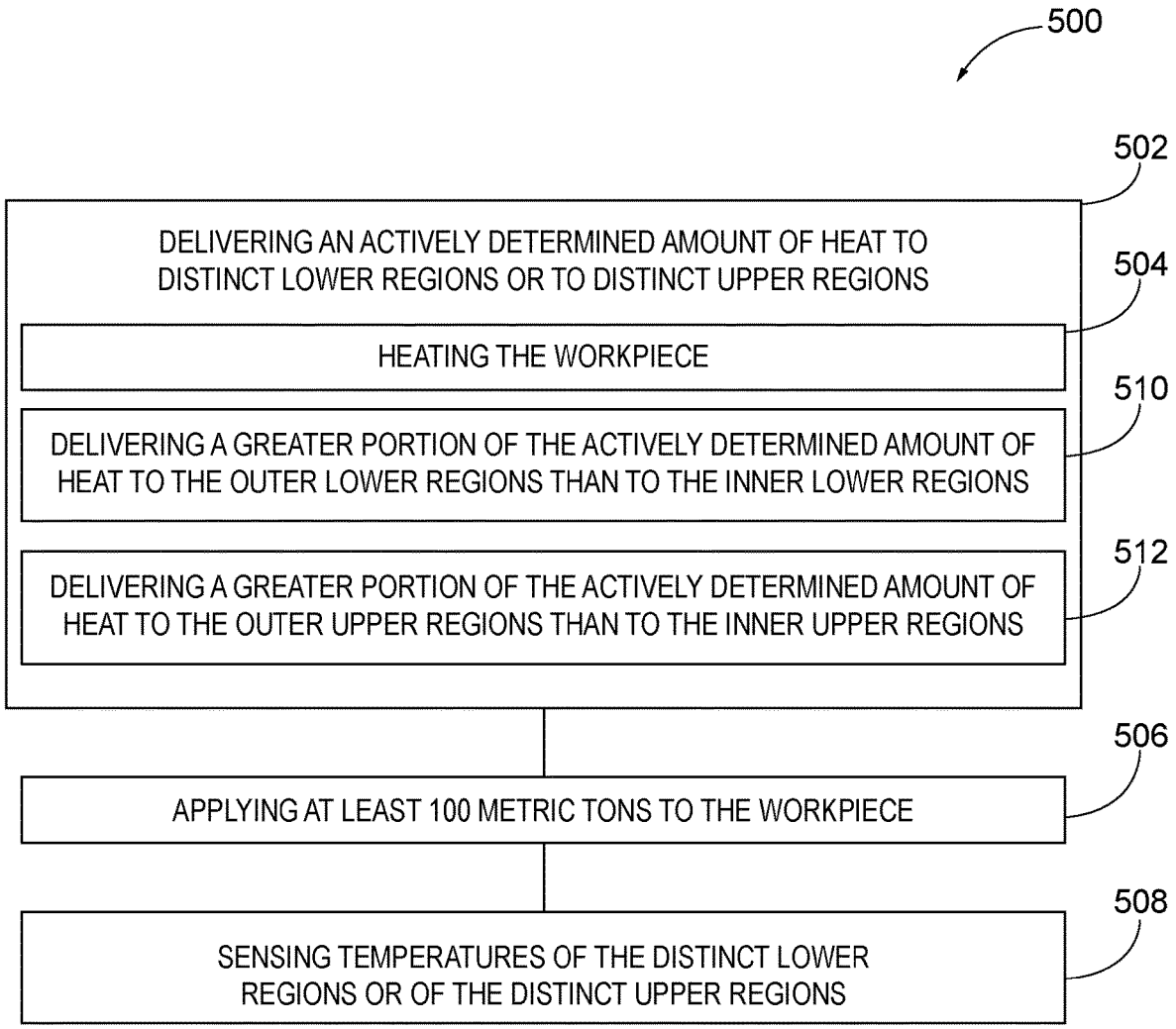
Figure 22:
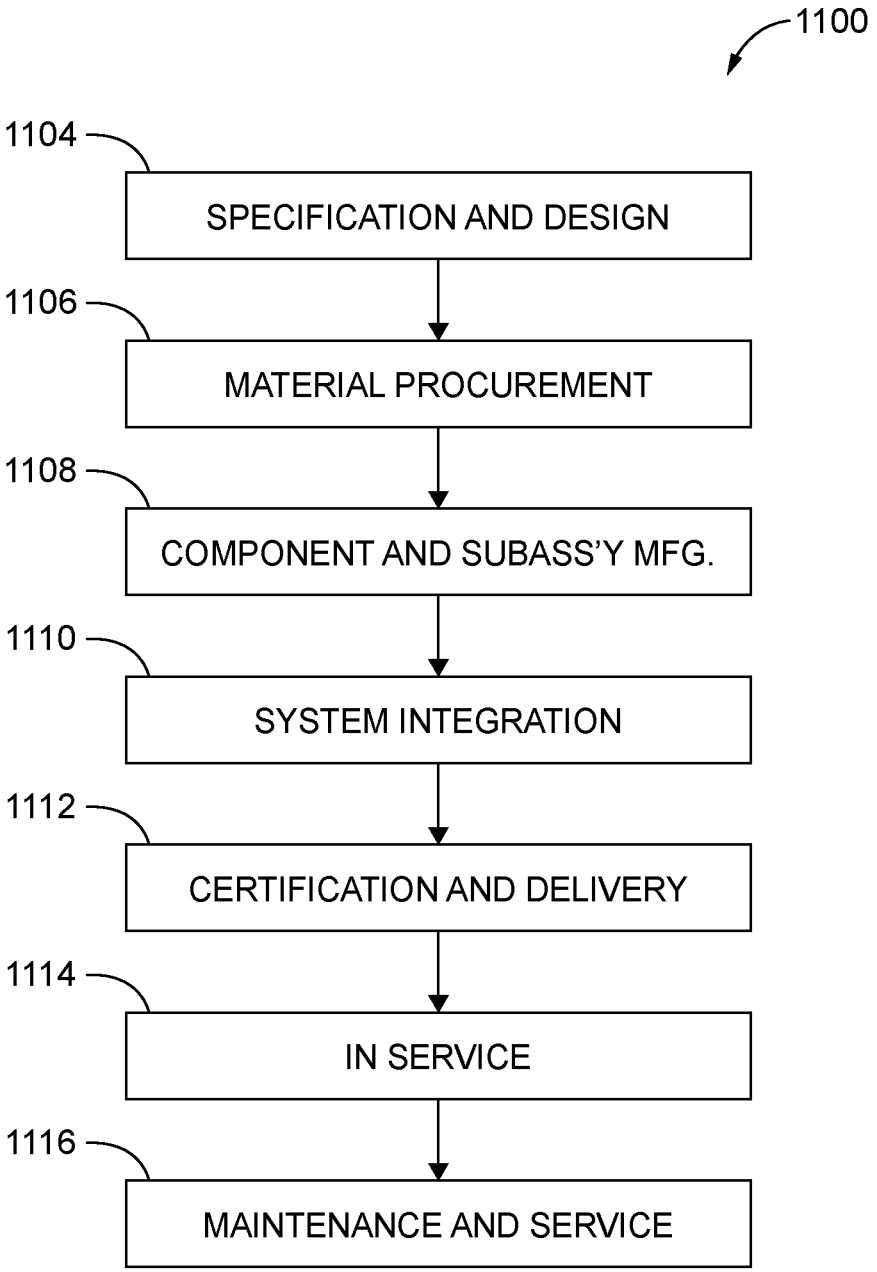
Figure 23:
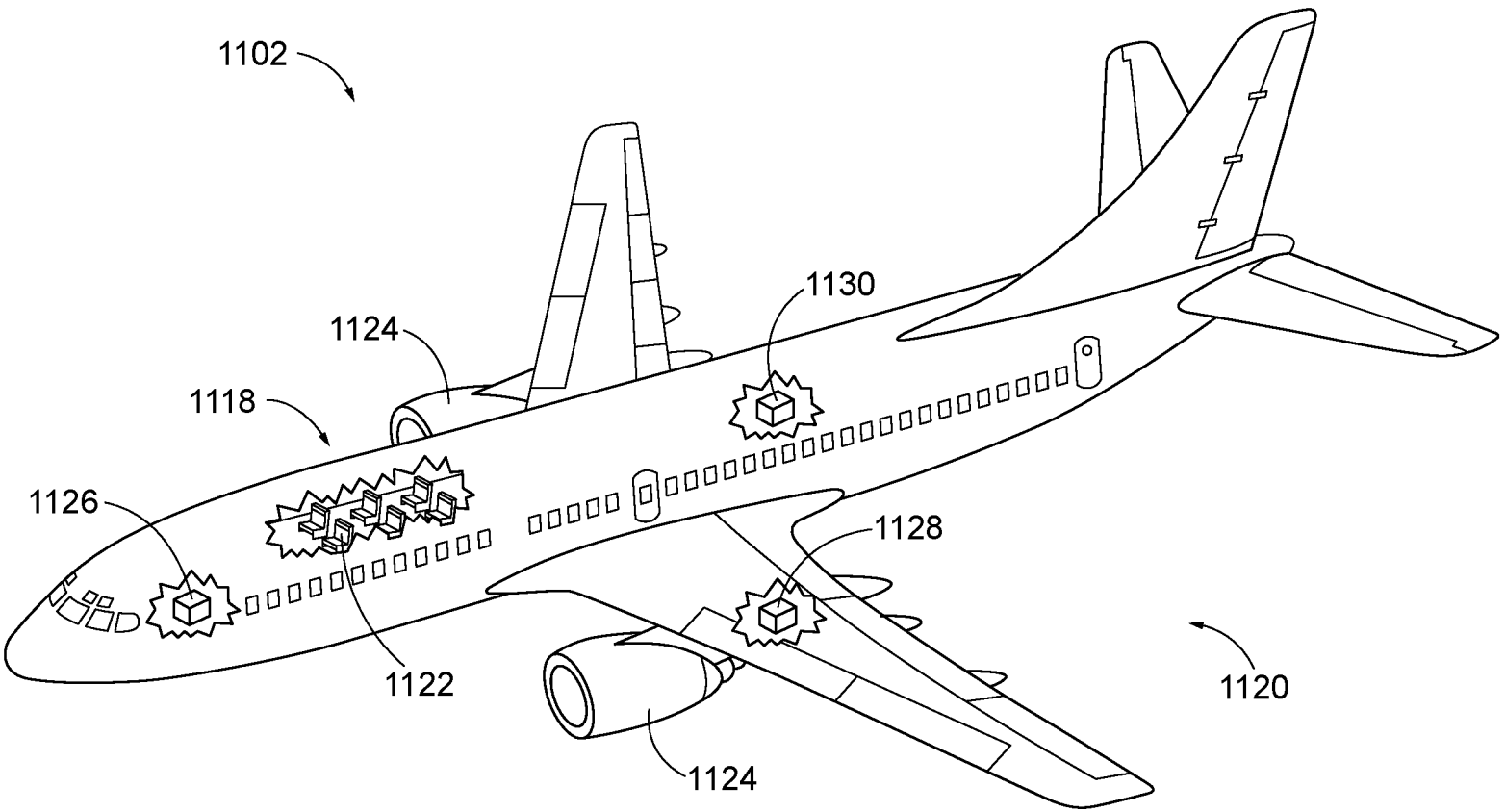

FIGS. 1A and 1B collectively are a block diagram of a hot-forming press, according to one or more examples of the present disclosure;

FIGS. 2A and 2B collectively are a block diagram of a hot box of a hot-forming press, according to one or more examples of the present disclosure;

FIG. 3 is a perspective view of the hot-forming press of FIG. 1, according to one or more examples of the present disclosure;

FIG. 4 is another perspective view of the hot-forming press of FIG. 1, according to one or more examples of the present disclosure;

FIG. 5 is a perspective view of a portion of the hot-forming press of FIG. 1, according to one or more examples of the present disclosure;

FIG. 6 is a cross-sectional perspective view of a portion of the hot-forming press of FIG. 1, according to one or more examples of the present disclosure;

FIG. 7 is a cross-sectional perspective view of a portion of the hot-forming press of FIG. 1, according to one or more examples of the present disclosure;

FIG. 8 is a perspective view of the hot box of FIG. 2 and of the hot box of the hot-forming press of FIG. 1, according to one or more examples of the present disclosure;

FIG. 9 is a cross-sectional perspective view of the hot box of FIG. 2 and of the hot box of the hot-forming press of FIG. 1, according to one or more examples of the present disclosure;

FIG. 10 is another cross-sectional perspective view of the hot box of FIG. 2 and of the hot box of the hot-forming press of FIG. 1, according to one or more examples of the present disclosure;

FIG. 11 is an exploded perspective view of the upper hot-box portion of the hot box of FIG. 2 and of the hot box of the hot-forming press of FIG. 1, according to one or more examples of the present disclosure;

FIG. 12 is another exploded perspective view of the upper hot-box portion of the hot box of FIG. 2 and of the hot box of the hot-forming press of FIG. 1, according to one or more examples of the present disclosure;

FIG. 13 is a cross-sectional view of a portion of the upper hot-box portion of the hot box of FIG. 2 and of the hot box of the hot-forming press of FIG. 1, according to one or more examples of the present disclosure;

FIG. 14 is an exploded perspective view of the lower hot-box portion of the hot box of FIG. 2 and of the hot box of the hot-forming press of FIG. 1, according to one or more examples of the present disclosure;

FIG. 15 is a cross-sectional view of a portion of the lower hot-box portion of the hot box of FIG. 2 and of the hot box of the hot-forming press of FIG. 1, according to one or more examples of the present disclosure;

FIG. 16 is a schematic side view of a heating rod of the hot-forming press of FIG. 1, according to one or more examples of the present disclosure;

FIG. 17 is a front view of a display of the hot-forming press of FIG. 1, according to one or more examples of the present disclosure;

FIG. 18 is a cross-sectional view of an upper die and a lower die of the hot-forming press of FIG. 1 together with a workpiece, according to one or more examples of the present disclosure;

FIG. 19 is a front view of a display of the hot-forming press of FIG. 1, according to one or more examples of the present disclosure;

FIGS. 20A and 20B collectively are a block diagram of a method of hot-forming a workpiece, according to one or more examples of the present disclosure;

FIG. 21 is a block diagram of another method of hot-forming a workpiece, according to one or more examples of the present disclosure;

FIG. 22 is a block diagram of aircraft production and service methodology; and FIG. 23 is a schematic illustration of an aircraft.

DESCRIPTION

In FIGS. 1 and 2, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 1 and 2 may be combined in various ways without the need to include other features described in FIGS. 1 and 2, other drawing figures, and/or the accompanying disclosure, even though such combination or combinations are not explicitly illustrated herein. Similarly, additional features not limited to the examples presented, may be combined with some or all of the features shown and described herein.

In FIGS. 20-22, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 20-22 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according to the present disclosure are provided below.

Referring generally to FIG. 1 and particularly to, e.g., FIGS. 3-7, hot-forming press 100 is disclosed. Hot-forming press 100 comprises lower press assembly 102 and upper press assembly 108. Lower press assembly 102 is movable along a vertical axis and comprises lower die 106 and lower hot-box portion 104, configured to receive lower die 106. Upper press assembly 108 is movable along the vertical axis above lower press assembly 102 and comprises upper die 112 and upper hot-box portion 110. Upper hot-box portion 110 is configured to receive upper die 112 so that upper die 112 is positioned opposite lower die 106. Lower die 106 and upper die 112 are configured to apply a forming pressure to workpiece 114 that is received between lower die 106 and upper die 112. Lower hot-box portion 104 and upper hot-box portion 110 are configured to heat workpiece 114. The preceding subject matter of this paragraph characterizes example 1 of the present disclosure.

By having both lower press assembly 102 and upper press assembly 108 movable along a vertical axis, the component(s) of hot-forming press 100 that apply a forming force to generate the forming pressure (i.e., the tonnage of hot-forming press 100) for application to workpiece 114 need not have a significant stroke length that accounts both for operative placement of workpiece 114 and removal of a formed part from hot-forming press 100 and for application of the forming force. Similarly, the component(s) of hot-forming press 100 that apply a forming force to generate the forming pressure need not have a stroke length that also accounts for removal and replacement of lower die 106 and upper die 112. Accordingly, the component(s) of hot-forming press 100 that apply the forming force to generate the forming pressure undergo less stress over the same number of cycles than prior art hot-forming presses, thus requiring less maintenance and repair over the lifetime of hot-forming press 100.

Lower hot-box portion 104 and upper hot-box portion 110 are structures that not only support lower die 106 and upper die 112, respectively, but also heat lower die 106 and upper die 112 for operative forming of workpiece 114.

Referring generally to FIG. 1, lower hot-box portion 104 and upper hot-box portion 110 are configured to heat workpiece 114 to a temperature of at least 250° Celsius C, at least 500° C., or at least 750° C., or to a temperature in the range of 250-1000° C. The preceding subject matter of this paragraph characterizes example 2 of the present disclosure, wherein example 2 also includes the subject matter according to example 1, above.

Heating workpiece 114 to a desired temperature enables an operator of hot-forming press 100 to control the yield strength, hardness, and ductility of workpiece 114, and ultimately of a part being formed from workpiece 114. That is, depending on the material selection for workpiece 114, a temperature or temperature range may be selected, for example, above the recrystallization temperature of the material to avoid string hardening of the material during the forming process. Moreover, heating workpiece 114 allows for high-strength materials to be formed at lower forming pressures than would be required in a cold-forming process.

Illustrative, non-exclusive examples of materials that may be used for workpiece 114 include (but are not limited to) various aluminum and titanium alloys and steels.

Referring generally to FIG. 1, the forming pressure results from a forming force of at least 50 metric tons, at least 100 metric tons, at least 300 metric tons, at least 500 metric tons, at least 700 metric tons, at least 1000 metric tons, or at least 2000 metric tons, or in the range of 50-2250 metric tons. The preceding subject matter of this paragraph characterizes example 3 of the present disclosure, wherein example 3 also includes the subject matter according to example 1 or 2, above.

Forming pressures are selected based on material properties of workpiece 114 and the complexity of a part being formed from workpiece 114. Moreover, higher forming pressures may provide for lower temperature requirements to result in desired material properties of the part being formed from workpiece 114.

Referring generally to FIG. 1 and particularly to, e.g., FIGS. 3-7, lower press assembly 102 and upper press assembly 108 are configured to be vertically moved to a loading configuration, in which lower press assembly 102 and upper press assembly 108 are spaced-apart to receive workpiece 114 between lower die 106 and upper die 112. Lower press assembly 102 and upper press assembly 108 are configured to be vertically moved to a closed configuration, in which lower press assembly 102 and upper press assembly 108 are positioned to apply the forming pressure to workpiece 114 between lower die 106 and upper die 112. The preceding subject matter of this paragraph characterizes example 4 of the present disclosure, wherein example 4 also includes the subject matter according to any one of examples 1 to 3, above.

The loading configuration provides sufficient space for an operator or robotic arm to operatively place workpiece 114 between lower die 106 and upper die 112. The closed configuration not only positions lower press assembly 102 and upper press assembly 108 for application of the forming pressure to workpiece 114, but also for heating workpiece 114 to a desired temperature.

In some examples, the loading configuration also provides sufficient space for an operator or robotic arm to remove the part formed from workpiece 114 after hot-forming press 100 has formed the part. Accordingly, in some examples, the loading configuration also may be referred to as an unloading configuration. However, in some examples, the loading configuration may not provide sufficient space for removal and replacement of lower die 106 and upper die 112 from lower press assembly 102 and upper press assembly 108.

Referring generally to FIG. 1 and particularly to, e.g., FIG. 4, upper press assembly 108 is configured to be selectively locked in the closed configuration. The preceding subject matter of this paragraph characterizes example 5 of the present disclosure, wherein example 5 also includes the subject matter according to example 4, above.

By locking upper press assembly 108 in the closed configuration, the forming force required to generate the forming pressure to workpiece 114 need only be applied by lower press assembly 102. Accordingly, the component(s) of hot-forming press 100 that vertically move upper press assembly 108 need not be capable of applying such high forces as may be required to generate a desired forming pressure, but rather need only be capable of moving upper press assembly between at least the loading configuration and the closed configuration.

Referring generally to FIG. 1 and particularly to, e.g., FIGS. 3-6, hot-forming press 100 further comprises upper press head 134, at least one locking rod 138, and at least one rod clamp 140. Upper press assembly 108 is vertically movable relative to upper press head 134. At least one locking rod 138 is fixed to upper press assembly 108. At least one rod clamp 140 is fixed to upper press head 134 and is configured to selectively clamp at least one locking rod 138 to immobilize upper press assembly 108 relative to upper press head 134. The preceding subject matter of this paragraph characterizes example 6 of the present disclosure, wherein example 6 also includes the subject matter according to example 5, above.

When at least one locking rod 138 is clamped by at least one rod clamp 140, upper press assembly 108 is immobilized relative to upper press head 134. Accordingly, when lower press assembly 102 applies the forming force to generate the forming pressure, upper press assembly 108 inherently applies an equal and opposite forming force for generation of the forming pressure that is applied to workpiece 114 for deformation thereof.

Hot-forming press 100, illustrated in FIGS. 3-6, comprises four locking rods and corresponding four rod clamps; however, any suitable number of locking rods and rod clamps may be used, such as depending on the size of hot-forming press 100, the tonnage of hot-forming press 100, and the strength and capacity of the locking rods and the rod clamps. Locking rods and rod clamps may take any suitable configuration, such that at least one rod clamp 140 is configured to receive and selectively lock relative movement of locking rod 138. Rod clamps additionally or alternatively may be referred to as locking units, and an illustrative, non-exclusive example of at least one rod clamp 140 is a Locking Unit KB, sold by SITEMA Gmbh & Co. KG of Germany.

Upper press head 134 may take any suitable configuration such that upper press head 134 provides sufficient rigidity to immobilize upper press assembly 108 when lower press assembly 102 is applying the forming force to generate the forming pressure for deformation of workpiece 114. As illustrated in FIGS. 3-6, in one or more examples, upper press head 134 is constructed of two spaced-apart steel plates structurally reinforced with steel ribs between the two plates, with the rod clamps coupled to the top of upper press head 134, and with the locking rods extending through upper press head 134. Upper press head 134 and subsequently discussed lower press head 126 and vertical supports 116 may be described as defining a frame of hot-forming press 100.

Referring generally to FIG. 1 and particularly to, e.g., FIGS. 3-7, hot-forming press 100 further comprises vertical supports 116. Lower press assembly 102 is moveable along vertical supports 116. Upper press assembly 108 is movable along vertical supports 116. The preceding subject matter of this paragraph characterizes example 7 of the present disclosure, wherein example 7 also includes the subject matter according to any one of examples 1 to 6, above.

Vertical supports 116 constrain movement of lower press assembly 102 and upper press assembly 108 along the vertical axis of hot-forming press 100.

As illustrated in FIGS. 3-7, in one or more examples, four vertical supports 116 are included and are located generally at four corners of hot-forming press 100. While the illustrated example has vertical supports 116 that are generally cylindrical, any suitable configuration of vertical supports 116 may be incorporated into hot-forming press 100, such that vertical supports 116 serve as a track, or guide, for lower press assembly 102 and upper press assembly 108 to move along when transitioning between the loading configuration and the closed configuration, and optionally also the subsequently discussed set-up configuration. In some examples, vertical supports 116 are be steel cylinders that are chrome-plated.

Referring generally to FIG. 1 and particularly to, e.g., FIGS. 3, 4, 6, and 7, lower press assembly 102 further comprises lower bolster plate 128. Lower bolster plate 128 is positioned beneath and vertically supports lower hot-box portion 104. Vertical supports 116 extend through lower bolster plate 128. The preceding subject matter of this paragraph characterizes example 8 of the present disclosure, wherein example 8 also includes the subject matter according to example 7, above.

Lower bolster plate 128 supports lower hot-box portion 104 and provides structure for lower press assembly 102 to translate along vertical supports 116 without affecting the insulating function of lower hot-box portion 104.

As illustrated in FIGS. 3, 4, 6, and 7, in one or more examples, lower bolster plate 128 is constructed of two spaced-apart steel plates structurally reinforced with steel ribs between the two plates, with lower hot-box portion 104 coupled to the top side of lower bolster plate 128, and with vertical supports 116 extending through lower bolster plate 128. Lower bolster plate 128 additionally or alternatively may be referred to as a lower ram or a lower support frame of lower press assembly 102.

Referring generally to FIG. 1 and particularly to, e.g., FIGS. 3-6, upper press assembly 108 further comprises upper bolster plate 130. Upper bolster plate 130 is positioned above and vertically supports upper hot-box portion 110. Vertical supports 116 extend through upper bolster plate 130. The preceding subject matter of this paragraph characterizes example 9 of the present disclosure, wherein example 9 also includes the subject matter according to example 7 or 8, above.

Upper bolster plate 130 supports upper hot-box portion 110 and provides structure for upper press assembly 108 to translate along vertical supports 116 without affecting the insulating function of upper hot-box portion 110.

As illustrated in FIGS. 3-6, in one or more examples, upper bolster plate 130 is constructed of two spaced-apart steel plates structurally reinforced with steel ribs between the two plates, with upper hot-box portion 110 coupled to the lower side of upper bolster plate 130, and with vertical supports 116 extending through upper bolster plate 130. Upper bolster plate 130 additionally or alternatively may be referred to as an upper ram or an upper support frame of upper press assembly 108.

Referring generally to FIG. 1 and particularly to, e.g., FIGS. 3-6, hot-forming press 100 further comprises lower translation mechanism 118. Lower translation mechanism 118 is operatively coupled to lower press assembly 102 and is configured to move lower press assembly 102 along the vertical axis. Hot-forming press 100 also comprises upper translation mechanism 120. Upper translation mechanism 120 is configured to vertically move upper press assembly 108 along the vertical axis. The preceding subject matter of this paragraph characterizes example 10 of the present disclosure, wherein example 10 also includes the subject matter according to any one of examples 1 to 9, above.

As stated, lower translation mechanism 118 and upper translation mechanism 120 respectively move lower press assembly 102 and upper press assembly 108 along the vertical axis. Accordingly, in one or more examples, lower press assembly 102 and upper press assembly 108 is selectively positioned in various vertical positions with respect to each other, such as to permit loading of workpiece 114 and unloading of a part, formed from workpiece 114, to permit insertion and removal of lower die 106 and upper die 112, and to permit maintenance of various component parts of lower press assembly 102 and upper press assembly 108.

In one or more examples, lower translation mechanism 118 and upper translation mechanism 120 take various forms, including (but not limited to) the specific examples disclosed and illustrated herein. In illustrative, non-exclusive examples, each of lower translation mechanism 118 and upper translation mechanism 120 comprises one or more of a hydraulic cylinder, a drive-screw assembly, a ratchet assembly, a pneumatic assembly, a gear assembly, and/or a pulley assembly.

Referring generally to FIG. 1 and particularly to, e.g., FIGS. 4 and 6, lower translation mechanism 118 is configured to apply a forming force to generate the forming pressure. The preceding subject matter of this paragraph characterizes example 11 of the present disclosure, wherein example 11 also includes the subject matter according to example 10, above.

The forming pressure operatively deforms workpiece 114 between lower die 106 and upper die 112.

Referring generally to FIG. 1, upper translation mechanism 120 is not configured to apply a forming force to generate the forming pressure. The preceding subject matter of this paragraph characterizes example 12 of the present disclosure, wherein example 12 also includes the subject matter according to example 10 or 11, above.

By having upper translation mechanism 120 not apply a forming force, upper translation mechanism 120 need not be capable of applying a forming force that is sufficient to generate the required forming pressure to operatively deform workpiece 114 into a formed part. Accordingly, in one or more examples, upper translation mechanism 120 is less expensive and easier to maintain than lower translation mechanism 118, which is configured to apply, and capable of applying, the forming force necessary to generate the forming pressure for operatively deformation of workpiece 114. Moreover, by having upper translation mechanism 120 not apply a forming force, in one or more examples, upper translation mechanism 120 is configured to have a much longer stroke than lower translation mechanism 118, such as for reconfiguring hot-forming press 100 to the loading configuration. As a result, in one or more examples, lower translation mechanism 118 is significantly less expensive than corresponding mechanisms of prior art hot-forming presses.

Referring generally to FIG. 1 and particularly to, e.g., FIGS. 4 and 6, lower translation mechanism 118 comprises at least one hydraulic cylinder 124. The preceding subject matter of this paragraph characterizes example 13 of the present disclosure, wherein example 13 also includes the subject matter according to any one of examples 10 to 12, above.

Hydraulic cylinders are capable of applying the necessary forming force to generate the required forming pressure for operative deformation of workpiece 114.

Any number of hydraulic cylinders is suitable for use, according to circumstances, such as based on the tonnage of hot-forming press 100, the specifications of the hydraulic cylinders, etc. In the illustrated examples of hot-forming press 100 of FIG. 4, four hydraulic cylinders are positioned between lower press head 126 and lower bolster plate 128. By having more than one hydraulic cylinder 124, less-expensive, off-the-shelf hydraulic cylinders are used in one or more examples to arrive at the desired tonnage of hot-forming press 100.

Referring generally to FIG. 1 and particularly to, e.g., FIGS. 4 and 6, hot-forming press 100 further comprises lower press head 126 and at least one hydraulic cylinder 124. Lower press assembly 102 is vertically movable relative to lower press head 126. At least one hydraulic cylinder 124 is operatively coupled between lower press assembly 102 and lower press head 126 to vertically move lower press assembly 102 relative to lower press head 126 and to apply the forming pressure to workpiece 114. The preceding subject matter of this paragraph characterizes example 14 of the present disclosure, wherein example 14 also includes the subject matter according to example 13, above.

Lower press head 126 provides fixed structure against which at least one hydraulic cylinder 124 pushes to vertically move lower press assembly 102 and operatively apply the forming pressure to workpiece 114.

In the illustrated example of hot-forming press 100 of FIGS. 4 and 6, lower press head 126 is positioned below floor surface 101 of a production environment in which hot-forming press 100 is installed. Accordingly, in one or more examples, lower press assembly 102 is positioned relative to floor surface 101, such that an operator of hot-forming press 100 is able to easily access lower press assembly 102 and its component parts, such as for maintenance, for insertion and removal of lower die 106, etc.

Referring generally to FIG. 1 and particularly to, e.g., FIGS. 3-6, upper translation mechanism 120 comprises single drive-screw assembly 132. The preceding subject matter of this paragraph characterizes example 15 of the present disclosure, wherein example 15 also includes the subject matter according to any one of examples 10 to 14, above.

By including only single drive-screw assembly 132, the cost of upper translation mechanism 120 is significantly reduced from prior art hot-forming presses. Moreover, by including only single drive-screw assembly 132, in one or more examples, the drive screw is positioned at the center of upper press assembly 108 and upper press head 134, thereby shielding single drive-screw assembly 132 from radiative heat emanating from hot box 300, including from lower die 106, upper die 112, and workpiece 114 upon being formed, such as when lower press assembly 102 and upper press assembly 108 are in the loading configuration for removal of a formed part and loading of workpiece 114.

In the example hot-forming press 100 illustrated in FIGS. 3-6, single drive-screw assembly 132 comprises direct-drive electric motor 121 mounted above upper press head 134 and drive screw 123 extending through upper press head 134 and operatively coupled between direct-drive electric motor 121 and upper bolster plate 130.

Referring generally to FIG. 1 and particularly to, e.g., FIGS. 3-6, hot-forming press 100 further comprises upper press head 134. Upper press assembly 108 is vertically movable relative to upper press head 134. Single drive-screw assembly 132 is operatively coupled between upper press assembly 108 and upper press head 134 to vertically move upper press assembly 108 relative to upper press head 134. The preceding subject matter of this paragraph characterizes example 16 of the present disclosure, wherein example 16 also includes the subject matter according to example 15, above.

In one or more examples, upper press head 134 provides fixed structure relative to which single drive-screw assembly 132 vertically translates upper press assembly 108.

Referring generally to FIG. 1 and particularly to, e.g., FIGS. 6 and 7, lower press assembly 102 is configured to be vertically moved to a die-setup configuration, in which lower die 106 is spaced-apart from lower hot-box portion 104 for selective removal and replacement of lower die 106. The preceding subject matter of this paragraph characterizes example 17 of the present disclosure, wherein example 17 also includes the subject matter according to any one of examples 1 to 16, above.

As indicated, in the die-setup configuration, in one or more examples, lower die 106 is removed and replaced from lower hot-box portion 104. Accordingly, in one or more examples, hot-forming press 100 is selectively configured for formation of various parts.

Referring generally to FIG. 1 and particularly to, e.g., FIGS. 6 and 7, hot-forming press 100 further comprises at least one lower-die lift pin 136. At least one lower-die lift pin 136 extends into lower hot-box portion 104 and is positioned to operatively engage lower die 106. Lower press assembly 102 is vertically movable relative to at least one lower-die lift pin 136. When lower press assembly 102 is vertically moved to the die-setup configuration, at least one lower-die lift pin 136 positions lower die 106 above lower hot-box portion 104 for selective removal and replacement of lower die 106. The preceding subject matter of this paragraph characterizes example 18 of the present disclosure, wherein example 18 also includes the subject matter according to example 17, above.

By operatively positioning lower die 106 above lower hot-box portion 104, in one or more examples, it is possible to remove and replace lower die 106. Accordingly, it is possible to selectively configure hot-forming press 100 for formation of various parts.

It is possible to incorporate any suitable number and configuration of lower-die lift pins into hot-forming press 100. Generally, lower-die lift pin 136 is an elongate structure that extends through lower hot-box portion 104 for engagement with lower die 106. More specifically, in the hot-forming press 100 of FIGS. 6 and 7, four lower-die lift pins are supported by corresponding pedestals 137 that are fixed to an upper surface of lower press head 126, with pedestals 137 extending partially through lower bolster plate 128, and with the lower-die lift pins extending from pedestals 137 through lower bolster plate 128 and through lower hot-box portion 104 to engage lower die 106. Accordingly, when lower translation mechanism 118 vertically lowers lower press assembly 102 to the die-setup configuration, the lower-die lift pins remain in engagement with lower die 106, such that the remainder of lower hot-box portion 104 is lowered with respect to lower die 106. As a result, lower die 106 becomes spaced-apart from and above the remainder of lower hot-box portion 104, enabling selective removal from lower press assembly 102. For example, in one or more examples, a fork lift is used to lift and remove lower die 106 from lower press assembly 102. Similarly, in one or more examples, a fork lift is used to position a new lower die atop lower-die lift pins 136.

Referring generally to FIGS. 1 and 2 and particularly to, e.g., FIGS. 6-10 and 14, lower hot-box portion 104 comprises lower housing 142, lower heating plate 144, and lower insulation layer 148. Lower heating plate 144 is received within lower housing 142, is configured to be in contact with lower die 106, and comprises distinct lower regions 146. Lower insulation layer 148 is positioned between lower housing 142 and lower heating plate 144. Lower press assembly 102 further comprises lower heat source 150, which is configured to deliver an actively determined amount of heat to distinct lower regions 146 of lower heating plate 144. The preceding subject matter of this paragraph characterizes example 19 of the present disclosure, wherein example 19 also includes the subject matter according to any one of examples 1 to 18, above.

Lower housing 142 provides structure for supporting the other components of lower hot-box portion 104. Lower insulation layer 148 insulates lower heating plate 144, which is in contact with lower die 106, and thereby facilitates efficient heating of lower die 106 by restricting conduction away from lower die 106. By having lower heat source 150 deliver an actively determined amount of heat to distinct lower regions 146 of lower heating plate 144, it is possible to control the amount of heat delivered to, and thus the temperature of, distinct lower regions 146 to provide desired heating of corresponding regions of lower die 106 and workpiece 114. For example, it may be desirable to heat the portions of lower die 106 corresponding to tighter bends to be formed in workpiece 114. Additionally or alternatively, it may be desirable to deliver greater heat to outer regions of lower die 106 than to inner regions of lower die 106 due to the conductive heat loss through lower insulation layer 148.

In one or more examples, lower housing 142 is constructed of any suitable material and in any suitable configuration, such that it supports the other components of lower hot-box portion 104. In the lower hot-box portion 104 of FIGS. 6-10 and 14, lower housing 142 comprises lower base plate 302 and lower side walls 304 constructed of an alloy, such as Inconel.

Lower heating plate 144, which additionally or alternatively may be described as a lower heated platen, in one or more examples, takes any suitable form, such that it is configured to receive heat from lower heat source 150 and deliver the heat to lower die 106. As illustrated in FIGS. 6-10 and 14, and as discussed herein, lower heating plate 144 defines portions of lower heating-rod passages 152, within which corresponding lower heating rods, of lower heat source 150, extend.

Referring generally to FIGS. 1 and 2 and particularly to, e.g., FIGS. 6-8, 10, and 14, lower heating plate 144 defines lower heating-plate volume 320 within which lower die 106 is positioned. The preceding subject matter of this paragraph characterizes example 20 of the present disclosure, wherein example 20 also includes the subject matter according to example 19, above.

By defining lower heating-plate volume 320, within which lower die 106 is positioned, lower heating plate 144 is able to deliver heat to lower die 106 not only from below, but also from the sides of lower die 106. As a result, the heating of lower die 106 is efficient.

Referring generally to FIG. 1 and particularly to, e.g., FIGS. 6, 7, 9, 10, 14, and 15, lower heating plate 144 and lower housing 142 collectively define lower heating-rod passages 152. Lower heat source 150 comprises lower heating rods 154 that extend into lower heating-rod passages 152. The preceding subject matter of this paragraph characterizes example 21 of the present disclosure, wherein example 21 also includes the subject matter according to example 19 or 20, above.

Lower heating rods 154, of lower heat source 150, enable controlled heating of lower heating plate 144, and thus of lower die 106 across an entire span of lower heating plate 144. As a result, it is possible to effectively and efficiently control temperatures of various portions of lower heating plate 144.

In one or more examples, lower heating rods 154 take various forms, such that they are configured to deliver heat to lower heating plate 144. As an illustrative, non-exclusive example, lower heating rods 154 comprise an elongate heating element, constructed of a nickel-steel, encapsulated by a ceramic layer and encased in a stainless-steel sheath. The ceramic layer absorbs oxygen to restrict oxidation of the heating element.

It is possible to provide any suitable number of lower heating rods 154 and corresponding lower heating-rod passages, such as based on the size of lower heating plate 144, the degree of temperature control required for hot-forming press 100, etc. In the illustrated examples of FIGS. 6, 7, 9, 10, and 14, forty lower heating-rod passages 152 are defined by lower heating plate 144 and lower housing 142.

In examples of lower hot-box portion 104 in which lower insulation layer 148 extends on the sides of lower heating plate 144, lower insulation layer 148 defines lower heating-rod passages 152 together with lower heating plate 144 and lower housing 142.

Referring generally to FIG. 1 and particularly to, e.g., FIG. 16, lower heating rods 154 are straight along entire lengths of lower heating rods 154. The preceding subject matter of this paragraph characterizes example 22 of the present disclosure, wherein example 22 also includes the subject matter according to example 21, above.

Since lower heating rods 154 are straight along their entire lengths, the integrity of lower heating rods 154 is maintained for significant periods of time without damage, and thus without requiring expensive replacement thereof.

For example, the ceramic layer of lower heating rods 154 will not crack as in prior art bent heating rods, thereby avoiding air encroachment into lower heating rods 154 and undesirable oxidation and deterioration of the heating elements of lower heating rods 154.

Referring generally to FIG. 1 and particularly to, e.g., FIGS. 3, 4, 6, and 7, lower heat source 150 further comprises lower connecting box 158 and lower connecting cables 160 that interconnect lower heating rods 154 to lower connecting box 158. Lower press assembly 102 further comprises lower bolster plate 128, positioned beneath and vertically supporting lower hot-box portion 104. Lower connecting box 158 is mounted to lower bolster plate 128. The preceding subject matter of this paragraph characterizes example 23 of the present disclosure, wherein example 23 also includes the subject matter according to example 21 or 22, above.

By having lower connecting box 158 mounted to lower bolster plate 128, such as at a periphery or lower side thereof, and by having lower connecting cables 160 interconnect lower heating rods 154 to lower connecting box 158, in one or more examples, lower connecting box 158 are shielded from, or at least spaced away from, radiative heat, emanating from lower die 106 and upper die 112 when hot-forming press 100 is in the loading configuration.

In contrast, in prior art hot-forming presses, connect cables and boxes typically are coupled to and in direct contact with hot surfaces of the hot-forming press, resulting in short life spans of these components, and requiring frequent maintenance or replacement thereof.

Referring generally to FIG. 1, lower bolster plate 128 shields lower connecting box 158 from heat, when the heat radiates from lower hot-box portion 104. The preceding subject matter of this paragraph characterizes example 24 of the present disclosure, wherein example 24 also includes the subject matter according to example 23, above.

By shielding lower connecting box 158 from heat that radiates from lower hot-box portion 104, lower connecting box 158 is protected and will have a longer lifespan than connecting boxes of prior art hot-forming presses.

Referring generally to FIG. 1 and particularly to, e.g., FIG. 16, lower heating rods 154 each comprise lower heating zones 162. Temperatures of lower heating zones 162 are independently controlled. Lower heating zones 162 coincide with distinct lower regions 146 of lower heating plate 144. The preceding subject matter of this paragraph characterizes example 25 of the present disclosure, wherein example 25 also includes the subject matter according to any one of examples 21 to 24, above.

By being divided into lower heating zones 162, it is possible to use lower heating rods 154 to independently control the heat delivered to distinct lower regions 146 of lower heating plate 144, and thus to distinct regions of lower die 106. As discussed, it is possible to control the amount of heat delivered to, and thus the temperature of, distinct lower regions 146 to provide desired heating of corresponding regions of lower die 106 and workpiece 114. For example, in some cases, it is desirable to heat the portions of lower die 106 corresponding to tighter bends to be formed in workpiece 114. Additionally or alternatively, it is desirable, in some cases, to deliver greater heat to outer regions of lower die 106 than to inner regions of lower die 106 due to the conductive heat loss through lower insulation layer 148. Moreover, in examples of lower hot-box portion 104, in which lower insulation layer 148 has different thicknesses on opposing sides of lower heating plate 144, it is possible to deliver greater heat to the region of lower heating plate 144 that is proximate to the thinner region of lower insulation layer 148, due to the greater loss of heat in such thinner region.

Referring generally to FIG. 1 and particularly to, e.g., FIG. 16, lower heating zones 162 comprise outer lower zones 168 and at least one inner lower zone 170 that is positioned between outer lower zones 168. Outer lower zones 168 have higher heating capacities than at least one inner lower zone 170. The preceding subject matter of this paragraph characterizes example 26 of the present disclosure, wherein example 26 also includes the subject matter according to example 25, above.

In some cases, it is desirable, or necessary, to deliver a greater amount of heat to outer lower zones 168 than to at least one inner lower zone 170, because the regions of lower heating plate 144 proximate to outer lower zones 168 lose heat at a greater rate than the regions of lower heating plate 144 proximate to at least one inner lower zone 170. Accordingly, in one or more examples, lower heating rods 154 with at least one inner lower zone 170 having a lower heating capacity than outer lower zones 168 are less expensive than heating rods with uniform heating capacities along their length.

As illustrated in FIG. 16, in one or more examples, lower heating rods 154 additionally include lower stem region 155 proximate to the corresponding lower connecting cable, with lower stem region 155 being configured not to conduct heat therefrom, such as with the heating element of lower heating rods 154 extending only through outer lower zones 168 and at least one inner lower zone 170. Moreover, in one or more examples, lower stem region 155 extends out from lower hot-box portion 104, in which case it is desirable for lower stem region 155 not to be heated.

Referring generally to FIGS. 1 and 2 and particularly to, e.g., FIGS. 3 and 4, lower hot-box portion 104 has lower front side 172 and lower rear side 174. Lower hot-box portion 104 is configured to receive lower die 106 in a position that is closer to lower front side 172 than to lower rear side 174. Outer lower zones 168 that are proximate to lower front side 172 have higher heating capacities than outer lower zones 168 that are proximate to lower rear side 174. The preceding subject matter of this paragraph characterizes example 27 of the present disclosure, wherein example 27 also includes the subject matter according to example 26, above.

By being positioned closer to lower front side 172, lower die 106, together with upper die 112 and workpiece 114, is more easily accessed by an operator of hot-forming press 100 from lower front side 172, such as to facilitate insertion and removal of workpiece 114.

However, by positioning lower die 106 closer to lower front side 172, and thus by having lower insulation layer 148 thinner on lower front side 172 than lower rear side 174, it is necessary, in some cases, to deliver greater heat to the region of lower heating plate 144 that is proximate to the thinner region of lower insulation layer 148, due to the greater loss of heat in such thinner region. In such examples, the outer lower zone of a lower heating rod that is proximate lower front side 172 has a higher heating capacity than the outer lower zone of the lower heating rod that is proximate lower rear side 174.

Referring generally to FIG. 1, hot-forming press 100 further comprises lower temperature sensors 164 and controller 156. Lower temperature sensors 164 are configured to sense temperatures of distinct lower regions 146 of lower heating plate 144. Controller 156 is operatively coupled to lower connecting box 158 and is configured to control the actively determined amount of heat, delivered to distinct lower regions 146 of lower heating plate 144, based at least in part on the temperatures of distinct lower regions 146 of lower heating plate 144. The preceding subject matter of this paragraph characterizes example 28 of the present disclosure, wherein example 28 also includes the subject matter according to any one of examples 19 to 27, above.

By sensing temperatures of distinct lower regions 146 of lower heating plate 144, controller 156 is able to base the amount of heat, delivered to distinct lower regions 146, on the sensed temperatures to ensure that distinct lower regions 146 of lower heating plate 144, and thus corresponding regions of lower die 106, are heated to desired temperatures for a particular operation of hot-forming press 100.

It is possible for lower temperature sensors 164 to take any suitable form such that they are configured to sense temperatures of distinct lower regions 146 of lower heating plate 144. For example, in one or more examples, lower temperature sensors 164 are thermocouples that are embedded within lower heating plate 144.

Referring generally to FIG. 1, hot-forming press 100 further comprises lower-die temperature sensors 166 and controller 156. Lower-die temperature sensors 166 are configured to sense temperatures of lower die 106. Controller 156 is configured to record or display the temperatures of lower die 106. Controller 156 is configured not to control the actively determined amount of heat, delivered to distinct lower regions 146 of lower heating plate 144, based on the temperatures of lower die 106. The preceding subject matter of this paragraph characterizes example 29 of the present disclosure, wherein example 29 also includes the subject matter according to example 28, above.

It is possible to record or display the temperatures of lower die 106 for quality control purposes, including, for example, generating a report that shows temperature compliance within or deviations from desired temperature ranges of lower die 106. Additionally or alternatively, it is possible to generate alerts during a forming process for an operator to take corrective action or otherwise make note of one or more problems that may need to be addressed.

Referring generally to FIG. 1 and particularly to, e.g., FIGS. 3, 4, and 17, hot-forming press 100 further comprises display 176. Display 176 is operatively coupled to controller 156 and is configured to display the temperatures of distinct lower regions 146 of lower heating plate 144. The preceding subject matter of this paragraph characterizes example 30 of the present disclosure, wherein example 30 also includes the subject matter according to example 28 or 29, above.

By displaying temperatures of distinct lower regions 146 of lower heating plate 144, it is possible to monitor such temperatures in real time by an operator of hot-forming press for quality control purposes.

As shown in FIG. 17, display 176 provides thermal information, such as associated with distinct lower regions 146 of lower heating plate 144. In the illustrated example of display 176, there are twelve regions of lower heating plate 144 being monitored. Each one of the regions has a distinct controller, or amp stack, associated with it for controlling the amount of current delivered to each circuit associated with lower heating zones 162 of the corresponding lower heating rods. These distinct controllers also monitor whether or not there is a problem with a lower heating rod, and communicate with controller 156 whether lower heating rods 154 are holding their temperatures correctly or whether they need more energy. Each of these distinct controllers can feed more or less power to the corresponding lower heating rod based on the temperatures, sensed by lower temperature sensors 164.

In the illustrated example of display 176 in FIG. 17, the temperatures, sensed by lower temperature sensors 164, are indicated by a digital "needle," or line, superimposed on a representation of an analog meter representing a temperature range, with an acceptable temperature range represented in the middle and with undesirable temperature ranges represented on the left- and right-hand sides of the analog meter. Accordingly, when the needle is in the intermediate range, the corresponding lower region of lower heating plate 144 is at a desired temperature. However, if the needle is in the left-hand-side range, the corresponding region of lower heating plate 144 is too cold, and the corresponding zone of an associated one of lower heating rods 154 may be defective or otherwise not working properly. If the needle is in the right-hand-side range, the corresponding region of lower heating plate 144 is too hot, and the corresponding zone of the associated one of lower heating rods 154 may be defective or otherwise not working properly. In one or more examples, the intermediate range is displayed as green, or another color, when the needle is within the intermediate range, thereby alerting an operator that the corresponding zone is functioning properly. In one or more examples, the intermediate range is displayed as yellow, or another color, when the needle is within the left-hand-side or right-hand-side ranges, thereby alerting an operator that the corresponding zone may not be functioning properly.

As shown in FIG. 17, it is possible for the operator of hot-forming press 100 to customize the allowable deviation for the temperatures. In the illustrated example, the deviation is set to 50 degrees.

Referring generally to FIGS. 1 and 2 and particularly to, e.g., FIGS. 6-10, 14, and 15, lower hot-box portion 104 further comprises lower cold plate 178. Lower cold plate 178 is positioned at least partially between lower insulation layer 148 and lower housing 142 and is configured to draw heat away from lower hot-box portion 104. The preceding subject matter of this paragraph characterizes example 31 of the present disclosure, wherein example 31 also includes the subject matter according to any one of examples 19 to 30, above.

Lower cold plate 178 draws away from lower hot-box portion 104 heat that conducts through lower insulation layer 148 from lower heating plate 144. Accordingly, lower cold plate 178 prevents lower housing 142 and lower bolster plate 128 from becoming too hot for an operator of hot-forming press 100.

Lower cold plate 178 is a heat transfer device and is implemented such that it effectively draws heat away from lower hot-box portion 104. For example, in one or more examples, lower cold plate 178 is made of stainless steel with one or more cooling channels extending through lower cold plate 178 and with a coolant (e.g., glycol) circulating through the one or more cooling channels. In some examples, lower cold plate 178 is made in two separate pieces that are welded together. Such a two-piece construction facilitates the machining of a single circuitous cooling channel in each piece. Alternatively, in one or more examples, lower cold plate 178 is made as a single piece, which avoids coolant leakage and the need for a gasket between the two pieces of a two-piece construction. In such a one-piece construction, in one or more examples, the cooling channels are gun-drilled all the way through lower cold plate 178, thereby requiring external plumbing to connect the cooling channels together. In one or more examples, the coolant is delivered and withdrawn from lower cold plate 178 via a factory-based coolant system.

Referring generally to FIGS. 1 and 2 and particularly to, e.g., FIGS. 7, 10, 14, and 15, lower hot-box portion 104 further comprises lower hot-box fasteners 180 that operatively interconnect lower housing 142, lower heating plate 144, and lower insulation layer 148. Lower hot-box fasteners 180 comprise lower bolts 182 and spring-loaded lower nut assemblies 184. Spring-loaded lower nut assemblies 184 are operatively coupled to lower bolts 182 and are configured to permit lower hot-box portion 104 to expand and contract without damage to lower hot-box portion 104. The preceding subject matter of this paragraph characterizes example 32 of the present disclosure, wherein example 32 also includes the subject matter according to any one of examples 19 to 31, above.

Lower hot-box fasteners 180 enable the assembly of lower hot-box portion 104 to expand and contract as a result of the significant temperature ranges experienced by lower hot-box portion 104 when hot-forming press 100 is being used and when it is not being used.

Lower hot-box fasteners 180 are implemented such that they permit the expansion and contraction of lower hot-box portion 104 without damage thereto. For example, with reference to FIG. 15, lower bolts 182 are constructed of two portions, namely first lower-bolt portion 183 including the bolt head and constructed of a high-temperature alloy, such as Supertherm, and second lower-bolt portion 185 constructed of a lower temperature and less expensive alloy, such as Inconel, welded to first lower-bolt portion 183. As an example, spring-loaded lower nut assemblies 184 comprise a stack of Belleville washers.

Referring generally to FIGS. 1 and 2 and particularly to, e.g., FIGS. 6, 7, and 9-12, upper hot-box portion 110 comprises upper housing 186, upper heating plate 188, and upper insulation layer 192. Upper heating plate 188 is received within upper housing 186, is configured to be in contact with upper die 112, and comprises distinct upper regions 190. Upper insulation layer 192 is positioned between upper housing 186 and upper heating plate 188. Upper press assembly 108 further comprises upper heat source 122. Upper heat source 122 is configured to deliver an actively determined amount of heat to distinct upper regions 190 of upper heating plate 188. The preceding subject matter of this paragraph characterizes example 33 of the present disclosure, wherein example 33 also includes the subject matter according to any one of examples 1 to 32, above.

Upper housing 186 provides structure for supporting the other components of upper hot-box portion 110. Upper insulation layer 192 insulates upper heating plate 188, which is in contact with upper die 112, and thereby facilitates efficient heating of upper die 112 by restricting conduction away from upper die 112. By having upper heat source 122 deliver an actively determined amount of heat to distinct upper regions 190 of upper heating plate 188, it is possible to control the amount of heat delivered to, and thus the temperature of, distinct upper regions 190 to provide desired heating of corresponding regions of upper die 112 and workpiece 114. For example, in some cases, it is desirable to heat the portions of upper die 112, corresponding to tighter bends to be formed in workpiece 114. Additionally or alternatively, it is desirable, in some cases, to deliver greater heat to outer regions of upper die 112 than to inner regions of upper die 112 due to the conductive heat loss through upper insulation layer 192.

In one or more examples, upper housing 186 is constructed of any suitable material and in any suitable configuration, such that it supports the other components of upper hot-box portion 110. As shown in FIGS. 6, 7, and 9-12, in one or more examples upper housing 186 comprises upper top plate 330 and upper side walls 332 constructed of an alloy, such as Inconel.

Upper heating plate 188, which additionally or alternatively may be described as an upper heated platen, is implemented in any suitable form such that it is configured to receive heat from upper heat source 122 and deliver the heat to upper die 112. As illustrated in FIGS. 6, 7, and 9-12, and as discussed herein, upper heating plate 188, in one or more examples, defines portions of upper heating-rod passages 194, within which corresponding upper heating rods, of upper heat source 122, extend.

Referring generally to FIGS. 1 and 2 and particularly to, e.g., FIGS. 6, 7, 9, 10, and 12, upper heating plate 188 defines upper heating-plate volume 346 within which upper die 112 is positioned. The preceding subject matter of this paragraph characterizes example 34 of the present disclosure, wherein example 34 also includes the subject matter according to example 33, above.

By defining upper heating-plate volume 346, within which upper die 112 is positioned, upper heating plate 188 is able to deliver heat to upper die 112 not only from above, but also from the sides of upper die 112. As a result, the heating of upper die 112 is efficient.

Referring generally to FIG. 1 and particularly to, e.g., FIGS. 6, 7, and 9-12, upper heating plate 188 and upper housing 186 collectively define upper heating-rod passages 194. Upper heat source 122 comprises upper heating rods 196 that extend into upper heating-rod passages 194. The preceding subject matter of this paragraph characterizes example 35 of the present disclosure, wherein example 35 also includes the subject matter according to example 33 or 34, above.

Upper heating rods 196, of upper heat source 122, enable controlled heating of upper heating plate 188, and thus of upper die 112 across an entire span of upper heating plate 188. As a result, it is possible to effectively and efficiently control temperatures of various portions of upper heating plate 188.

Upper heating rods 196 are implemented such that they are configured to deliver heat to upper heating plate 188. As an illustrative, non-exclusive example, upper heating rods 196 comprise an elongate heating element, constructed of a nickel-steel, encapsulated by a ceramic layer, and encased in a stainless-steel sheath. The ceramic layer absorbs oxygen to restrict oxidation of the heating element. In one or more examples, upper heating rods 196 are the same or similar to lower heating rods 154.

It is possible to provide any suitable number of upper heating rods 196 and corresponding upper heating-rod passages 194, such as based on the size of upper heating plate 188, the degree of temperature control required for hot-forming press 100, etc. In the illustrated example of FIGS. 6, 7, and 9-12, twenty-eight upper heating-rod passages 194 are defined by upper heating plate 188 and upper housing 186.

In examples of upper hot-box portion 110 in which upper insulation layer 192 extends on the sides of upper heating plate 188, upper insulation layer 192 defines upper heating-rod passages 194 together with upper heating plate 188 and upper housing 186.

Referring generally to FIG. 1 and particularly to, e.g., FIG. 16, upper heating rods 196 are straight along entire lengths of upper heating rods 196. The preceding subject matter of this paragraph characterizes example 36 of the present disclosure, wherein example 36 also includes the subject matter according to example 35, above.

Since upper heating rods 196 are straight along their entire lengths, it is possible to maintain the integrity of upper heating rods 196 for significant periods of time without damage, and thus without requiring expensive replacement thereof.

For example, the ceramic layer of upper heating rods 196 will not crack as in prior art bent heating rods, thereby avoiding air encroachment into upper heating rods 196 and undesirable oxidation and deterioration of the heating elements of upper heating rods 196.

Referring generally to FIG. 1 and particularly to, e.g., FIGS. 3-6, and 16, upper heat source 122 further comprises upper connecting box 198 and upper connecting cables 200 that interconnect upper heating rods 196 to upper connecting box 198. Upper press assembly 108 further comprises upper bolster plate 130. Upper bolster plate 130 is positioned above and vertically supports upper hot-box portion 110.

Upper connecting box 198 is mounted to upper bolster plate 130. The preceding subject matter of this paragraph characterizes example 37 of the present disclosure, wherein example 37 also includes the subject matter according to example 35 or 36, above.

By having upper connecting box 198 mounted to upper bolster plate 130, such as at a periphery or upper side thereof, and by having upper connecting cables 200 interconnect upper heating rods 196 to upper connecting box 198, it is possible to shield, or at least space away, upper connecting box 198 from radiative heat, emanating from lower die 106 and upper die 112 when hot-forming press 100 is in the loading configuration.

In contrast, in prior art hot-forming presses, connect cables and boxes typically are coupled to and in direct contact with hot surfaces of the hot-forming press, resulting in short life spans of these components, and requiring frequent maintenance or replacement thereof.

Referring generally to FIG. 1, upper bolster plate 130 shields upper connecting box 198 from heat, when the heat radiates from upper hot-box portion 110. The preceding subject matter of this paragraph characterizes example 38 of the present disclosure, wherein example 38 also includes the subject matter according to example 37, above.

By shielding upper connecting box 198 from heat that radiates from upper hot-box portion 110, upper connecting box 198 is protected and will have a longer lifespan than connecting boxes of prior art hot-forming presses.

Referring generally to FIG. 1 and particularly to, e.g., FIG. 16, upper heating rods 196 each comprise upper heating zones 202. Temperatures of upper heating zones 202 are independently controlled. Upper heating zones 202 coincide with distinct upper regions 190 of upper heating plate 188. The preceding subject matter of this paragraph characterizes example 39 of the present disclosure, wherein example 39 also includes the subject matter according to any one of examples 35 to 38, above.

By being divided into upper heating zones 202, it is possible to use upper heating rods 196 to independently control the heat, delivered to distinct upper regions 190 of upper heating plate 188, and thus to distinct regions of upper die 112. As discussed, it is possible to control the amount of heat delivered to, and thus the temperature of, distinct upper regions 190 to provide desired heating of corresponding regions of upper die 112 and workpiece 114. For example, in some cases it is desirable to heat the portions of upper die 112 corresponding to tighter bends to be formed in workpiece 114. Additionally or alternatively, in some cases, it is desirable to deliver greater heat to outer regions of upper die 112 than to inner regions of upper die 112 due to the conductive heat loss through upper insulation layer 192. Moreover, in examples of upper hot-box portion 110, in which upper insulation layer 192 has different thicknesses on opposing sides of upper heating plate 188, it is possible to deliver greater heat to the region of upper heating plate 188 that is proximate to the thinner region of upper insulation layer 192, due to the greater loss of heat in such thinner region.

Referring generally to FIG. 1 and particularly to, e.g., FIG. 16, upper heating zones 202 comprise outer upper zones 204 and at least one inner upper zone 206 that is positioned between outer upper zones 204. Outer upper zones 204 have higher heating capacities than at least one inner upper zone 206. The preceding subject matter of this paragraph characterizes example 40 of the present disclosure, wherein example 40 also includes the subject matter according to example 39, above.

In some cases, it is desirable, or necessary, to deliver a greater amount of heat to outer upper zones 204 than to at least one inner upper zone 206, because the regions of upper heating plate 188 proximate to outer upper zones 204 lose heat at a greater rate than the regions of upper heating plate 188 proximate to at least one inner upper zone 206. Accordingly, in one or more examples, upper heating rods 196 with at least one inner upper zone 206, having a lower heating capacity than outer upper zones 204, are less expensive than heating rods with uniform heating capacities along their length.

As illustrated in FIG. 16, in one or more examples, upper heating rods 196 additionally include upper stem region 197 proximate to the corresponding upper connecting cable, with upper stem region 197 being configured not to conduct heat therefrom, such as with the heating element of upper heating rods 196 extending only through outer upper zones 204 and at least one inner upper zone 206. Moreover, in one or more examples, upper stem region 197 extends out from upper hot-box portion 110, in which case it is desirable for upper stem region 197 not to be heated.

Referring generally to FIGS. 1 and 2 and particularly to, e.g., FIGS. 3 and 4, upper hot-box portion 110 has upper front side 208 and upper rear side 210. Upper hot-box portion 110 is configured to receive upper die 112 in a position that is closer to upper front side 208 than to upper rear side 210. Outer upper zones 204 that are proximate to upper front side 208 have higher heating capacities than outer upper zones 204 that are proximate to upper rear side 210. The preceding subject matter of this paragraph characterizes example 41 of the present disclosure, wherein example 41 also includes the subject matter according to example 40, above.

By being positioned closer to upper front side 208, upper die 112, together with lower die 106 and workpiece 114, are more easily accessed by an operator of hot-forming press 100 from upper front side 208, such as to facilitate insertion and removal of workpiece 114.

However, by positioning upper die 112 closer to upper front side 208, and thus by having upper insulation layer 192 thinner on upper front side 208 than upper rear side 210, in some cases it is necessary to deliver greater heat to the region of upper heating plate 188 that is proximate to the thinner region of upper insulation layer 192, due to the greater loss of heat in such thinner region. In such examples, the outer upper zone of an upper heating rod that is proximate upper front side 208 has a higher heating capacity than the outer upper zone of the upper heating rod that is proximate upper rear side 210.

Referring generally to FIG. 1, hot-forming press 100 further comprises upper temperature sensors 212 and controller 156. Upper temperature sensors 212 are configured to sense temperatures of distinct upper regions 190 of upper heating plate 188. Controller 156 is operatively coupled to upper connecting box 198 and is configured to control the actively determined amount of heat to distinct upper regions 190 of upper heating plate 188, based at least in part on the temperatures of distinct upper regions 190 of upper heating plate 188. The preceding subject matter of this paragraph characterizes example 42 of the present disclosure, wherein example 42 also includes the subject matter according to any one of examples 33 to 41, above.

By sensing temperatures of distinct upper regions 190 of upper heating plate 188, controller 156 is able to base the amount of heat, delivered to distinct upper regions 190, on the sensed temperatures, to ensure that distinct upper regions 190 of upper heating plate 188, and thus corresponding regions of upper die 112, are heated to desired temperatures for a particular operation of hot-forming press 100.

In one or more examples, upper temperature sensors 212 are implemented such that they are configured to sense temperatures of distinct upper regions 190 of upper heating plate 188. For example, in one or more examples, upper temperature sensors 212 are thermocouples that are embedded within upper heating plate 188.

Referring generally to FIG. 1, hot-forming press 100 further comprises upper-die temperature sensors 214 that are configured to sense temperatures of upper die 112. Controller 156 is configured to record or display the temperatures of upper die 112. Controller 156 is configured not to control the actively determined amount of heat, delivered to distinct upper regions 190 of upper heating plate 188, based on the temperatures of upper die 112. The preceding subject matter of this paragraph characterizes example 43 of the present disclosure, wherein example 43 also includes the subject matter according to example 42, above.

In one or more examples, recording or displaying the temperatures of upper die 112 is performed for quality control purposes, including, for example, generating a report that shows temperature compliance within or deviations from desired temperature ranges of upper die 112. Additionally or alternatively, in one or more examples, alerts are generated during a forming process for an operator to take corrective action or otherwise make note of one or more problems that may need to be addressed.

Referring generally to FIG. 1 and particularly to, e.g., FIGS. 3, 4, and 17, hot-forming press 100 further comprises display 176 that is operatively coupled to controller 156 and that is configured to display the temperatures of distinct upper regions 190 of upper heating plate 188. The preceding subject matter of this paragraph characterizes example 44 of the present disclosure, wherein example 44 also includes the subject matter according to example 42 or 43, above.

By displaying temperatures of distinct lower regions 146 of lower heating plate 144, in one or more examples, such temperatures are monitored in real time by an operator of hot-forming press for quality control purposes.

As shown in FIG. 17, display 176 provides thermal information, such as associated with distinct upper regions 190 of upper heating plate 188. In the illustrated example of display 176, there are twelve regions of upper heating plate 188 being monitored. Each one of the regions has a distinct controller, or amp stack, associated with it for controlling the amount of current delivered to each circuit associated with upper heating zones 202 of the corresponding one of upper heating rods 196. These distinct controllers also monitor whether or not there is a problem with an upper heating rod, and communicate with controller 156 whether upper heating rods 196 are holding their temperatures correctly or whether they need more energy. Each of these distinct controllers can feed more or less power to the corresponding upper heating rod based on the temperatures sensed by upper temperature sensors 212.

In the illustrated example of display 176 in FIG. 17, the temperatures sensed by upper temperature sensors 212 are indicated by a digital "needle," or line, superimposed on a representation of an analog meter representing a temperature range, with an acceptable temperature range represented in the middle and with undesirable temperature ranges represented on the left-hand and right-hand sides of the analog meter. Accordingly, when the needle is in the intermediate range, the corresponding upper region of upper heating plate 188 is at a desired temperature. However, if the needle is in the left-hand-side range, the corresponding region of upper heating plate 188 is too cold, and the corresponding zone of the associated one of upper heating rods 196 may be defective or otherwise not working properly. If the needle is in the right-hand-side range, the corresponding region of upper heating plate 188 is too hot, and the corresponding zone of the associated one of upper heating rods 196 may be defective or otherwise not working properly. In one or more examples, the intermediate range is displayed as green, or another color, when the needle is within the intermediate range, thereby alerting an operator that the corresponding zone is functioning properly. In one or more examples, the intermediate range is displayed as yellow, or another color, when the needle is within the left-hand-side or right-hand-side ranges, thereby alerting an operator that the corresponding zone may not be functioning properly.

As shown in FIG. 17, the operator of hot-forming press 100 is able to customize the allowable deviation for the temperatures. In the illustrated example, the deviation is set to 50 degrees.

Referring generally to FIGS. 1 and 2 and particularly to, e.g., FIGS. 6-13, upper hot-box portion 110 further comprises upper cold plate 216. Upper cold plate 216 is positioned at least partially between upper insulation layer 192 and upper housing 186 and is configured to draw heat away from upper hot-box portion 110. The preceding subject matter of this paragraph characterizes example 45 of the present disclosure, wherein example 45 also includes the subject matter according to any one of examples 33 to 44, above.

Upper cold plate 216 draws away from upper hot-box portion 110 heat that conducts through upper insulation layer 192 from upper heating plate 188. Accordingly, upper cold plate 216 prevents upper housing 186 and upper bolster plate 130 from becoming too hot for an operator of hot-forming press 100.

Upper cold plate 216 is a heat transfer device and, in one or more examples, is implemented such that it effectively draws heat away from upper hot-box portion 110. For example, in one or more examples, upper cold plate 216 is made of stainless steel with one or more cooling channels extending through upper cold plate 216 and with a coolant (e.g., glycol) circulating through the one or more cooling channels. In some examples, upper cold plate 216 is made in two separate pieces that are welded together. Such a two-piece construction facilitates the machining of a single circuitous cooling channel in each piece. Alternatively, in one or more examples, upper cold plate 216 is made as a single piece, which avoids coolant leakage and the need for a gasket between the two pieces of a two-piece construction. In such a one-piece construction, the cooling channels are, in some examples, gun-drilled all the way through upper cold plate 216, thereby requiring external plumbing to connect the cooling channels together. In one or more examples, the coolant is delivered and withdrawn from upper cold plate 216 via a factory-based coolant system.

Referring generally to FIGS. 1 and 2 and particularly to, e.g., FIGS. 7 and 10-13, upper hot-box portion 110 further comprises upper hot-box fasteners 218 that operatively interconnect upper housing 186, upper heating plate 188, and upper insulation layer 192. Upper hot-box fasteners 218 comprise upper bolts 220 and spring-loaded upper nut assemblies 222 that are operatively coupled to upper bolts 220 and that are configured to enable upper hot-box portion 110 to expand and contract without damage to upper hot-box portion 110. The preceding subject matter of this paragraph characterizes example 46 of the present disclosure, wherein example 46 also includes the subject matter according to any one of examples 33 to 45, above.

Upper hot-box fasteners 218 enable the assembly of upper hot-box portion 110 to expand and contract as a result of the significant temperature ranges experienced by upper hot-box portion 110 when hot-forming press 100 is being used and when it is not being used.

In one or more examples, upper hot-box fasteners 218 are implemented such that they permit the expansion and contraction of upper hot-box portion 110 without damage thereto. With reference to FIG. 13, upper bolts 220 are, for example, constructed of two portions, including first upper-bolt portion 221 including the bolt head and constructed of a high-temperature alloy, such as Supertherm, and second upper-bolt portion 223 constructed of a lower temperature and less expensive alloy, such as Inconel, welded to first upper-bolt portion 221. As an example, spring-loaded upper nut assemblies 222 comprise a stack of Belleville washers.

Referring generally to FIG. 1 and particularly to, e.g., FIG. 18, hot-forming press 100 further comprises gas pressure system 224. Gas pressure system 224 is configured to deliver a gas to internal chamber 226 of workpiece 114 when workpiece 114 is operatively positioned between lower die 106 and upper die 112 and when lower die 106 and upper die 112 are applying the forming pressure to workpiece 114. The preceding subject matter of this paragraph characterizes example 47 of the present disclosure, wherein example 47 also includes the subject matter according to any one of examples 1 to 46, above.

Inclusion of gas pressure system 224 enables hot-forming press 100 to form parts from multi-sheet workpieces. More specifically, by delivering the gas to internal chamber 226 of workpiece 114 at an elevated pressure when workpiece 114 is held between lower die 106 and upper die 112 and when hot-forming press 100 is applying tonnage, not only is it possible to use lower die 106 and upper die 112 to bend workpiece 114 into a desired form, but it is also possible to use lower die 106 and upper die 112 as a mold as the gas pressure pushes workpiece 114 radially toward into engagement with and to conform to lower die 106 and upper die 112.

With reference to FIG. 18, in one or more examples, workpiece 114 comprises more than one sheet 225 of material. As an illustrative, non-exclusive example, workpiece 114 is constructed of titanium and the gas, introduced by gas pressure system 224, is argon or another gas, suitable for reducing or eliminating oxidation of the titanium.

As a more specific example, a part is formed from four sheets of titanium. The two inner sheets are first welded together (e.g., with resistance welds) to form interstitial pockets between the sheets before workpiece 114 is loaded into hot-forming press 100. Then, workpiece 114 is loaded into hot-forming press 100, the gas is introduced between the inner sheets by gas pressure system 224, thereby inflating a pocket or pockets within the sheets and forming a sandwich structure. Wherever the two inner sheets touch the two outer sheets, the titanium is diffusion-bonded together.

In one or more examples, gas pressure system 224 is configured to control the application of gas pressure in the range of 0 to 600 psi, or greater, depending on the application required. As gas pressure increases, the tonnage applied by hot-forming press 100 must increase the same amount to keep hot-forming press 100 in the closed configuration. In other words, the tonnage applied by hot-forming press 100 when utilizing gas pressure system 224 is directed related to the gas pressure being applied by gas pressure system 224.

To enable gas pressure to be applied between the sheets of workpiece 114 by gas pressure system 224, workpiece 114 typically incorporates gas tubes welded onto the sheets for delivery of the gas pressure internal volume(s) of workpiece 114.

In one or more examples, gas pressure system 224 comprises a pressure transducer to measure the gas pressure, applied to internal chamber 226, and an electronic pressure regulator, operated by a motor, to control the gas pressure.

FIG. 19 illustrates an example of display 176, generated when hot-forming press 100 comprises gas pressure system 224.

Referring generally to FIG. 2 and particularly to, e.g., FIGS. 3, 4, and 6-15, hot box 300 of hot-forming press 100 is disclosed. Hot box 300 comprises lower hot-box portion 104 and upper hot-box portion 110. Lower hot-box portion 104 comprises lower housing 142, lower heating plate 144, and lower insulation layer 148. Lower heating plate 144 is received within lower housing 142 and is configured to support lower die 106. Lower insulation layer 148 is positioned between lower housing 142 and lower heating plate 144. Upper hot-box portion 110 is positionable above lower hot-box portion 104 and comprises upper housing 186, upper heating plate 188, and upper insulation layer 192. Upper heating plate 188 is received within upper housing 186 and is configured to support upper die 112. Upper insulation layer 192 is positioned between upper housing 186 and upper heating plate 188. Lower hot-box portion 104 and upper hot-box portion 110 provide a thermal barrier around workpiece 114 that is received between lower die 106 and upper die 112, when lower hot-box portion 104 and upper hot-box portion 110 are in contact with each other. The preceding subject matter of this paragraph characterizes example 48 of the present disclosure.

Hot box 300 provides a thermal barrier to maintain the heat delivered to lower die 106 and upper die 112, and thus to workpiece 114, when hot-forming press 100 is operatively forming a part from workpiece 114. Lower housing 142 provides structure for supporting the other components of lower hot-box portion 104. Lower insulation layer 148 insulates lower heating plate 144, which is configured to support lower die 106 and conduct heat thereto, and thereby facilitates efficient heating of lower die 106 by restricting conduction away from lower die 106. Similarly, upper housing 186 provides structure for supporting the other components of upper hot-box portion 110. Upper insulation layer 192 insulates upper heating plate 188, which is configured to support upper die 112 and conduct heat thereto, and thereby facilitates efficient heating of upper die 112 by restricting conduction away from upper die 112.

Referring generally to FIG. 2 and particularly to, e.g., FIGS. 3, 4, 6-11, 14, and 15, lower housing 142 comprises lower base plate 302 and lower side walls 304, positioned above lower base plate 302. The preceding subject matter of this paragraph characterizes example 49 of the present disclosure, wherein example 49 also includes the subject matter according to example 48, above.

Lower base plate 302 provides support from below the other components of lower hot-box portion 104, and lower side walls 304 provide lateral support to maintain lower insulation layer 148 in an operative position between lower housing 142 and lower heating plate 144. In addition, in examples of lower hot-box portion 104 that also comprises lower cold plate 178, the two-piece construction of lower housing 142 provides access for coolant lines to be connected to lower cold plate 178.

Referring generally to FIG. 2 and particularly to, e.g., FIGS. 6, 7, 9, and 14, lower base plate 302, lower insulation layer 148, and lower heating plate 144 collectively define at least one lower lift-pin passage 306. At least one lower lift-pin passage 306 is configured to receive at least one lower-die lift pin 136 for operative engagement with lower die 106 and for separation of lower die 106 from lower hot-box portion 104. The preceding subject matter of this paragraph characterizes example 50 of the present disclosure, wherein example 50 also includes the subject matter according to example 49, above.

At least one lower lift-pin passage 306 provides a sliding conduit for Lower-die lift pin 136. More specifically, when hot box 300 is a component of hot-forming press 100, at least one lower lift-pin passage 306 and lower-die lift pin 136 enable hot-forming press 100 to be moved to the die-setup configuration, as discussed herein.

In examples of lower hot-box portion 104 that also comprise lower cold plate 178, lower cold plate 178 also defines at least one lower lift-pin passage 306 collectively with lower base plate 302, lower insulation layer 148, and lower heating plate 144.

Referring generally to FIG. 2 and particularly to, e.g., FIGS. 7, 10, 14, and 15, lower base plate 302, lower insulation layer 148, and lower heating plate 144 collectively define lower bolt passages 308. Lower hot-box portion 104 further comprises lower bolts 182 and spring-loaded lower nut assemblies 184. Lower bolts 182 extend through lower bolt passages 308. Spring-loaded lower nut assemblies 184 are operatively coupled to lower bolts 182 and are configured to permit lower hot-box portion 104 to expand and contract without damage to lower hot-box portion 104. The preceding subject matter of this paragraph characterizes example 51 of the present disclosure, wherein example 51 also includes the subject matter according to example 49 or 50, above.

Lower bolt passages 308, lower bolts 182, and spring-loaded lower nut assemblies 184 operatively couple together the component parts of lower hot-box portion 104 and enable the assembly of lower hot-box portion 104 to expand and contract as a result of the significant temperature ranges experienced by lower hot-box portion 104 when installed as part of hot-forming press 100.

In examples of lower hot-box portion 104 that also comprise lower cold plate 178, lower cold plate 178 also defines lower bolt passages 308 collectively with lower base plate 302, lower insulation layer 148, and lower heating plate 144.

Referring generally to FIG. 2 and particularly to, e.g., FIGS. 7, 9, 10, 14, and 15, spring-loaded lower nut assemblies 184 are positioned within lower base plate 302. The preceding subject matter of this paragraph characterizes example 52 of the present disclosure, wherein example 52 also includes the subject matter according to example 51, above.

By being positioned within lower base plate 302, spring-loaded lower nut assemblies 184 are shielded from heat emanating from lower heating plate 144.

Referring generally to FIG. 2 and particularly to, e.g., FIGS. 7, 10, 14, and 15, lower bolt passages 308 comprise lower rounded counterbores 310. Lower bolts 182 comprise lower rounded heads 312 that are configured to mate with lower rounded counterbores 310. The preceding subject matter of this paragraph characterizes example 53 of the present disclosure, wherein example 53 also includes the subject matter according to example 51 or 52, above.

The interface between lower rounded counterbores 310 and lower rounded heads 312 of lower bolts 182 avoids creating stress risers that could lead to crack formation as a result of the thermal cycling, experienced by lower heating plate 144 and lower bolts 182.

Referring generally to FIG. 2 and particularly to, e.g., FIGS. 7, 10, 14, and 15, lower heating plate 144 defines lower rounded counterbores 310. Lower rounded heads 312 are positioned within lower heating plate 144. The preceding subject matter of this paragraph characterizes example 54 of the present disclosure, wherein example 54 also includes the subject matter according to example 53, above.

By having lower rounded heads 312 of lower bolts 182 positioned within lower heating plate 144, lower rounded heads 312 do not interfere with the lower heating plate's engagement with lower die 106. Moreover, spring-loaded lower nut assemblies 184 are necessarily positioned away from lower heating plate 144 and thus are shielded from heat emanating from lower heating plate 144.

Referring generally to FIG. 2 and particularly to, e.g., FIGS. 6, 7, 9, and 10, lower insulation layer 148 defines lower insulation volume 314. Lower heating plate 144 is positioned within lower insulation volume 314. The preceding subject matter of this paragraph characterizes example 55 of the present disclosure, wherein example 55 also includes the subject matter according to any one of examples 49 to 54, above.

Lower insulation layer 148 insulates lower heating plate 144 from below and from the sides of lower heating plate 144, thereby maximizing the insulative function of lower insulation layer 148 with respect to heat conducted away from lower heating plate 144.

Referring generally to FIG. 2 and particularly to, e.g., FIGS. 6, 7, 9, 10, and 14, lower insulation layer 148 comprises lower ceramic sheets 316 and at least one lower ceramic block 318. Lower ceramic sheets 316 are positioned between lower heating plate 144 and lower side walls 304. At least one lower ceramic block 318 is positioned between lower heating plate 144 and lower base plate 302. The preceding subject matter of this paragraph characterizes example 56 of the present disclosure, wherein example 56 also includes the subject matter according to example 55, above.

Use of lower ceramic sheets 316 and at least one lower ceramic block 318 facilitates assembly of lower hot-box portion 104.

However, also within the scope of the present disclosure is lower insulation layer 148 comprising a single monolithic block of insulation that defines lower insulation volume 314 and thus that insulates lower heating plate 144 from below and its sides.

Referring generally to FIG. 2 and particularly to, e.g., FIGS. 6, 7, 9, 10, and 14, lower heating plate 144 defines lower heating-plate volume 320, which is sized to receive and operatively position lower die 106. The preceding subject matter of this paragraph characterizes example 57 of the present disclosure, wherein example 57 also includes the subject matter according to any one of examples 49 to 56, above.

By having lower heating-plate volume 320, which receives lower die 106, lower heating plate 144 is able to heat lower die 106 not only from below lower die 106, but also from the sides and ends of lower die 106.

Referring generally to FIG. 2, lower hot-box portion 104 has lower front side 172 and lower rear side 174. Lower heating-plate volume 320 is positioned closer to lower front side 172 than to lower rear side 174. The preceding subject matter of this paragraph characterizes example 58 of the present disclosure, wherein example 58 also includes the subject matter according to example 57, above.

By positioning lower heating-plate volume 320 closer to lower front side 172 than to lower rear side 174, lower die 106 is therefore positioned closer to lower front side 172 than to lower rear side 174. As a result, lower die 106, together with upper die 112 and workpiece 114, is more easily accessed by an operator of hot-forming press 100 from lower front side 172, such as to facilitate insertion and removal of workpiece 114.

Referring generally to FIG. 2 and particularly to, e.g., FIGS. 6, 7, 9, 10, 13, and 14, lower heating plate 144 and lower side walls 304 collectively define lower heating-rod passages 152, which are configured to receive lower heating rods 154. The preceding subject matter of this paragraph characterizes example 59 of the present disclosure, wherein example 59 also includes the subject matter according to any one of examples 49 to 58, above.

Lower heating-rod passages 152 provide conduits for insertion of lower heating rods 154. As discussed herein, lower heating rods 154 enable controlled heating of lower heating plate 144, and thus of lower die 106, across an entire span of lower heating plate 144. As a result, it is possible to effectively and efficiently control temperatures of various portions of lower heating plate 144.

In examples of lower hot-box portion 104 in which lower insulation layer 148 extends on the sides of lower heating plate 144, lower insulation layer 148 defines lower heating-rod passages 152 together with lower heating plate 144 and lower side walls 304.

Referring generally to FIG. 2 and particularly to, e.g., FIG. 14, lower hot-box portion 104 has lower front side 172 and lower rear side 174. Lower heating-rod passages 152 extend through lower side walls 304 only on lower rear side 174. The preceding subject matter of this paragraph characterizes example 60 of the present disclosure, wherein example 60 also includes the subject matter according to example 59, above.

By only extending through lower side walls 304 on lower rear side 174 of lower hot-box portion 104, lower heating-rod passages 152 provide for installation of corresponding lower heating rods from the rear side of hot-forming press 100. Accordingly, corresponding lower connecting cables are all routed on the rear side of hot-forming press 100, leaving the front side of hot-forming press 100 open for the operator to insert and remove workpiece 114 and otherwise access hot box 300.

Referring generally to FIG. 2 and particularly to, e.g., FIGS. 6, 7, 9, 10, and 14, lower heating plate 144 defines lower slot 322, which is configured to receive lower coupler 324 for operatively retaining lower die 106 to lower heating plate 144. The preceding subject matter of this paragraph characterizes example 61 of the present disclosure, wherein example 61 also includes the subject matter according to any one of examples 49 to 60, above.

Lower slot 322 and lower coupler 324 permit lower die 106 to be coupled and retained to lower heating plate 144.

In one or more examples, lower slot 322 is described as, or is in the form of, a T-slot, and lower coupler 324 is described as, or is in the form of, a T-peen.

Referring generally to FIG. 2 and particularly to, e.g., FIGS. 3, 4, 8, and 14, lower side walls 304 define lower access passage 328, which is configured to provide access to lower slot 322 for operative insertion and removal of lower coupler 324. The preceding subject matter of this paragraph characterizes example 62 of the present disclosure, wherein example 62 also includes the subject matter according to example 61, above.

As indicated, lower access passage 328 provides access to lower slot 322 for operative insertion and removal of lower coupler 324.

In examples of lower hot-box portion 104 that include lower insulation layer 148 between lower heating plate 144 and lower side walls 304, lower insulation layer 148 defines lower access passage 328 with lower side walls 304.

Referring generally to FIG. 2 and particularly to, e.g., FIGS. 3, 4, 6-10, and 14, lower base plate 302 comprises lower peripheral flange 326, which is configured to operatively couple lower hot-box portion 104 to lower bolster plate 128 of hot-forming press 100. The preceding subject matter of this paragraph characterizes example 63 of the present disclosure, wherein example 63 also includes the subject matter according to any one of examples 49 to 62, above.

Lower peripheral flange 326 provides structure for coupling lower hot-box portion 104 to lower bolster plate 128, such as with lower bolted brackets 327.

Referring generally to FIG. 2 and particularly to, e.g., FIGS. 3, 4, 6-10, 14, and 15, lower hot-box portion 104 further comprises lower cold plate 178, which is positioned between lower insulation layer 148 and lower base plate 302 and is configured to draw heat away from hot box 300. The preceding subject matter of this paragraph characterizes example 64 of the present disclosure, wherein example 64 also includes the subject matter according to any one of examples 49 to 63, above.

Lower cold plate 178 draws away from lower hot-box portion 104 heat that conducts through lower insulation layer 148 from lower heating plate 144. Accordingly, lower cold plate 178 prevents lower housing 142 and lower bolster plate 128 from becoming too hot for an operator of hot-forming press 100.

Referring generally to FIG. 2 and particularly to, e.g., FIGS. 3, 4, 6-10, 14, and 15, lower cold plate 178 extends between lower base plate 302 and lower side walls 304. The preceding subject matter of this paragraph characterizes example 65 of the present disclosure, wherein example 65 also includes the subject matter according to example 64, above.

By having lower cold plate 178 extend between lower base plate 302 and lower side walls 304, coolant lines are easily connected to lower cold plate 178.

Referring generally to FIG. 2 and particularly to, e.g., FIGS. 3, 4, 6, and 8-12, upper housing 186 comprises upper top plate 330 and upper side walls 332, positioned below upper top plate 330. The preceding subject matter of this paragraph characterizes example 66 of the present disclosure, wherein example 66 also includes the subject matter according to any one of examples 48 to 65, above.

Upper top plate 330 provides support from above the other components of upper hot-box portion 110, and upper side walls 332 provide lateral support to maintain upper insulation layer 192 in an operative position between upper housing 186 and upper heating plate 188. In addition, in examples of upper hot-box portion 110 that also comprises upper cold plate 216, the two-piece construction of upper housing 186 provides access for coolant lines to be connected to upper cold plate 216.

Referring generally to FIG. 2 and particularly to, e.g., FIGS. 7-13, upper top plate 330, upper insulation layer 192, and upper heating plate 188 collectively define upper bolt passages 334. Upper hot-box portion 110 further comprises upper bolts 220 and spring-loaded upper nut assemblies 222. Upper bolts 220 extend through upper bolt passages 334. Spring-loaded upper nut assemblies 222 are operatively coupled to upper bolts 220 and are configured to permit upper hot-box portion 110 to expand and contract without damage to upper hot-box portion 110. The preceding subject matter of this paragraph characterizes example 67 of the present disclosure, wherein example 67 also includes the subject matter according to example 66, above.

Upper bolt passages 334, upper bolts 220, and spring-loaded upper nut assemblies 222 operatively couple together the component parts of upper hot-box portion 110 and enable the assembly of upper hot-box portion 110 to expand and contract as a result of the significant temperature ranges experienced by upper hot-box portion 110 when installed as part of hot-forming press 100.

In examples of upper hot-box portion 110 that also comprise upper cold plate 216, upper cold plate 216 also defines upper bolt passages 334 collectively with upper top plate 330, upper insulation layer 192, and upper heating plate 188.

Referring generally to FIG. 2 and particularly to, e.g., FIGS. 9, 10, and 13, spring-loaded upper nut assemblies 222 are positioned within upper top plate 330. The preceding subject matter of this paragraph characterizes example 68 of the present disclosure, wherein example 68 also includes the subject matter according to example 67, above.

By being positioned within upper top plate 330, spring-loaded upper nut assemblies 222 are shielded from heat emanating from upper heating plate 188.

Referring generally to FIG. 2 and particularly to, e.g., FIGS. 7 and 10-13, upper bolt passages 334 comprise upper rounded counterbores 336. Upper bolts 220 comprise upper rounded heads 338, which are configured to mate with upper rounded counterbores 336. The preceding subject matter of this paragraph characterizes example 69 of the present disclosure, wherein example 69 also includes the subject matter according to example 67 or 68, above.

The interface between upper rounded counterbores 336 and upper rounded heads 338 of upper bolts 220 avoids creating stress risers that could lead to crack formation as a result of the thermal cycling experienced by upper heating plate 188 and upper bolts 220.

Referring generally to FIG. 2 and particularly to, e.g., FIGS. 7, 10, and 13, upper heating plate 188 defines upper rounded counterbores 336. Upper rounded heads 338 are positioned within upper heating plate 188. The preceding subject matter of this paragraph characterizes example 70 of the present disclosure, wherein example 70 also includes the subject matter according to example 69, above.

By having upper rounded heads 338 of upper bolts 220 positioned within upper heating plate 188, upper rounded heads 338 do not interfere with the upper heating plate's engagement with upper die 112. Moreover, spring-loaded upper nut assemblies 222 are necessarily positioned away from upper heating plate 188 and thus are shielded from heat emanating from upper heating plate 188.

Referring generally to FIG. 2 and particularly to, e.g., FIGS. 6, 7, 9, and 10, upper insulation layer 192 defines upper insulation volume 340, and upper heating plate 188 is positioned within upper insulation volume 340. The preceding subject matter of this paragraph characterizes example 71 of the present disclosure, wherein example 71 also includes the subject matter according to any one of examples 66 to 70, above.

Upper insulation layer 192 insulates upper heating plate 188 from above and from the sides of upper heating plate 188, thereby maximizing the insulative function of upper insulation layer 192 with respect to heat conducted away from upper heating plate 188.

Referring generally to FIG. 2 and particularly to, e.g., FIGS. 6, 7, and 9-13, upper insulation layer 192 comprises upper ceramic sheets 342 and at least one upper ceramic block 344. Upper ceramic sheets 342 are positioned between upper heating plate 188 and upper side walls 332. At least one upper ceramic block 344 is positioned between upper heating plate 188 and upper top plate 330. The preceding subject matter of this paragraph characterizes example 72 of the present disclosure, wherein example 72 also includes the subject matter according to example 71, above.

Use of upper ceramic sheets 342 and at least one upper ceramic block 344 facilitates assembly of upper hot-box portion 110.

However, also within the scope of the present disclosure is upper insulation layer 192 comprising a single monolithic block of insulation that defines upper insulation volume 340 and thus that insulates upper heating plate 188 from above and its sides.

Referring generally to FIG. 2 and particularly to, e.g., FIGS. 6, 7, 9, 10, and 12, upper heating plate 188 defines upper heating-plate volume 346, which is sized to receive and operatively position upper die 112. The preceding subject matter of this paragraph characterizes example 73 of the present disclosure, wherein example 73 also includes the subject matter according to any one of examples 66 to 72, above.

By having upper heating-plate volume 346, which receives upper die 112, upper heating plate 188 is able to heat upper die 112 not only from above upper die 112, but also from the sides and ends of upper die 112.

Referring generally to FIG. 2, upper hot-box portion 110 has upper front side 208 and upper rear side 210. Upper heating-plate volume 346 is positioned closer to upper front side 208 than to upper rear side 210. The preceding subject matter of this paragraph characterizes example 74 of the present disclosure, wherein example 74 also includes the subject matter according to example 73, above.

By positioning upper heating-plate volume 346 closer to upper front side 208 than to upper rear side 210, upper die 112 is therefore positioned closer to upper front side 208 than to upper rear side 210. As a result, upper die 112, together with lower die 106 and workpiece 114, is more easily accessed by an operator of hot-forming press 100 from upper front side 208, such as to facilitate insertion and removal of workpiece 114.

Referring generally to FIG. 2 and particularly to, e.g., FIGS. 6, 7, and 9-13, upper heating plate 188 and upper side walls 332 collectively define upper heating-rod passages 194, which are configured to receive upper heating rods 196. The preceding subject matter of this paragraph characterizes example 75 of the present disclosure, wherein example 75 also includes the subject matter according to any one of examples 66 to 74, above.

Upper heating-rod passages 194 provide conduits for insertion of upper heating rods 196. As discussed herein, upper heating rods 196 enable controlled heating of upper heating plate 188, and thus of upper die 112, across an entire span of upper heating plate 188. As a result, it is possible to effectively and efficiently control temperatures of various portions of upper heating plate 188.

In examples of upper hot-box portion 110 in which upper insulation layer 192 extends on the sides of upper heating plate 188, upper insulation layer 192 defines upper heating-rod passages 194 together with upper heating plate 188 and upper side walls 332.

Referring generally to FIG. 2 and particularly to, e.g., FIGS. 11 and 12, upper hot-box portion 110 has upper front side 208 and upper rear side 210. Upper heating-rod passages 194 extend through upper side walls 332 only on upper rear side 210. The preceding subject matter of this paragraph characterizes example 76 of the present disclosure, wherein example 76 also includes the subject matter according to example 75, above.

By only extending through upper side walls 332 on upper rear side 210 of upper hot-box portion 110, upper heating-rod passages 194 provide for installation of corresponding upper heating rods from the rear side of hot-forming press 100. Accordingly, corresponding upper connecting cables are all routed on the rear side of hot-forming press 100, leaving the front side of hot-forming press 100 open for the operator to insert and remove workpiece 114 and otherwise access hot box 300.

Referring generally to FIG. 2 and particularly to, e.g., FIGS. 6, 7, 9, 10, and 12, upper heating plate 188 defines upper slot 348, which is configured to receive upper coupler 350 for operatively retaining upper die 112 to upper heating plate 188. The preceding subject matter of this paragraph characterizes example 77 of the present disclosure, wherein example 77 also includes the subject matter according to any one of examples 66 to 76, above.

Upper slot 348 and upper coupler 350 permit upper die 112 to be coupled and retained to upper heating plate 188.

In one or more examples, upper slot 348 is described as, or is in the form of, a T-slot, and upper coupler 350 is described as, or is in the form of, a T-peen.

Referring generally to FIG. 2 and particularly to, e.g., FIGS. 3, 4, 8, 11, and 12, upper side walls 332 define upper access passage 352, which is configured to provide access to upper slot 348 for operative insertion and removal of upper coupler 350. The preceding subject matter of this paragraph characterizes example 78 of the present disclosure, wherein example 78 also includes the subject matter according to example 77, above.

As indicated, upper access passage 352 provides access to upper slot 348 for operative insertion and removal of upper coupler 350.

In examples of upper hot-box portion 110 that include upper insulation layer 192 between upper heating plate 188 and upper side walls 332, upper insulation layer 192 defines upper access passage 352 with upper side walls 332.

Referring generally to FIG. 2 and particularly to, e.g., FIGS. 6 and 8-12, upper top plate 330 comprises upper peripheral flange 354, which is configured to operatively couple upper hot-box portion 110 to upper bolster plate 130 of hot-forming press 100. The preceding subject matter of this paragraph characterizes example 79 of the present disclosure, wherein example 79 also includes the subject matter according to any one of examples 66 to 78, above.

Upper peripheral flange 354 provides structure for coupling upper hot-box portion 110 to upper bolster plate 130, such as with upper bolted brackets 355.

Referring generally to FIG. 2 and particularly to, e.g., FIGS. 3, 4, 6, and 8-13, upper hot-box portion 110 further comprises upper cold plate 216. Upper cold plate 216 is positioned between upper insulation layer 192 and upper top plate 330 and is configured to draw heat away from hot box 300. The preceding subject matter of this paragraph characterizes example 80 of the present disclosure, wherein example 80 also includes the subject matter according to any one of examples 66 to 79, above.

Upper cold plate 216 draws away from upper hot-box portion 110 heat that conducts through upper insulation layer 192 from upper heating plate 188. Accordingly, upper cold plate 216 prevents upper housing 186 and upper bolster plate 130 from becoming too hot for an operator of hot-forming press 100.

Referring generally to FIG. 2 and particularly to, e.g., FIGS. 3, 4, 6, and 8-13, upper cold plate 216 extends between upper top plate 330 and upper side walls 332. The preceding subject matter of this paragraph characterizes example 81 of the present disclosure, wherein example 81 also includes the subject matter according to example 80, above.

By having upper cold plate 216 extend between upper top plate 330 and upper side walls 332, coolant lines are easily connected to upper cold plate 216.

Referring generally to FIG. 20 and particularly to, e.g., FIGS. 1, 3, 4, and 6, method 400 of hot-forming workpiece 114 is disclosed. Method 400 comprises a step of (block 402) vertically moving both lower press assembly 102 and upper press assembly 108 to a loading configuration, in which lower press assembly 102 and upper press assembly 108 are spaced-apart to receive workpiece 114. Method 400 also comprises a step of (block 404) positioning workpiece 114 between lower die 106 of lower press assembly 102 and upper die 112 of upper press assembly 108. Method 400 further comprises a step of (block 406) vertically moving both lower press assembly 102 and upper press assembly 108 to a closed configuration, in which lower press assembly 102 and upper press assembly 108 are positioned to apply a forming pressure to workpiece 114. Method 400 additionally comprises a step of (block 408) immobilizing upper press assembly 108. Method 400 further comprises a step of (block 410) moving lower press assembly 102 toward upper press assembly 108 to apply the forming pressure to workpiece 114. Method 400 also comprises a step of (block 412) heating workpiece 114. The preceding subject matter of this paragraph characterizes example 82 of the present disclosure.

By vertically moving both lower press assembly 102 and upper press assembly 108 between the loading configuration and the closed configuration, the component(s) of hot-forming press 100 that apply a forming force to generate the forming pressure (i.e., the tonnage of hot-forming press 100) for application to workpiece 114 need not have a significant stroke length that accounts both for operative placement of workpiece 114 and removal of a formed part from hot-forming press 100 and for application of the forming force. Similarly, the component(s) of hot-forming press 100 that apply a forming force to generate the forming pressure need not have a stroke length that also accounts for removal and replacement of lower die 106 and upper die 112. Accordingly, the component(s) of hot-forming press 100 that apply the forming force to generate the forming pressure undergo less stress over the same number of cycles than prior art hot-forming presses, thus requiring less maintenance and repair over the lifetime of hot-forming press 100.

By immobilizing upper press assembly 108, the component(s) associated with vertically moving upper press assembly 108 need not be capable of applying a forming force that is sufficient to generate the required forming pressure to operatively deform workpiece 114. Rather, only the component(s) associated with vertically moving lower press assembly 102 need be capable of applying a forming force that is sufficient to generate the required forming pressure to operatively deform workpiece 114. As a result, in one or more examples, the component(s), associated with vertically moving upper press assembly 108, are significantly less expensive than the component(s), associated with vertically moving lower press assembly 102.

Referring generally to FIG. 20, according to method 400, the step of (block 412) heating workpiece 114 comprises heating workpiece 114 to a temperature of at least 250° C., at least 500° C., or at least 750° C., or to a temperature in the range of 250-1000° C. The preceding subject matter of this paragraph characterizes example 83 of the present disclosure, wherein example 83 also includes the subject matter according to example 82, above.

Heating workpiece 114 to a desired temperature enables the yield strength, hardness, and ductility of workpiece 114, and ultimately of a part being formed from workpiece 114, to be controlled. That is, depending on the material selection for workpiece 114, in one or more examples, a temperature or temperature range is selected to be above the recrystallization temperature of the material to avoid string hardening of the material during the forming process. Moreover, heating workpiece 114 allows for high-strength materials to be formed at lower forming pressures than would be required in a cold-forming process.

Referring generally to FIG. 20, according to method 400, the forming pressure results from a forming force of at least 50 metric tons, at least 100 metric tons, at least 300 metric tons, at least 500 metric tons, at least 700 metric tons, at least 1000 metric tons, or at least 2000 metric tons, or in the range of 50-2250 metric tons. The preceding subject matter of this paragraph characterizes example 84 of the present disclosure, wherein example 84 also includes the subject matter according to example 82 or 83, above.

Forming pressures are selected based on material properties of workpiece 114 and the complexity of a part being formed from workpiece 114. Moreover, in one or more examples, higher forming pressures provide for lower temperature requirements to result in desired material properties of the part being formed from workpiece 114.

Referring generally to FIG. 20 and particularly to, e.g., FIGS. 1 and 7, method 400 further comprises a step of (block 414) vertically moving lower press assembly 102 to a die-setup configuration, in which lower die 106 is spaced-apart from lower hot-box portion 104 of lower press assembly 102. Method 400 also comprises, while lower press assembly 102 is in the die-setup configuration, a step of (block 416) removing and replacing lower die 106 from lower hot-box portion 104. The preceding subject matter of this paragraph characterizes example 85 of the present disclosure, wherein example 85 also includes the subject matter according to any one of examples 82 to 84, above.

In the die-setup configuration, lower die 106 is removed from lower hot-box portion 104 and replaced, in one or more examples. Accordingly, it is possible to selectively configure hot-forming press 100 for formation of various parts.

Referring generally to FIG. 20 and particularly to, e.g., FIGS. 1 and 7, according to method 400, the step of (block 414) vertically moving lower press assembly 102 to the die-setup configuration comprises (block 418) lowering lower hot-box portion 104 relative to at least one lower-die lift pin 136 that extends into lower hot-box portion 104 and that operatively engages lower die 106 to prevent lower die 106 from lowering with lower hot-box portion 104. The preceding subject matter of this paragraph characterizes example 86 of the present disclosure, wherein example 86 also includes the subject matter according to example 85, above.

Preventing lower die 106 from lowering with lower hot-box portion 104 results in lower die 106 being positioned above lower hot-box portion 104. Accordingly, in one or more examples, lower die 106 is removed and replaced, such as with a forklift.

Referring generally to FIG. 20 and particularly to, e.g., FIGS. 1, 3, 4, and 6, according to method 400, the step of (block 402) vertically moving lower press assembly 102 and upper press assembly 108 to the loading configuration and the step of (block 406) vertically moving lower press assembly 102 and upper press assembly 108 to the closed configuration comprise (blocks 420 and 422) vertically moving lower press assembly 102 with at least one hydraulic cylinder 124. The preceding subject matter of this paragraph characterizes example 87 of the present disclosure, wherein example 87 also includes the subject matter according to any one of examples 82 to 86, above.

Hydraulic cylinders are capable of applying the necessary forming force to generate the required forming pressure for operative deformation of workpiece 114. Accordingly, in one or more examples, at least one hydraulic cylinder 124 is used both for applying the forming pressure and for reconfiguring lower press assembly 102 between the loading configuration and the closed configuration. Additionally, when example 87 also includes the subject matter according to example 86, in one or more examples, at least one hydraulic cylinder 124 is used for reconfiguring lower press assembly 102 to the die-setup configuration.

Referring generally to FIG. 20 and particularly to, e.g., FIGS. 1 and 3-6, according to method 400, the step of (block 402) vertically moving lower press assembly 102 and upper press assembly 108 to the loading configuration and the step of (block 406) vertically moving lower press assembly 102 and upper press assembly 108 to the closed configuration comprise (blocks 424 and 426) vertically moving upper press assembly 108 with single drive-screw assembly 132. The preceding subject matter of this paragraph characterizes example 88 of the present disclosure, wherein example 88 also includes the subject matter according to any one of examples 82 to 87, above.

By utilizing single drive-screw assembly 132, the cost of the component(s) used to vertically move upper press assembly 108 is significantly reduced from prior art hot-forming presses. Moreover, in one or more examples, single drive-screw assembly 132 is positioned at the center of upper press assembly 108, thereby shielding single drive-screw assembly 132 from radiative heat emanating from hot box 300, including from lower die 106, upper die 112, and workpiece 114 upon being formed, such as when lower press assembly 102 and upper press assembly 108 are in the loading configuration for removal of a formed part and loading of workpiece 114.

Referring generally to FIG. 20 and particularly to, e.g., FIG. 1, according to method 400, the step of (block 412) heating workpiece 114 comprises a step of (block 428) sensing temperatures of distinct lower regions 146 of lower heating plate 144 of lower hot-box portion 104 of lower press assembly 102. The step of (block 412) heating workpiece 114 also comprises, responsive to sensing temperatures of distinct lower regions 146, a step of (block 430) actively and independently controlling heat, delivered to distinct lower regions 146. The preceding subject matter of this paragraph characterizes example 89 of the present disclosure, wherein example 89 also includes the subject matter according to any one of examples 82 to 88, above.

By sensing temperatures of distinct lower regions 146 of lower heating plate 144, the amount of heat, delivered to distinct lower regions 146, in one or more examples, is based on the sensed temperatures to ensure that distinct lower regions 146 of lower heating plate 144, and thus corresponding regions of lower die 106, are heated to desired temperatures for a particular operation.

Referring generally to FIG. 20 and particularly to, e.g., FIG. 1, according to method 400, distinct lower regions 146 comprise outer lower regions 228 and inner lower regions 230, positioned between outer lower regions 228. The step of (block 430) actively and independently controlling heat, delivered to distinct lower regions 146, comprises (block 432) delivering a greater amount of the heat to outer lower regions 228 than to inner lower regions 230. The preceding subject matter of this paragraph characterizes example 90 of the present disclosure, wherein example 90 also includes the subject matter according to example 89, above.

By delivering a greater amount of heat to outer lower regions 228 than to inner lower regions 230, a uniform, or desired, temperature profile is established, in one or more examples, across a span of lower heating plate 144, as outer lower regions 228 lose heat more rapidly than inner lower regions 230 due to conduction away from lower heating plate 144.

Referring generally to FIG. 20 and particularly to, e.g., FIG. 1, according to method 400, the step of (block 412) heating workpiece 114 comprises a step of (block 434) sensing temperatures of distinct upper regions 190 of upper heating plate 188 of upper hot-box portion 110 of upper press assembly 108. The step of (block 412) heating workpiece 114 also comprises, responsive to sensing temperatures of distinct upper regions 190, a step of (block 436) actively and independently controlling heat, delivered to distinct upper regions 190. The preceding subject matter of this paragraph characterizes example 91 of the present disclosure, wherein example 91 also includes the subject matter according to any one of examples 82 to 90, above.

By sensing temperatures of distinct upper regions 190 of upper heating plate 188, the amount of heat, delivered to distinct upper regions 190, is based, in one or more examples, on the sensed temperatures to ensure that distinct upper regions 190 of upper heating plate 188, and thus, corresponding regions of upper die 112 are heated to desired temperatures for a particular operation.

Referring generally to FIG. 20 and particularly to, e.g., FIG. 1, according to method 400, distinct upper regions 190 comprise outer upper regions 232 and inner upper regions 234, positioned between outer upper regions 232. The step of (block 436) actively and independently controlling heat, delivered to distinct upper regions 190, comprises (block 438) delivering a greater amount of the heat to outer upper regions 232 than inner upper regions 234. The preceding subject matter of this paragraph characterizes example 92 of the present disclosure, wherein example 92 also includes the subject matter according to example 91, above.

By delivering a greater amount of heat to outer upper regions 232 than to inner upper regions 234, in one or more examples, a uniform, or desired, temperature profile is established across a span of upper heating plate 188, as outer upper regions 232 lose heat more rapidly than inner upper regions 234 due to conduction away from upper heating plate 188.

Referring generally to FIG. 21 and particularly to, e.g., FIG. 1, method 500 of hot-forming workpiece 114 is disclosed. Method 500 comprises a step of (block 502) delivering an actively determined amount of heat to distinct lower regions 146 of lower heating plate 144 of lower hot-box portion 104 of hot box 300 of hot-forming press 100 or to distinct upper regions 190 of upper heating plate 188 of upper hot-box portion 110 of hot box 300. The preceding subject matter of this paragraph characterizes example 93 of the present disclosure, wherein example 93 also includes the subject matter according to example 92 above.

By delivering an actively determined amount of heat to distinct lower regions 146 and/or to distinct upper regions 190, in one or more examples, the temperature of distinct lower regions 146 and/or distinct upper regions 190 is controlled to provide desired heating of corresponding regions of workpiece 114. For example, in some cases it is desirable to heat the portions of workpiece 114 corresponding to tighter bends to be formed in workpiece 114. Additionally or alternatively, in some cases it is desirable to deliver greater heat to outer regions of workpiece 114 than to inner regions of workpiece 114 due to the conductive and radiative heat loss from the periphery of workpiece 114.

Referring generally to FIG. 21, according to method 500, the step of (block 502) delivering the actively determined amount of heat comprises (block 504) heating workpiece 114 to a temperature of at least 250° C., at least 500° C., or at least 750° C., or to a temperature in the range of 250-1000° C. The preceding subject matter of this paragraph characterizes example 94 of the present disclosure, wherein example 94 also includes the subject matter according to example 93, above.

Heating workpiece 114 to a desired temperature enables the yield strength, hardness, and ductility of workpiece 114, and ultimately of a part being formed from workpiece 114, to be controlled. That is, depending on the material selection for workpiece 114, in one or more examples, a temperature or temperature range is selected to be above the recrystallization temperature of the material to avoid string hardening of the material during the forming process. Moreover, heating workpiece 114 allows for high-strength materials to be formed at lower forming pressures than would be required in a cold-forming process.

Referring generally to FIG. 21, method 500 further comprises a step of (block 506) applying a forming force of at least 50 metric tons, at least 100 metric tons, at least 300 metric tons, at least 500 metric tons, at least 700 metric tons, at least 1000 metric tons, at least 2000 metric tons, or 50-2250 metric tons to workpiece 114. The preceding subject matter of this paragraph characterizes example 95 of the present disclosure, wherein example 95 also includes the subject matter according to example 93 or 94, above.

Forming pressures are selected based on material properties of workpiece 114 and the complexity of a part being formed from workpiece 114. Moreover, in one or more examples, higher forming pressures provide for lower temperature requirements to result in desired material properties of the part being formed from workpiece 114.

Referring generally to FIG. 21 and particularly to, e.g., FIG. 1, method 500 further comprises a step of (block 508) sensing temperatures of distinct lower regions 146 or of distinct upper regions 190. The actively determined amount of heat is based at least in part on the temperatures. The preceding subject matter of this paragraph characterizes example 96 of the present disclosure, wherein example 96 also includes the subject matter according to any one of examples 93 to 95, above.

By sensing temperatures of distinct lower regions 146 and/or of distinct upper region 190, the amount of heat, delivered to distinct lower regions 146 and/or distinct upper regions 190, is, in one or more examples, based on the sensed temperatures to ensure that distinct lower regions 146 and/or distinct upper regions 190 are heated to desired temperatures for a particular operation.

Referring generally to FIG. 21 and particularly to, e.g., FIG. 1, according to method 500, distinct lower regions 146 comprise outer lower regions 228 and inner lower regions 230, positioned between outer lower regions 228. Distinct upper regions 190 comprise outer upper regions 232 and inner upper regions 234, positioned between outer upper regions 232. The step of (block 502) delivering the actively determined amount of heat comprises (block 510) delivering a greater portion of the actively determined amount of heat to outer lower regions 228 than to inner lower regions 230 or (block 512) delivering the greater portion of the actively determined amount of heat to outer upper regions 232 than to inner upper regions 234. The preceding subject matter of this paragraph characterizes example 97 of the present disclosure, wherein example 97 also includes the subject matter according to example 96, above.

By delivering a greater amount of heat to outer lower regions 228 and/or to outer upper regions 232 than to inner lower regions 230 and/or inner upper regions 234, in one or more examples, a uniform, or desired, temperature profile is established across a span of workpiece 114, as outer lower regions 228 and outer upper regions 232 lose heat more rapidly than inner lower regions 230 and inner upper regions 234 due to conduction away from lower heating plate 144 and upper heating plate 188.

Examples of the present disclosure may be described in the context of aircraft manufacturing and service method 1100 as shown in FIG. 22 and aircraft 1102 as shown in FIG. 23. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 23, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

The invention claimed is:

1. A hot-forming press, comprising:

a lower press assembly, movable along a vertical axis and comprising:

a lower die; and a lower hot-box portion, configured to receive the lower die;

an upper press assembly, movable along the vertical axis above the lower press assembly and comprising:

an upper die; and an upper hot-box portion, configured to receive the upper die so that the upper die is positioned opposite the lower die;

a lower translation mechanism, operatively coupled to the lower press assembly and configured to move the lower press assembly along the vertical axis;

an upper press head;

an upper translation mechanism, configured only to move the upper press assembly along the vertical axis relative to the upper press head;

a locking rod, fixed to the upper press assembly and extending through the upper press head; and a rod clamp, fixed to the upper press head and configured to selectively clamp the locking rod, wherein:

the upper die is immobilized relative to the upper press head when the rod clamp clamps the locking rod;

the lower die and the upper die are configured to apply a forming pressure to a workpiece, received between the lower die and the upper die;

the lower hot-box portion and the upper hot-box portion are configured to heat the workpiece;

the lower press assembly and the upper press assembly are configured to be vertically movable to a loading configuration, in which the lower press assembly and the upper press assembly are spaced apart to receive the workpiece between the lower die and the upper die;

the lower press assembly and the upper press assembly are configured to be vertically movable to a closed configuration, in which the lower press assembly and the upper press assembly are positioned to apply the forming pressure to the workpiece between the lower die and the upper die;

the upper press assembly is configured to be selectively locked in the closed configuration;

the upper press assembly is locked in the closed configuration when the rod clamp clamps the locking rod the lower translation mechanism is additionally configured to apply a forming force to the lower die to generate the forming pressure on the workpiece when the upper press assembly is locked in the closed configuration; and the upper translation mechanism is incapable of applying a forming force to the upper die when the locking rod is clamped by the rod clamp.

2. The hot-forming press according to claim 1, further comprising vertical supports, wherein:

the lower press assembly is moveable along the vertical supports;

the upper press assembly is movable along the vertical supports;

the lower press assembly further comprises a lower bolster plate , positioned beneath and vertically supporting the lower hot-box portion; and the vertical supports extend through the lower bolster plate.

3. The hot-forming press according to claim 1, further comprising vertical supports, wherein:

the lower press assembly is moveable along the vertical supports;

the upper press assembly is movable along the vertical supports;

the upper press assembly further comprises an upper bolster plate, positioned above and vertically supporting the upper hot-box portion; and the vertical supports extend through the upper bolster plate.

4. The hot-forming press according to claim 1, wherein:

the lower translation mechanism comprises at least one hydraulic cylinder;

the hot-forming press further comprises a lower press head;

the lower press assembly is vertically movable relative to the lower press head; and the at least one hydraulic cylinder is operatively coupled between the lower press assembly and the lower press head to vertically move the lower press assembly relative to the lower press head and to apply the forming pressure to the workpiece.

5. The hot-forming press according to claim 1, wherein:

the upper translation mechanism comprises a single drive-screw assembly; and the single drive-screw assembly is operatively coupled between the upper press assembly and the upper press head to vertically move the upper press assembly relative to the upper press head.

6. The hot-forming press according to claim 1, wherein the lower press assembly is configured to be vertically moved to a die-setup configuration, in which the lower die is spaced apart from the lower hot-box portion for selective removal and replacement of the lower die.

7. The hot-forming press according to claim 6, further comprising at least one lower-die lift pin, extending into the lower hot-box portion and positioned to operatively engage the lower die, and wherein:

the lower press assembly is vertically movable relative to the at least one lower-die lift pin; and when the lower press assembly is vertically moved to the die-setup configuration, the at least one lower-die lift pin positions the lower die above the lower hot-box portion for selective removal and replacement of the lower die.

8. The hot-forming press according to claim 1, wherein:

the lower hot-box portion comprises:

a lower housing;

a lower heating plate, received within the lower housing, configured to be in contact with the lower die, and comprising distinct lower regions; and a lower insulation layer, positioned between the lower housing and the lower heating plate; and the lower press assembly further comprises a lower heat source, configured to deliver an actively determined amount of heat to the distinct lower regions of the lower heating plate.

9. The hot-forming press according to claim 8, wherein:

the lower heating plate and the lower housing collectively define lower heating-rod passages;

the lower heat source comprises lower heating rods, extending into the lower heating-rod passages; and the lower heating rods are straight along entire lengths of the lower heating rods.

10. The hot-forming press according to claim 9, wherein:

the lower heat source further comprises:

a lower connecting box; and lower connecting cables, interconnecting the lower heating rods to the lower connecting box;

the lower press assembly further comprises a lower bolster plate, positioned beneath and vertically supporting the lower hot-box portion;

the lower connecting box is mounted to the lower bolster plate; and the lower bolster plate shields the lower connecting box from heat, when the heat radiates from the lower hot-box portion.

11. The hot-forming press according to claim 9, wherein:

each of the lower heating rods comprises lower heating zones;

temperatures of the lower heating zones are independently controlled; and the lower heating zones coincide with the distinct lower regions of the lower heating plate.

12. The hot-forming press according to claim 11, wherein:

the lower heating zones comprise outer lower zones and at least one inner lower zone, positioned between the outer lower zones; and the outer lower zones have higher heating capacities than the at least one inner lower zone.

13. The hot-forming press according to claim 12, wherein:

the lower hot-box portion has a lower front side and a lower rear side;

the lower hot-box portion is configured to receive the lower die in a position that is closer to the lower front side than to the lower rear side; and the outer lower zones that are proximate to the lower front side have higher heating capacities than the outer lower zones that are proximate to the lower rear side.

14. The hot-forming press according to claim 10, further comprising:

lower temperature sensors, configured to sense temperatures of the distinct lower regions of the lower heating plate; and a controller, operatively coupled to the lower connecting box and configured to control the actively determined amount of heat, delivered to the distinct lower regions of the lower heating plate, based at least in part on the temperatures of the distinct lower regions of the lower heating plate.

15. A method of hot-forming a workpiece using the hot forming press of claim 1, the method comprising steps of:

vertically moving both the lower press assembly and the upper press assembly to the loading configuration;

positioning the workpiece between the lower die of the lower press assembly and the upper die of the upper press assembly;

vertically moving both the lower press assembly and the upper press assembly to the closed configuration;

clamping the locking rod with the rod clamp to immobilize the upper press assembly;

moving the lower press assembly toward the upper press assembly to apply the forming pressure to the workpiece; and heating the workpiece.

16. A method of hot-forming a workpiece using the hot forming press of claim 1, the method comprising a step of delivering an actively determined amount of heat to distinct lower regions of a lower heating plate of the lower hot-box portion of a hot box of the hot-forming press or to distinct upper regions of an upper heating plate of the upper hot-box portion of the hot box.

17. The hot-forming press according to claim 1, wherein:

the lower hot-box portion comprises:

a lower housing;

a lower heating plate, received within the lower housing and configured to support the lower die; and a lower insulation layer, positioned between the lower housing and the lower heating plate;

the lower housing comprises a lower base plate and lower side walls, positioned above the lower base plate;

the lower heating plate defines a lower slot, configured to receive a lower coupler for operatively retaining the lower die to the lower heating plate; and the lower side walls define a lower access passage, configured to provide access to the lower slot for operative insertion and removal of the lower coupler.

18. The hot-forming press according to claim 1, wherein:

the upper hot-box portion comprises:

an upper housing;

an upper heating plate, received within the upper housing and configured to support the upper die; and an upper insulation layer, positioned between the upper housing and the upper heating plate;

the upper housing comprises an upper top plate and upper side walls, positioned below the upper top plate;

the upper heating plate defines an upper slot, configured to receive an upper coupler for operatively retaining the upper die to the upper heating plate; and the upper side walls define an upper access passage, configured to provide access to the upper slot for operative insertion and removal of the upper coupler.

19. The hot-forming press according to claim 1, wherein:

the lower hot-box portion comprises:

a lower housing;

a lower heating plate, received within the lower housing and supporting the lower die; and a lower insulation layer, positioned between the lower housing and the lower heating plate;

the upper hot-box portion comprises:

an upper housing;

an upper heating plate, received within the upper housing and supporting the upper die; and an upper insulation layer, positioned between the upper housing and the upper heating plate;

the lower hot-box portion and the upper hot-box portion provide a thermal barrier around a workpiece when the lower hot-box portion and the upper hot-box portion are in contact with each other and the workpiece is received between the lower die and the upper die;

the lower housing comprises a lower base plate and lower side walls, positioned above the lower base plate;

the lower heating plate defines a lower heating-plate volume, sized to receive and operatively position the lower die relative to the upper die;

the lower hot-box portion has a lower front side and a lower rear side;

the lower heating-plate volume is positioned closer to the lower front side than to the lower rear side;

the lower die is positioned within the lower heating-plate volume such that the lower die is positioned closer to the lower front side than to the lower rear side;

the upper housing comprises an upper top plate and upper side walls, positioned below the upper top plate;

the upper heating plate defines an upper heating-plate volume, sized to receive and operatively position the upper die;

the upper hot-box portion has an upper front side and an upper rear side;

the upper heating-plate volume is positioned closer to the upper front side than to the upper rear side; and the upper die is positioned within the upper heating-plate volume such that the upper die is positioned closer to the upper front side than to the upper rear side.

20. The hot-forming press according to claim 4, wherein the lower press head is positioned below a floor surface.

21. The hot-forming press according to claim 1, wherein the upper translation mechanism has a longer stroke than the lower translation mechanism.

* * * * *